US008714874B2

(12) United States Patent
Tunget

(10) Patent No.: US 8,714,874 B2
(45) Date of Patent: May 6, 2014

(54) APPARATUS AND METHODS FOR FORMING AND USING SUBTERRANEAN SALT CAVERN

(76) Inventor: Bruce A. Tunget, Aberdeen (GB)

( * ) Notice: Subject to any disclaimer, the term of this patent is extended or adjusted under 35 U.S.C. 154(b) by 698 days.

(21) Appl. No.: 12/803,283

(22) Filed: Jun. 22, 2010

(65) Prior Publication Data

US 2011/0206459 A1 Aug. 25, 2011

Related U.S. Application Data

(63) Continuation-in-part of application No. 12/587,360, filed on Oct. 6, 2009, now Pat. No. 8,397,819.

(51) Int. Cl.
*E21B 43/12* (2006.01)

(52) U.S. Cl.
USPC ..... 405/59; 405/53; 405/55

(58) Field of Classification Search
USPC ..... 405/53, 54, 55, 59
See application file for complete search history.

(56) References Cited

U.S. PATENT DOCUMENTS

| | | | | |
|---|---|---|---|---|
| 366,988 | A | 7/1887 | Wiester | |
| 3,949,559 | A | 4/1976 | Meyer | |
| 4,117,684 | A | 10/1978 | Hendrix | |
| 4,134,619 | A | 1/1979 | Bunnelle | |
| 4,224,800 | A | 9/1980 | Grennard | |
| 4,365,978 | A * | 12/1982 | Scott | 95/255 |
| 4,435,290 | A | 3/1984 | Lindorfer et al. | |
| 4,572,707 | A | 2/1986 | Sagefors | |
| 4,624,130 | A | 11/1986 | Faul et al. | |
| 4,716,758 | A | 1/1988 | Amantini | |
| 4,720,995 | A | 1/1988 | Thiel | |
| 4,949,749 | A | 8/1990 | Fowler et al. | |
| 5,052,856 | A | 10/1991 | Tek | |
| 5,129,759 | A | 7/1992 | Bishop | |
| 5,366,030 | A * | 11/1994 | Pool et al. | 175/215 |
| 5,394,943 | A | 3/1995 | Harrington | |
| 5,431,482 | A | 7/1995 | Russo | |
| 5,511,905 | A | 4/1996 | Bishop et al. | |
| 5,669,734 | A | 9/1997 | Becnel et al. | |
| 6,026,349 | A | 2/2000 | Heneman | |
| 6,460,936 | B1 * | 10/2002 | Abramov et al. | 299/17 |
| 6,637,207 | B2 | 10/2003 | Konezciny et al. | |
| 6,688,702 | B1 | 2/2004 | Abramov et al. | |
| 6,813,893 | B2 | 11/2004 | Bishop et al. | |
| 6,945,055 | B2 | 9/2005 | Bishop et al. | |
| 7,036,325 | B2 | 5/2006 | Bishop et al. | |
| 7,097,386 | B2 | 8/2006 | Maudell et al. | |
| 7,151,465 | B2 | 12/2006 | Barbot et al. | |
| 7,156,579 | B2 | 1/2007 | Castle et al. | |

(Continued)

FOREIGN PATENT DOCUMENTS

| | | |
|---|---|---|
| GB | 2 454 895 | 5/2009 |
| WO | WO 00/36270 | 6/2000 |

*Primary Examiner* — Benjamin Fiorello

(57) ABSTRACT

Apparatus for solution mining and gas storage in a salt cavern formed by solution mining comprises a flow diverting conduit string is provided in fluid communication with two or more concentric conduits within the single main bore, with at least one lateral opening from an internal passageway with an outer annular passageway communicating with the surface under a single valve tree. Flow control devices, flow diverters and/or isolation conduits can be inserted into the flow diverting conduit string, enabling a dissolution zone in the salt cavern to be varied to control the shape of the cavern. Furthermore the flow diverting conduit string used to form the cavern can also be used for dewatering and gas storage.

21 Claims, 19 Drawing Sheets

(56) References Cited

U.S. PATENT DOCUMENTS

| | | | |
|---|---|---|---|
| 7,198,108 | B2 | 4/2007 | Joynson |
| 7,258,508 | B2 | 8/2007 | McCoy et al. |
| 7,322,387 | B2 | 1/2008 | Landry et al. |
| 7,729,976 | B2 | 6/2010 | Hill et al. |
| 2008/0127655 | A1 | 6/2008 | Landry et al. |
| 2009/0013697 | A1 | 1/2009 | Landry et al. |

* cited by examiner

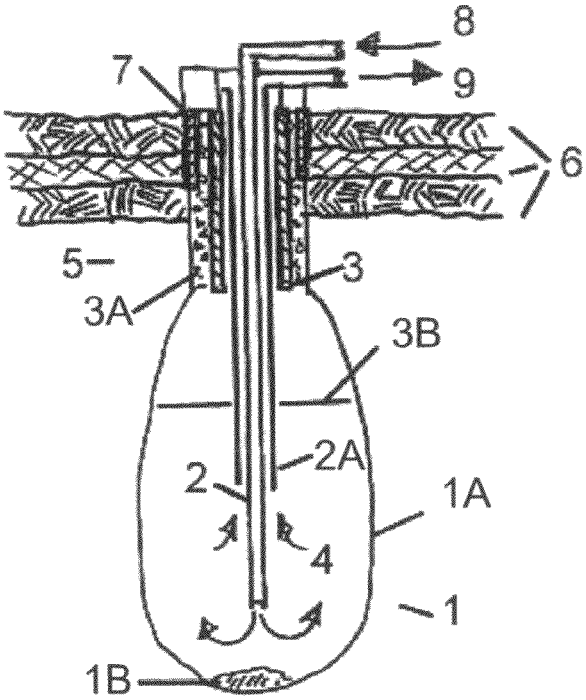
Fig. 1 Prior Art
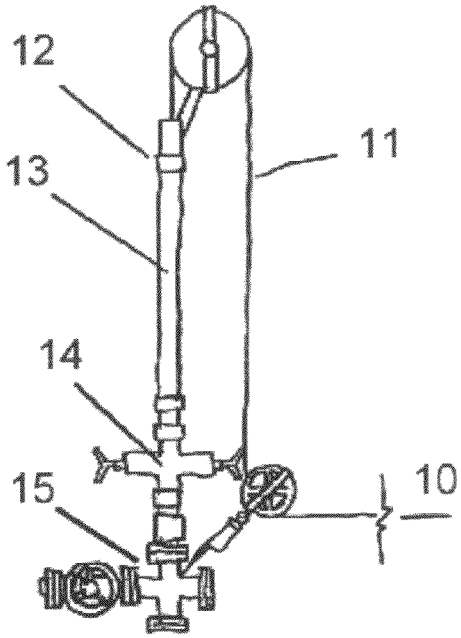
Fig. 3 Prior Art
Fig. 2 Prior Art
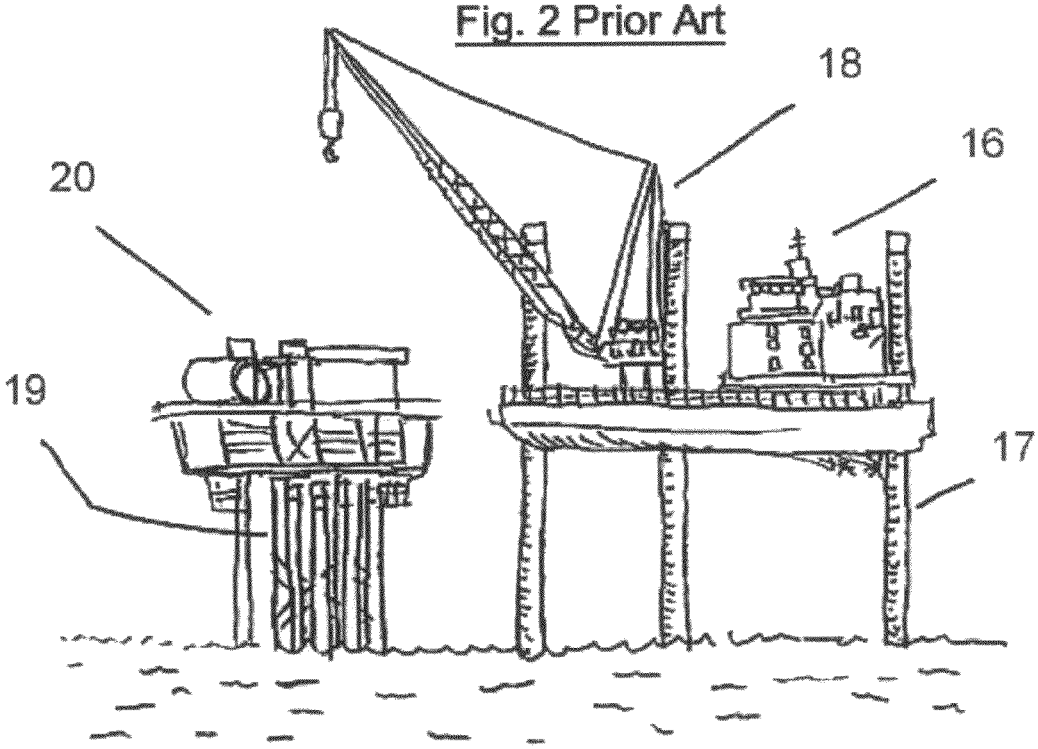

Section A-A

Section A-A

Section A-A

Section A-A

Section B-B

Section C-C

Section D-D

Section E-E

Section F-F

G
49
G
47
96

H
H 39
47
115
I
I
24
25
25

115
117
116
118
121
120
117
119

Section H-H
49
58A
96
50
47

SECTION G-G
51
25
2
115
121
2A
58
43
47
24
41
39
118
120
117
58
23
58
25
24
2
2A

Section I-I

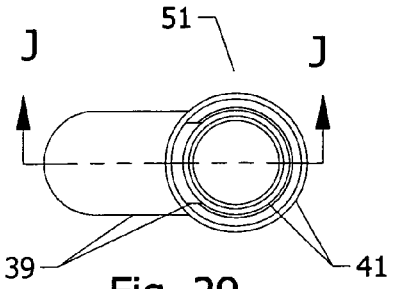
Fig. 29
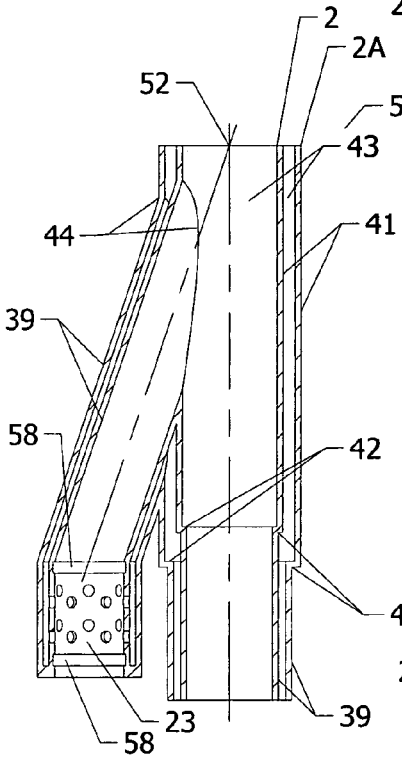
Fig. 30 Section J-J
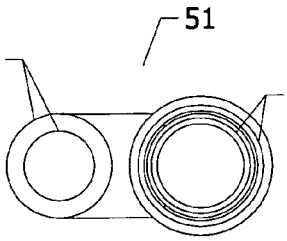
Fig. 30A
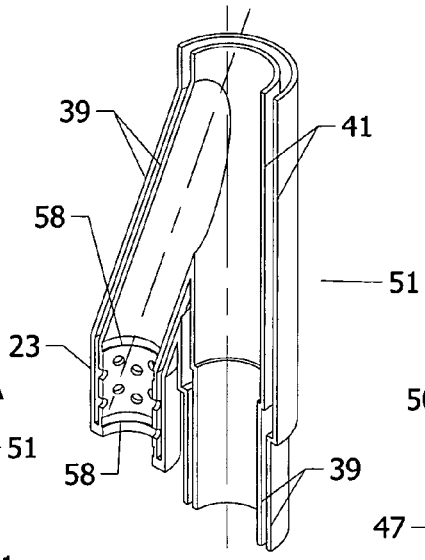
Fig. 30B Section J-J
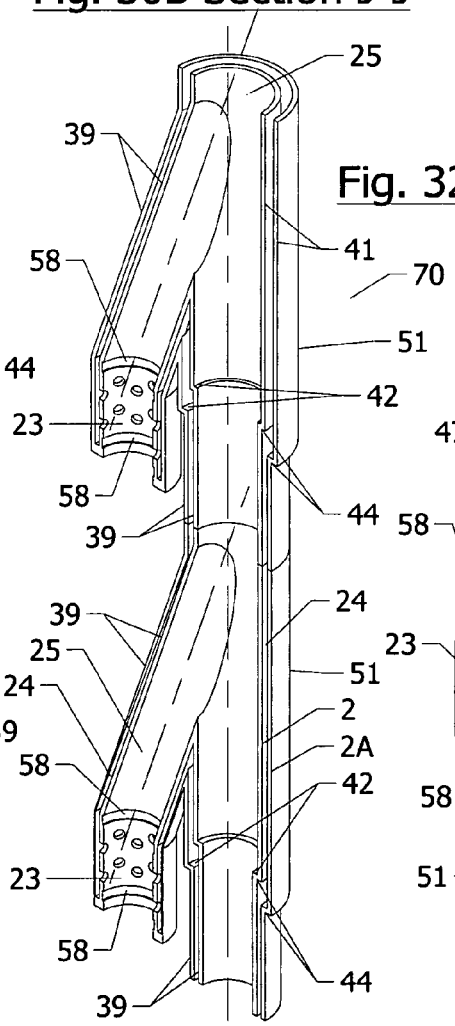
Fig. 30C Section J-J
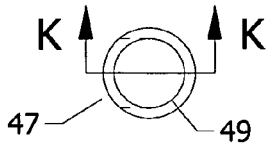
Fig. 31
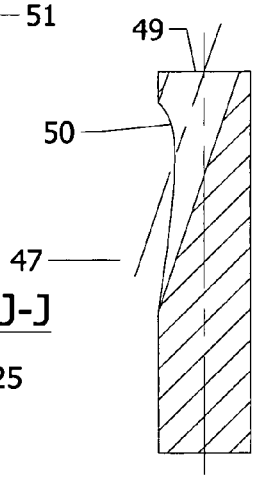
Fig. 32 Section K-K
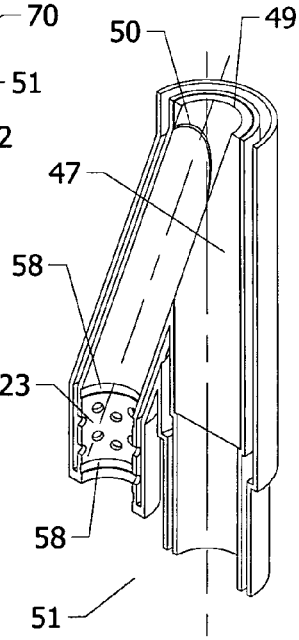
Fig. 32A Sections J-J & K-K

55
L
L
M
M
N
N

52

23

23
53
61
56
55
2
2A
58
60
22
59

Section L-L

Section M-M

Section N-N
57

O
55
39
O
21
25
24

61
56
49
60
21
50
47
2
2A
44
41
61
57

61
56
21
58
54
60
39
39
39
22
44
39
44
58
42A
60
39
57
61

Section O-O
61
21
58
39
39
2
2A
44
39
44
41
39
41
57

Section O-O

Fig. 45 Section P-P
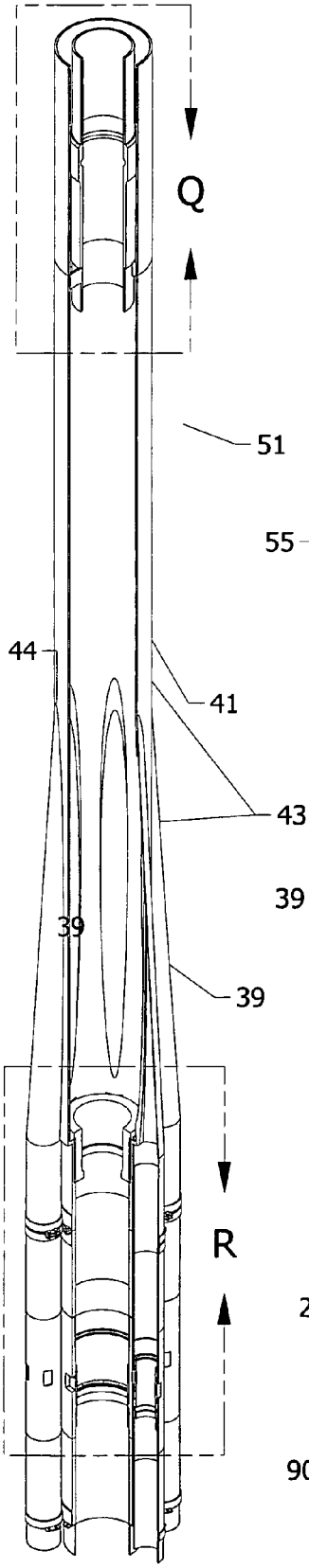
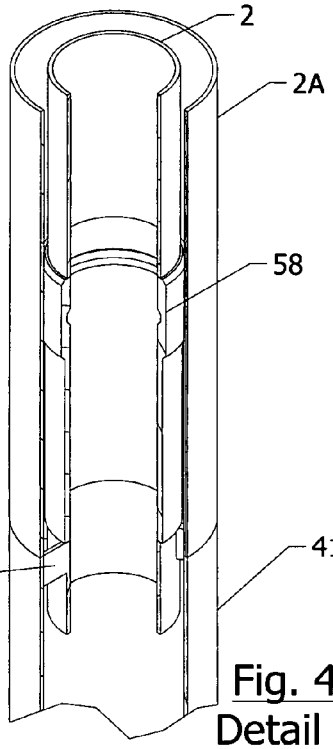
Fig. 46
Detail Q
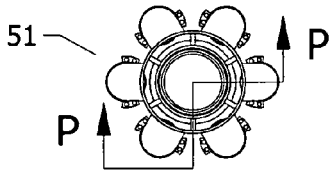
Fig. 44
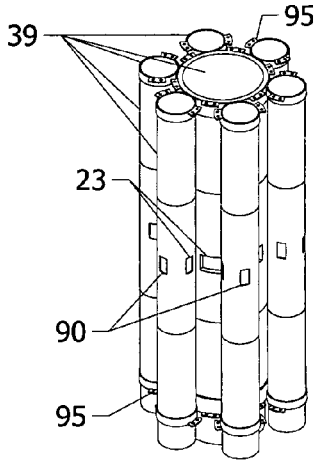
Fig. 50
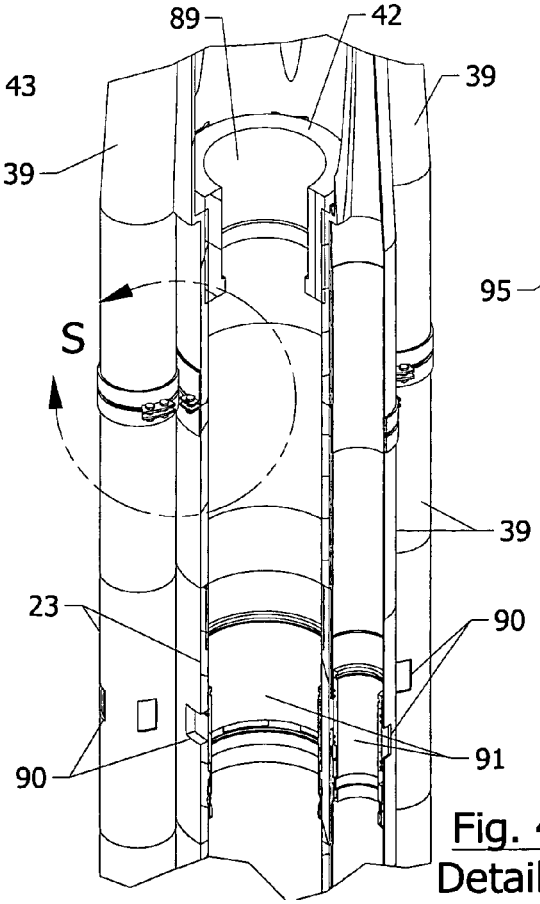
Fig. 47
Detail R
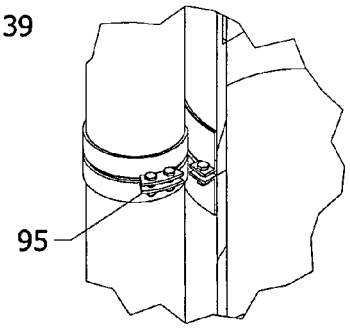
Fig. 48
Detail S
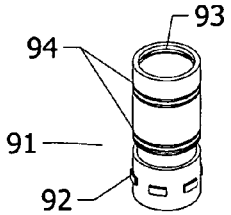
Fig. 49

T
T
2
2A
51
58
55
51
22
39
89
31
23
90
91
39
90
91
23
32

Section T-T

U
22
V 96
97

Detail U
97

Detail V
W
W
47

96
97
47
49
50
50
97
47

Section W-W

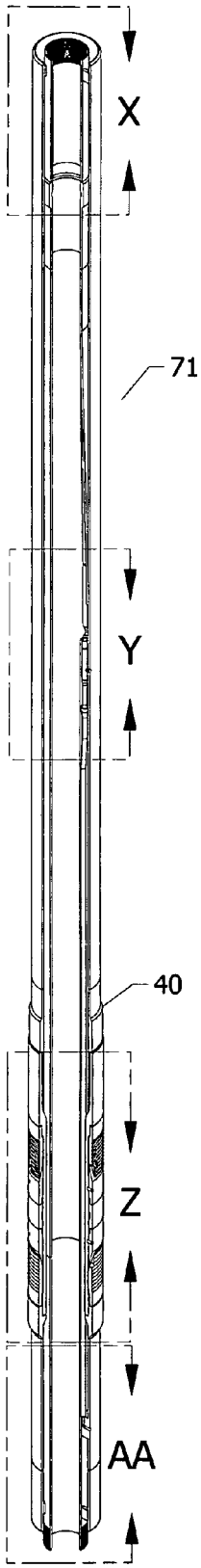
Fig. 59
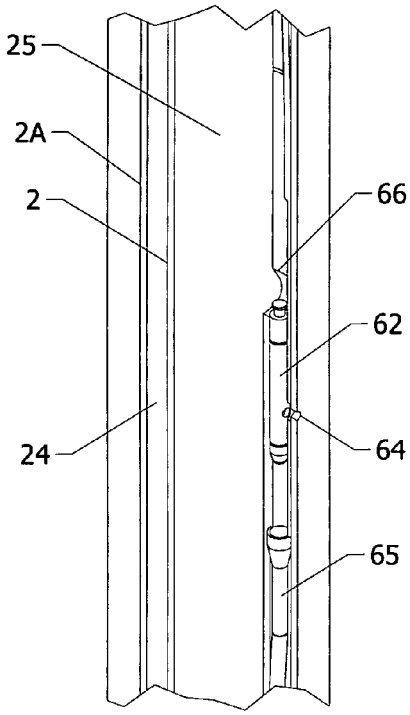
Fig. 61
Detail Y
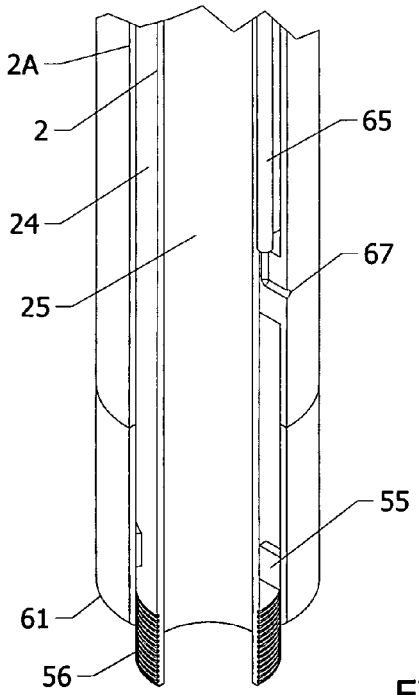
Fig. 63
Detail AA
Fig. 60
Detail X
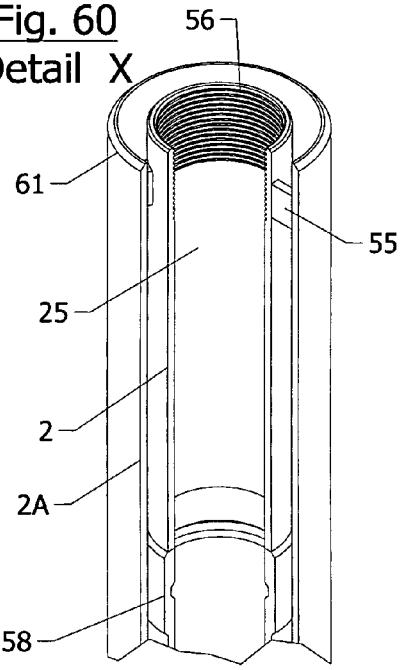
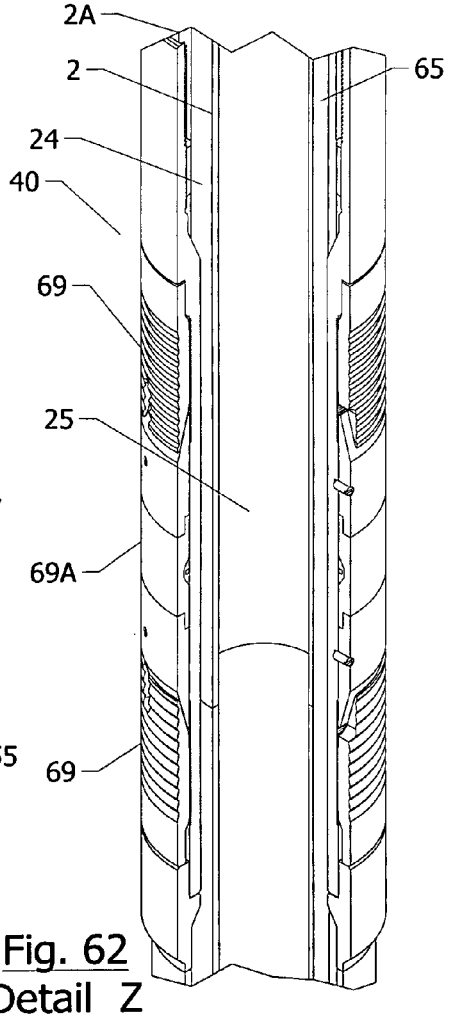
Fig. 62
Detail Z Detail AC Section AB-AB Section AD-AD Section AB-AB

22
AF
22
105
AG
97
80
2A
2

AH
78
22
79
81
96
97
2
2A
22

Detail AF
24
2
84
82
23
24
22
83

Detail AG
25
24
93
106
96
58
97
22

Detail AH

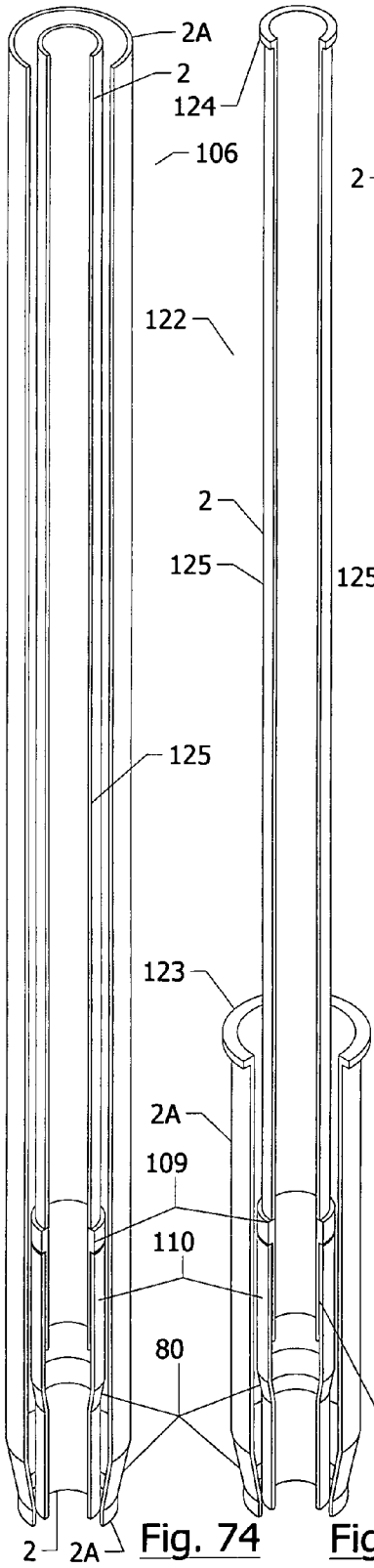
Fig. 74
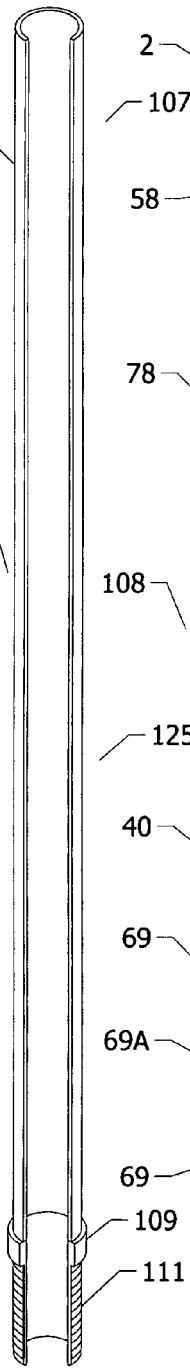
Fig. 74A
Fig. 75
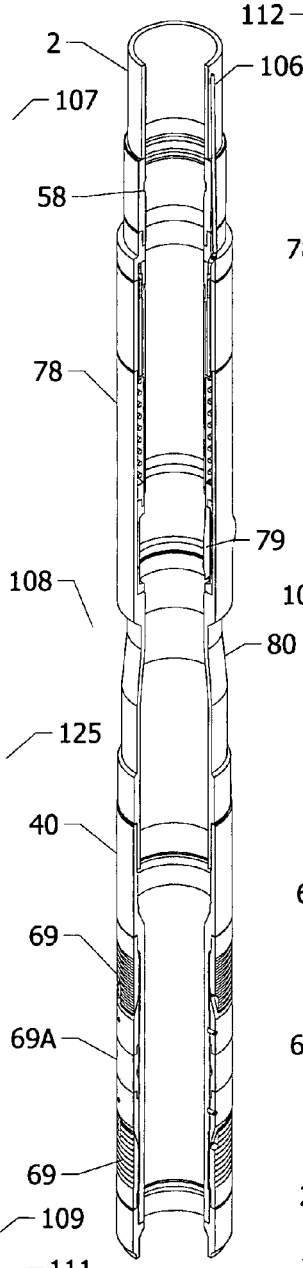
Fig. 76
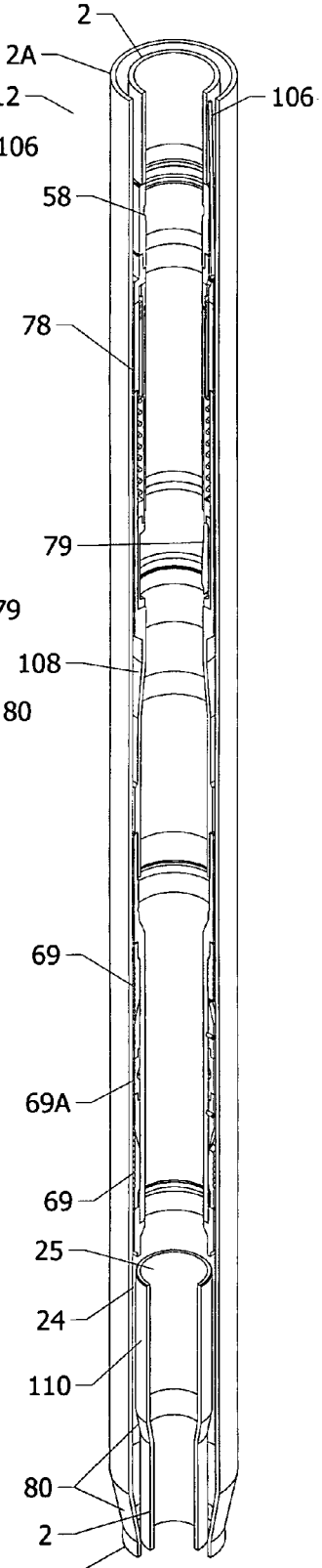
Fig. 77

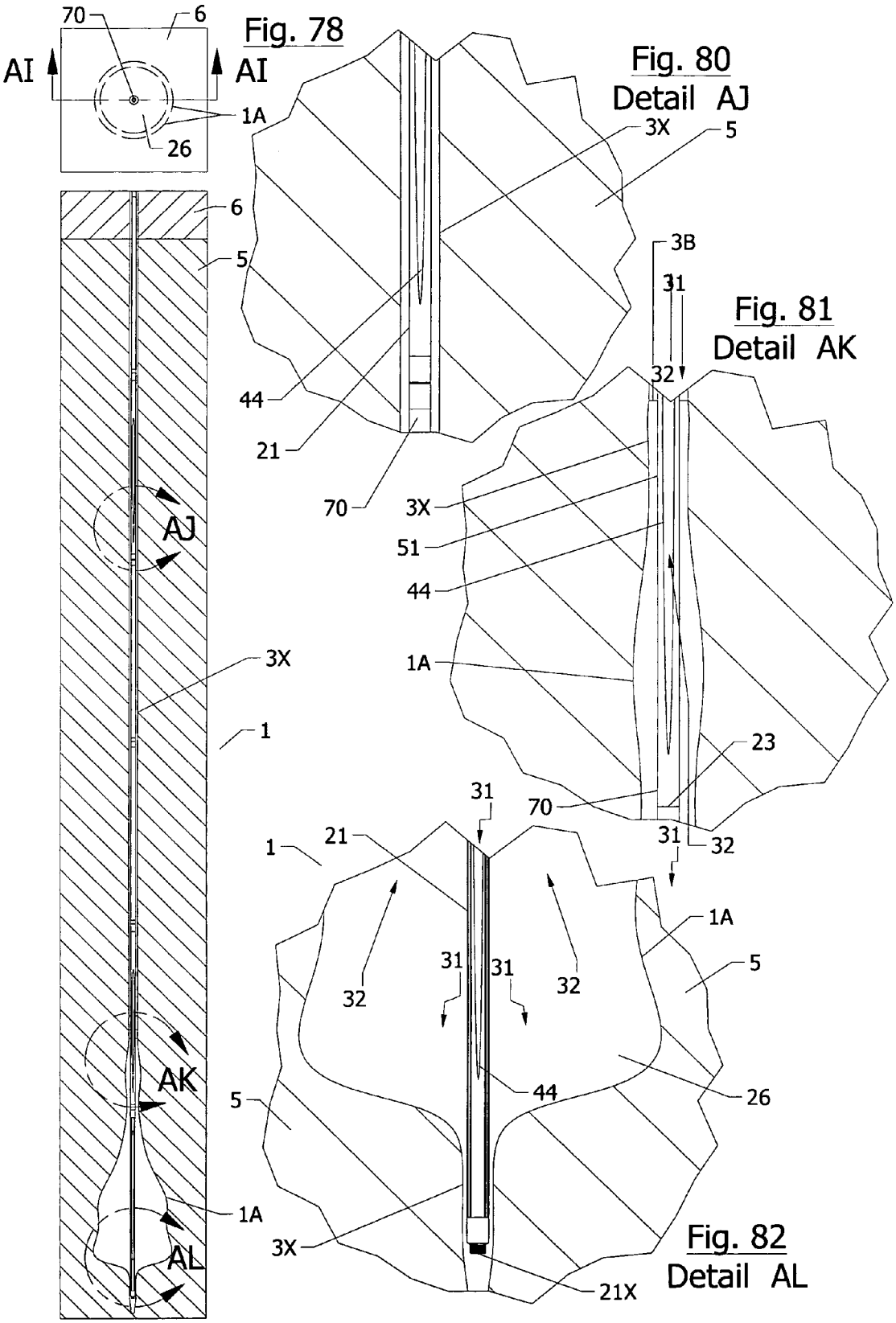
Fig. 79 Section AI-AI

AM
70
AM
26
6
1A

AN
70
AN
26
1A

AO
70
AO
26

34
33
40
65
3A
3
33
3B
21
51
34
23
25
2A
24
2
26
44X
5
39X
21X
34
23
1X
22
21
44
22
51
23
80
1B
23A
6
5
21
3B
70
1
23
3B
1A
51
33
33
26
32
32
1A
21
33
33
32
32
1A
21
6
5
21
33
33
70
3C
26
23
51
38
38
1A
32
32
21

Section AM-AM
Section AN-AN
Section AO-AO

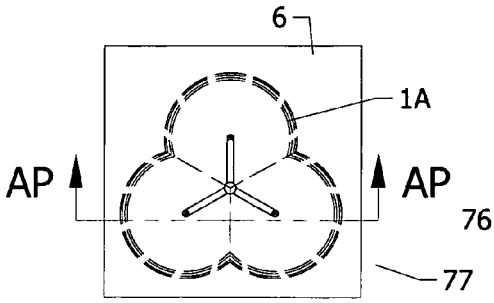
Fig. 90
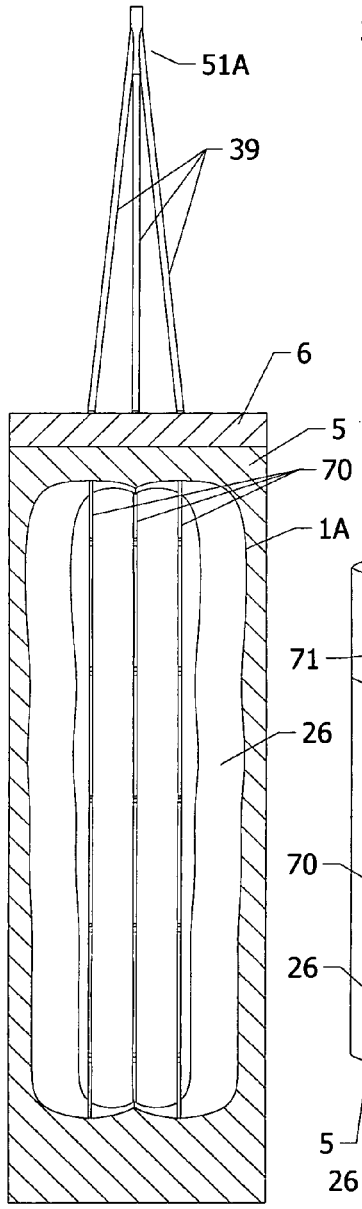
Fig. 91
Section AP-AP
Fig. 89
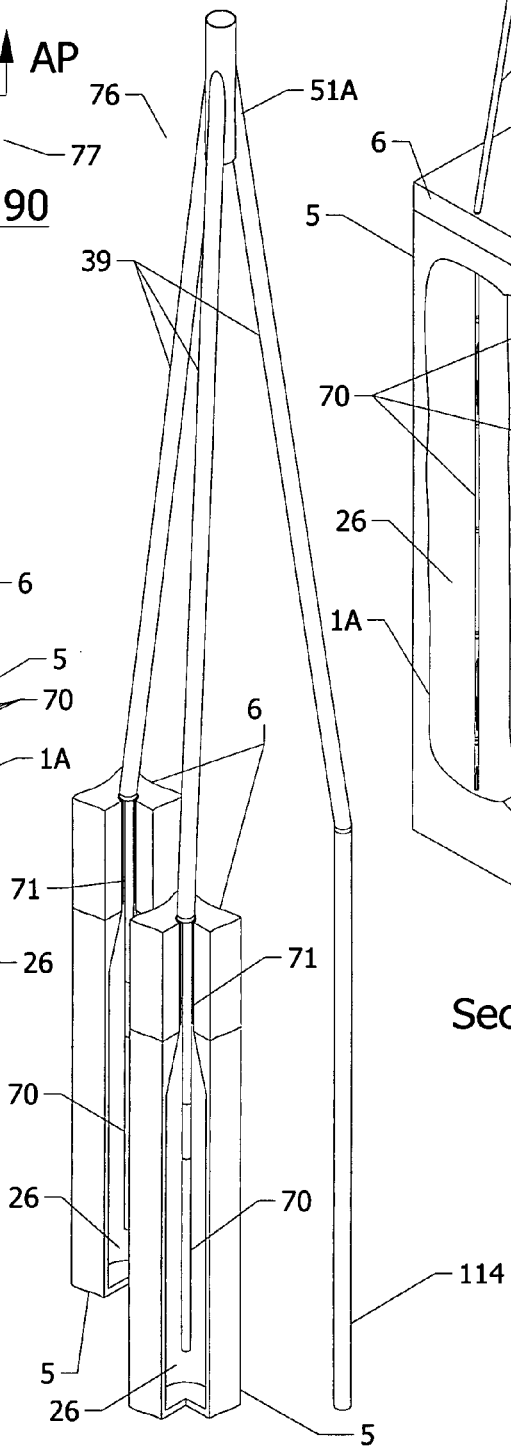
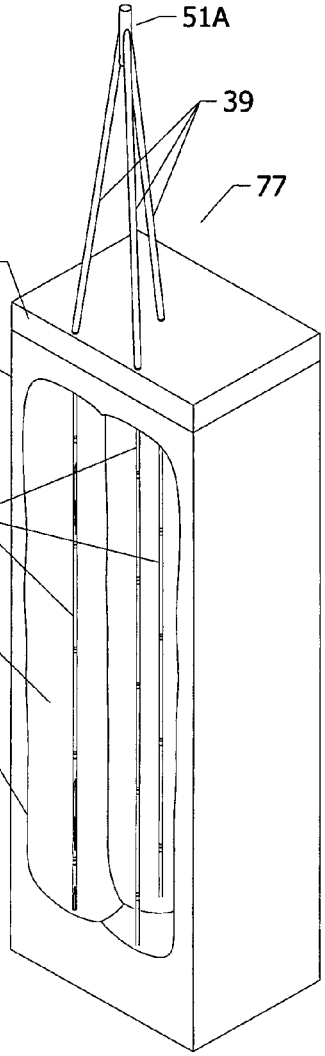
Fig. 92
Section AP-AP Section AQ-AQ Detail AR Detail AS Section AT-AT Section AT-AT Detail AU Detail AV Detail AW Detail AX

APPARATUS AND METHODS FOR FORMING AND USING SUBTERRANEAN SALT CAVERN

CROSS-REFERENCE TO RELATED APPLICATIONS

The present application is a continuation-in-part application, which claims priority to the United Kingdom patent application having Application Serial Number GB0920214.4, entitled "Apparatus and Methods for Operating a Plurality of Wells through a Single Bore," filed Nov. 19, 2009, the U.S. patent application having application Ser. No. 12/587,360, entitled "Systems and Method for Operating a Plurality of Wells through a Single Bore," filed Oct. 6, 2009, the United Kingdom patent application having Patent Application Number 0911672.4, entitled "Through Tubing Cable Rotary System," filed Jul. 6, 2009, the United Kingdom patent application having Patent Application Number 0910779.8, entitled "Large Volume Low Temperature Well Structure," filed Jun. 23, 2009, and the United Kingdom patent application having Patent Application Number 1004961.7, entitled "Apparatus And Methods For Operating One Or More Solution Mined Storage Wells Through A Single Bore," filed Mar. 25, 2010, each of which are incorporated herein in their entirety by reference.

FIELD

The present invention relates to a conduit string for forming a subterranean salt cavern, to methods of forming a subterranean salt cavern by solution mining (leaching), and to methods of using a subterranean salt cavern involving storing fluid (e.g. gaseous fluids or liquid hydrocarbon) in or extracting fluid (e.g. gaseous fluids or liquid hydrocarbon) from a subterranean salt cavern. The term subterranean includes subsea and indeed the present invention is particularly applicable to subsea salt caverns and offshore installations.

BACKGROUND

As demand for energy varies by the time of day and year, continuous supply depends on storage of energy to meet peak requirements in excess of a base energy demand. To level peak usage requirements, gas or liquid hydrocarbons can be stored in large quantities during periods of excess supply, and then released from storage during periods of insufficient supply. Furthermore compressed air may be generated by e.g. wind power, stored in a subterranean salt cavern, and subsequently released and used to generate power with pneumatic motors during periods of high demand and/or during periods when, e.g. wind speeds or output levels of other naturally available power sources are low.

Storing hydrocarbon gas involves compression and/or liquefaction of gas and pumping the compressed and/or liquefied hydrocarbons into large volumetric spaces, while naturally liquid hydrocarbons are simply pumped into said large volumetric spaces.

Embodiments of the present invention relate to the creation and operation of large-volume storage caverns formed in subterranean salt deposits, located on-shore and off-shore, primarily used for the storage of gases and/or liquids, such as hydrocarbons used in the supply of energy.

The present invention relates, generally, to apparatuses, systems and methods usable to create and operate solution mined storage wells. Embodiments of the systems and methods can be used in controlling the formation of the storage wells within salt deposits, controlling and directing the flow of the liquid and/or gas into or out from the wells, and for performing operations, such as batch drilling, completion, solution mining or leaching, dewatering, and below ground gas or liquid storage operations.

Generally, above ground storage costs are greater than below ground storage costs, because the utility of inhabitable above ground space is greater than uninhabitable below ground space.

Thus, conventional methods include below ground mining of a storage facility to create large liquid and gas tight storage spaces for hydrocarbon gas or liquids, known as solution mining, leaching, or leach mining, of subterranean salt deposits.

Leach mining of a subterranean salt deposit involves placing a well bore in the salt deposit and pumping water into the salt deposit to dissolve the salt, then extracting the salt laden brine to create a cavern below ground where gas may be stored.

The density of high quality subterranean salt deposits creates a gas tight barrier for storage of said hydrocarbon gases and liquids, once the entry point into the salt is sealed.

Generally, onshore leach mining of subterranean salt deposits is less resource demanding than offshore leach mining of subterranean salt deposits because facilities must be built above ocean level to facilitate said offshore leach mining. The majority of leach mining operations to-date have therefore occurred onshore using relatively simple construction methods.

Additionally, the limited quantity of onshore high quality subterranean salt deposits close to hydrocarbon gas transmission facilities often limits the number of solution mined onshore storage facilities that may be constructed.

However, there are sometimes high quality salt deposits offshore in proximity to large quantities of hydrocarbon production or transmission facilities, generating utility for constructing offshore gas storage facilities in the form of salt storage gas caverns where no suitable onshore deposits exist.

Unfortunately, the relatively simple technology and methods for construction of onshore gas storage facilities are not cost or resource effective given the high costs and complex logistics of working in a confined space offshore.

Conventional onshore methods and apparatuses for solution mining are particularly unsuitable for offshore applications due to the number of required drilling and/or work-over rig visits to construct a cavern, and due to the high cost of the offshore operations and sea state requirements of moving such ocean going vessels.

As onshore construction methods and apparatuses are impractical and oil industry existing or prior art apparatuses are often unsuitable, no fit-for-purpose existing or prior art offshore construction methods or offshore gas storage cavern apparatuses exist.

Embodiments of the present methods, systems, and apparatuses are capable of withstanding the thermal cycling involved with intermittently compressing and expanding large volumes of gas, storing liquids, dewatering and solution mining to reduce the quantity of resources needed, by simplifying the logistics required for construction of an offshore gas storage cavern with a single flow diverting string usable to perform necessary functions, which would require multiple string installations and removals when using conventional apparatuses, systems and methods.

Generally, practitioners create bore holes into subterranean salt deposits and place conduit segments, such as casing joints, between the subterranean strata and the bore passageway using metallurgical sealing, i.e. welding, to secure each conduit segment or casing joint.

Practitioners in salt cavern well construction often weld the casing joints together to improve the thermal cycling of properties of the conduit or casing string. After placing welded casing strings in the bore hole, practitioners place cement between the subterranean strata and the welded casing string.

An embodiment of the method of the present invention, can include using an existing snap together coupling connection, not presently used in the art of constructing and using storage spaces in salt deposits, to remove the need to weld casing and, thus, save significant time.

Thus, the common practice for creating a series of bore holes emanating from previous casing bores through subterranean strata includes repeating the process of welding and cementing casing, followed by boring until the top of a desired subterranean salt deposit is reached.

Once a bore hole has been urged through the subterranean salt deposit, and a welded casing has been cemented in place above the depth where the solution mined storage space is intended, practitioners in the art of gas cavern wells generally place threaded conduits or casing strings, referred to as leaching strings, within the welded casing string and bore hole, extending downward from the casing through the subterranean salt deposit.

Using conventional methods, the leaching strings are only temporary conduits, requiring fluid pressure integrity during the solution mining process, thus threaded connections are used.

Embodiments of the present invention include a flow diverting string that can be permanently used during solution mining, dewatering, and storage operations to replace these leaching strings, and other strings normally used after removal of the leaching string.

In conventional practice, water is then pumped down these threaded casing strings, which creates dissolved salt or brine by placing water next to the salt deposit, that is returned through the annulus, between the threaded leaching casing strings, in a forward fashion and returned through the inner bore of the internal leaching string in a reverse fashion to improve the rate of salt dissolution.

For additional control and to prevent water from dissolving salt in undesired locations, a blanket comprised of gas, such as nitrogen, or a liquid, such as diesel, is placed through the annulus between the threaded leaching strings and the bore of the well or cavern wall.

Occasionally, the blanket is adjusted and/or the threaded casing is adjusted and/or removed from the well or cavern, and a device, such as sonar, is inserted into the bore to determine if the cavern is being created in the correct shape.

In conventional practice, if the cavern is not leaching as intended or solution mining is to be carried out in stages, the blanket and/or threaded casing are reconfigured one or more times to correct a misshapen cavern or to create space in a stepwise fashion by affecting the dissolution of salt during solution mining.

Using conventional methods, two concentric strings are used for the leaching, and a large hoisting rig is required to remove the inner string (2 of FIG. 1) before the rig can move the outer string (2A of FIG. 1) and re-install the inner string.

The conventional practice of raising the outer (2A of FIG. 1) leaching string is required to adjust the depth at which water is released from between the outer and inner (2 of FIG. 1) leaching strings during the prevalent method of allowing lighter water to float above and force heavier brine into the bore of the inner leaching string, thus increasing the salt saturation of the brine.

The primary convention means for determining when the depth of the inner or outer leaching string should be changed is by measuring the shape and extent of salt dissolution within the bore or cavern using a sonar tool. In instances where low resolution is acceptable, sonar measurements can be taken through the leaching strings; however, if high resolution measurements are required, the leaching strings must be removed before taking sonar measurements.

In conventional practice, threaded leaching string casing can be placed deep within the subterranean salt cavern and sections can be cut and allowed to fall to the bottom of the cavern to adjust the fluid circulation point and to prevent the sucking in of insoluble substances that have fallen to the bottom of the created space, after which leach mining of the subterranean salt deposit continues. The conventional practice of intermittent removal of the threaded casing, checking the cavern shape, cutting the casing, and removal and reinsertion of the threaded casing is logistically complex and expensive for onshore facilities, but even more expensive for offshore facilities.

The conventional process of repeating solution mining operations, measuring the cavern shape and potentially changing the depths of the inner and/or outer leaching strings is continued until the desired cavern volume and shape is created.

In conventional practices, after the gas or liquid storage cavern has been created, the threaded casing string is removed, and a welded casing is installed with a valve tree placed at the surface to control access to the storage cavern.

Conventional practice further includes placing a permanent production packer at the lower end of a welded production casing to be engaged with the final cemented casing above the salt cavern, and sealing the annulus between the production casing and the final cemented casing.

Once the production casing and permanent packer are installed, using conventional methods a dewatering string is installed through the production casing string and associated permanent packer to the lower end of the cavern.

Immediately after solution mining, the created cavern is full of brine. Conventional methods require the installation of a dewatering string through the valve tree, including any subsurface safety valves and the production casing, to the bottom of the cavern to remove the brine by forcing a stored fluid or gas into the cavern to urge the brine to the surface through the dewatering string.

Conventional practice is to force brine from a cavern with the liquid or gases to be stored. This practice is often referred to as dewatering.

During storage operations, compressed gas may be allowed to expand during retrieval, but the cavern must be refilled with water or brine to retrieve stored liquids or gas with insufficient pressure to escape the cavern. When compressed gas is stored within a cavern, a risk of escape exists where liquid stored within the cavern generally lacks the pressure to escape.

Hence, in conventional practice, subsurface safety valves are often installed within the conduits above a gas storage cavern to prevent escape of gas, where the subsurface safety valves are generally not needed in liquid storage caverns.

Where it the conventional practice to leave dewatering strings in liquid storage wells for storage and retrieval purposes, the general practice for gas storage caverns having subsurface safety valves is to remove the dewatering string after brine has been extracted through the dewatering process to allow any associated subsurface safety valves and/or valves of the surface valve tree to close conduits leading to the cavern to prevent the unintended escape of gases.

Removal of a dewatering string from a well and cavern full of compressed gas is a hazardous task, that requires expensive safety precautions to remove the dewatering string from the well and cavern, using a process referred to as stripping or snubbing.

Embodiments of the present invention include a flow diverting string that can be permanently left within the well to dewater during liquid storage operations, with internal portions removed to facilitate use of safety valves in gas storage operations, thus, removing the conventional need to perform hazardous stripping or snubbing operations.

As the diameters of salt caverns are limited by the ability to support the roof of the cavern, large salt cavern storage facilities require many caverns which, using conventional practices, require installing, using and removing a plurality of differing strings to first solution mine and, then, dewater each of the caverns, with gas storage caverns potentially requiring hazardous stripping and/or snubbing operations.

Conventional methods for performing operations on multiple wells within a region require numerous bores and conduits, coupled with associated valve trees, wellheads, and other equipment. Typically, above-ground conduits or above mudline-conduits and related pieces of leaching, production and/or injection equipment are used to communicate with each well. As a result, performing drilling, completion, dewatering, snubbing and other similar operations, within a region having numerous wells, can be extremely costly and time-consuming, as it is often necessary to install above-ground or above-mudline equipment to interact with each well, or alternatively, to erect a large rig, then after use, disassemble, jack down and/or retrieve anchors, and move the large rig to each successive well.

Conventional methods for the solution mining of a cavern within a salt deposit require, at a minimum, the mobilization of a large rig, its erection or installation, its use and its disassembly or disengagement from the well after drilling the well, and again after completing the well, and yet again after dewatering the well before the well can be used for gas or liquid storage operations. Any adjustment of the leaching strings, including removal of the inner leaching string prior to movement of the outer leaching string, requires additional large rig erections, work and disassembly, which further increases the costs and logistical complexity.

Significant hazards and costs exist for performing these same drilling, completions, leaching, dewatering, snubbing and other similar operations numerous times. The hazards and costs increase in harsh environments, such as those beneath the surface of the ocean, arctic regions, or situations in which space is limited, such as when operating from an offshore platform or artificial island. Additionally, the cost of above-ground, or above-mudline, valve trees and related equipment can be economically disadvantageous, and the use of such above-ground or above-mudline equipment can be subject to numerous environmental or other industry regulations that limit access and/or the number of wells, due to significant negative environmental impact.

Where movement, installation, performing work, disassembling and removing a large rig from a well or cavern site is often economically viable onshore during all but the worst weather conditions, the addition of offshore wind, waves and tidal movements can often prevent both the movement and operation of a large offshore rig potentially increasing the costs of constructing gas storage facilities in an offshore environment significantly.

A need exists for systems and methods usable for creating and operating a solution mined storage well, that provides greater efficiency and reduced expense over existing methods by reducing above-ground equipment requirements and reducing or eliminating the need to move, erect, and disassemble drilling and/or hoisting rigs and similar equipment between such operations as the drilling, completion, dewatering, snubbing and storage phases of a storage well or between a plurality of storage wells.

A need exists for systems and methods usable for creating and operating a solution mined storage well that can utilize less expensive and smaller wireline and slickline rigs, and alleviating the need for a plurality of subsequent installations and removals of large equipment that require the use of larger and more expensive hoisting rigs.

A need exists for systems and methods usable for creating and operating solution mined storage wells that can perform numerous operations, including batch drilling, completion, solution mining, dewatering, and gas and liquid storage operations, through a single installation of a string.

A need exists for systems and methods usable for constructing and operating large volumetric solution mined storage wells, within underground or subsea subterranean salt deposits, for lowering storage costs and conserving above ground space.

A need exists for systems and methods usable for constructing subsea or underground large, volumetric solution mined storage wells with great accuracy and control of the formation of the storage cavern.

A need exists for systems and methods usable for operating solution mined storage wells that enable operations, including completion, solution mining, dewatering, and gas and liquid storage operations, to be performed on multiple storage wells through a single main bore.

An object of the present invention is to meet at least some of the above needs, at least in preferred embodiments, and to overcome or alleviate at least some of the above-described problems in the prior art.

SUMMARY

Accordingly, in one embodiment of present invention, a conduit string (70, 76) is provided for injecting fluid into or extracting fluid from a subterranean borehole in salt or a subterranean salt cavern (26), said conduit string comprising: an inner conduit string (2) disposed within an outer conduit string (2A), with an inner passageway (25) in said inner conduit string and a first annular passageway (24) between said inner and outer conduit strings. The conduit string can also include at least one lateral opening (44, 64, 67, 90) in said inner or outer conduit string (2/2A), said lateral opening communicating with at least one of said passageways (24, 25) and with said borehole or cavern (26), and flow control means (21, 22, 23, 25A, 47, 51, 51A, 65, 71) arranged to control flow of said fluid between or along said passageways (24, 25) to enable said flow-diverting conduit string (70) to be used for storage and extraction of gases, liquid hydrocarbons, or combinations thereof, in and from said cavern (26) and at least one of solution mining operations, subterranean hydrocarbon separation and dewatering operations.

The enhanced versatility of the above conduit string reduces the complexity and cost of the operations needed during the various stages of solution mining, dewatering and use of a salt cavern.

In particular, flow diverting string embodiments of the present invention reduce the complexity and costs of both onshore and offshore construction and use of storage spaces in salt deposits by providing a single string where conventional apparatus and methods require multiple strings for solution mining, dewatering and storage operations.

Preferably, within said flow diverting string (70), a flow diverter (47) is disposed in said inner passageway (25) of said inner conduit string (2) and has a bore communicating between said inner passageway and said at least one lateral opening (44), said flow diverter allowing flow past said flow diverter through said first annular passageway (24), thus allowing the use of a single string.

In one embodiment an exit conduit extension (115) projects into said borehole or said cavern (26) through said bore of said flow diverter (47) and associated lateral opening and a cable carrying tools for deployment in said borehole or cavern extends through said exit conduit extension allowing measurement of said cavern to occur for subsequent reconfiguration of said flow diverter (47) within said flow diverting string with a reduced probability of wrapping said cable around said flow diverting string.

Flow diverting string embodiments of the present invention can be used efficiently in both onshore and offshore environments, and can function to reduce the complexity and costs of both onshore and offshore construction and use of storage spaces in salt deposits, by providing a single string where conventional apparatuses and methods require multiple strings for solution mining, dewatering and storage operations The present invention relates both to wells where a single bore with a storage cavern at its lower end is connected to a surface valve tree, and instances where it is desirable to have more than one subterranean well, with caverns at their lower ends that are engaged with a single surface valve tree. Preferred embodiments are described in FIGS. 79 to 92.

A benefit of selected embodiments of the present invention is the overcoming or alleviation of at least some of the above problems by combining the functionality of leaching strings, production strings and dewatering strings into a single string with a plurality of conduits to facilitate and control the functionality and to remove the need for multiple movements of large and expensive rigs to perform tasks that a smaller and significantly less expensive wireline or slickline rig, such as that shown in FIG. 3, is capable of performing.

Additionally, for gas storage, some existing oil industry equipment, such as threaded and coupled connections, are relatively useless due to abbreviated longevity when exposed to the thermal cycling of intermittently compressing and expanding large volumes of gas.

In one preferred embodiment the flow diverting string of the invention is formed from sections each comprising:

a) an inner conduit string section having threaded ends for screwing to complementary threaded ends of adjacent inner conduit string sections, and b) an outer conduit string section having ends which abut adjacent outer conduit string ends when the inner conduit string section is screwed to its adjacent inner conduit string ends, the inner conduit string ends being screwed together and the abutting outer conduit string ends being welded together.

In the above embodiment the outer conduit string, being welded, is capable of withstanding the thermal cycling involved with intermittently compressing and expanding large volumes of gas. The overall conduit string is useful for storing liquids, dewatering and solution mining In another preferred embodiment the flow diverting string of the invention is formed from sections each comprising:

a) an outer conduit string section having threaded or snap fitting ends for engagement to complementary threaded or snap fitting ends of adjacent outer conduit string sections, and b) an inner conduit string section having mandrel ends which are resiliently sealed to adjacent inner conduit string receptacle ends when the outer conduit string mandrel section is snapped or screwed to its adjacent outer conduit string ends.

Snap together coupling connections are known, but are not presently used in the art of constructing and using storage spaces in salt deposits. The above embodiment has the advantage of saving significant time by avoiding many welding operations.

An embodiment of the present invention includes an apparatus for operating one or more solution mined storage wells through a single main bore, that can include one or more flow diverting strings, which function as a leaching, dewatering and storage conduit system, and alleviate the need for a plurality of conventional conduit strings, that require a plurality of assemblies, uses, disassemblies and movements of a large hoisting rig to install and/or remove.

The flow diverting string and/or conduit systems can include internal passageways surrounded by annular passageways and one or more chamber junctions, that include an interior chamber disposed within an exterior chamber, with preferred embodiments described in FIGS. 7 to 22, FIGS. 27 to 32A, FIGS. 41 to 48 and FIGS. 51 to 52. The annular passageway of the fluid diverter string is defined between the interior and exterior chambers of the chamber junction and communicates with the annular passageway of the single main bore to form and use a cavern.

One or more internal passageways can extend outwardly from respective orifices in the interior chamber and into the annular passageway. Alternatively, the internal passageways can extend through the annular passageway, defined between the interior and exterior chambers, and/or through the exterior chamber, wherein the exit bore conduits have been truncated and secured at the outer diameter of the chamber, with preferred embodiments described in FIGS. 7 to 22, FIGS. 27 to 28 and FIGS. 41 to 43. Alternatively and/or additionally, the exit bore conduits can extend past the outer diameter of the chamber, with preferred embodiments described in FIGS. 29 to 30C, FIG. 32, FIGS. 44 to 48 and FIGS. 51 to 52. The internal passageways enable selective communication between the internal well bores and/or or annuli of the one or more solution mined storage wells and the one or more conduits.

Without removal from the well, the chamber junctions' selective communication can be arranged as a leaching string, dewatering string and storage string, that is usable for solution mining and operating a salt storage cavern with selective flow control devices and bore selectors, also referred to as flow diverters throughout the remainder of the application, with preferred embodiments described in FIGS. 4 to 6 and FIGS. 78 to 92. In instances where flow efficiency is not important or tool passage is not required, flow diverters can be replaced by any selective flow control device, such as a plug, and can be used to selectively communicate through an orifice of a chamber junction.

In an embodiment, the chamber junction internal passageways extend downwardly from an upper end of the interior chamber, and the system further includes a bore selection or flow diverter tool, that is sized for alignment with the orifices and located in a bore of the interior chamber. The bore communicates with at least one of the two or more internal passageways, an upper opening aligned with a first orifice of the interior chamber member, and at least one lower opening. Each of the lower openings can be aligned with a selected orifice of the interior chamber member, such that the bore selection or flow diverter tool prevents communication with at least one other orifice, with preferred embodiments described in FIG. 11, FIGS. 17 to 20, FIGS. 27 to 28, FIG. 32, FIG. 40, and FIGS. 56 to 58.

In an embodiment, the chamber junction can include a construction having a chamber and plurality of orifices, also referred to as lateral openings throughout the remainder of the present application, that intersect the chamber. Typically, a first of the orifices can be used to communicate with the surface through subterranean strata, via one or more conduits within the main bore, while one or more additional orifices, within the chamber junction, are usable to communicate with a single bore well or any number of well bores through associated conduits. Thus, a chamber junction can have any shape or arrangement of orifices necessary to engage a desired configuration of conduits.

In a preferred embodiment, an apparatus includes one or more concentric conduits flow crossovers, which can include a conduit surrounded by one or more concentric conduits. The internal conduit can have one or more orifice passageways within its walls, thus allowing communication between the inner bore and surrounding annulus, formed between the inner conduit and surrounding conduit, in the absence of a placeable and removable isolation conduit within the internal conduit's bore. The presence of the isolation conduit across the orifice passageways of the internal conduit prevents communication between the internal conduits bore and the surrounding annulus, with preferred embodiments described in FIGS. 4 to 6, FIGS. 15 to 16, FIGS. 35 to 38, FIGS. 41 to 42, FIGS. 51 to 55, FIGS. 70 to 73, FIG. 88A, FIGS. 95 and 97, FIGS. 98 to 99, FIG. 101, FIG. 102, and FIG. 104.

In an embodiment of the present invention, an annulus isolation apparatus, such as a production packer assembly, is used and can include a side pocket for a placeable and retrievable valve to control an annulus passageway across the annulus isolation apparatus, wherein the flow of gases or liquids in the annulus can be controlled, with preferred embodiments described in FIGS. 59 to 63.

In a preferred embodiment the invention provides a flow diverting conduit string arrangement (76) comprising at least one flow diverting string (70) as defined above, disposed within a dissolution zone, and a further conduit string (39, 70, 114) communicating with and branching from said at least one lateral opening of said first-mentioned flow diverting string, said further conduit string having at least one downhole opening locatable in a production zone or dissolution zone associated with said borehole and comprising an inner conduit string (2) disposed within an outer conduit string (2A), with an inner passageway (25) in said inner conduit string being disposed within a first annular passageway (24) between said inner and outer conduit strings thereof.

In preferred embodiments, any number and any arrangement of chamber junctions, annulus isolation apparatuses, communicating conduits and/or flow control devices can be assembled to form a flow diverting string, that is inserted or urged through the single main bore and assembled in series or in parallel, to accommodate any configuration of one or more wells. Chamber junctions, annulus isolation apparatuses and conduits can be assembled concentrically or eccentrically about one another, which both defines annuli usable to flow substances into or from selected wells, and provides multiple barriers between the surrounding environment and the interior of the chambers and conduits. A flow diverting string is thereby formed, which can include any number of communicating or separated conduits and chambers, with or without annuli, each conduit and/or annulus usable to communicate substances into or from a selected well or well bore during solution mining and storage operations.

Preferably, during solution mining, flow diverters and isolation conduits placed across bores and passageways or orifices from annuli of conduits, associated with the orifices of chamber junctions or concentric conduit flow crossovers, enable the flow diverting string to control injection of non-salt-saturated water, such as fresh water, into a salt deposit, and control return of water containing a higher concentration of dissolved salt, i.e. brine, formed during the process of dissolving a salt deposit to form a storage space or cavern. Removal and replacement of flow diverters and flow control devices allow alternative solution mining configurations without the need to remove chamber junctions and associated conduits.

Preferably, after completion of solution mining operations, flow diverters and isolation conduits can be placed across bores and passageways or orifices from annuli of conduits, associated with the orifices of chamber junctions, or concentric conduit flow crossovers forming a dewatering configuration of a flow diverting string, to control stored gas or liquid during dewatering of the storage space or cavern with the stored gas or liquid product, and enabling pressurized storage and retrieval of the gas or liquids.

In another aspect the invention provides a method of forming a subterranean salt cavern (26) by solution mining, the method comprising the steps of:

i) forming a first borehole in a salt deposit (5);

ii) locating a flow diverting conduit string (70) in said first borehole, said flow diverting conduit string having at least one downhole opening in a dissolution zone of said first borehole and comprising an inner conduit string (2) disposed within an outer conduit string (2A), with an inner passageway (25) in said inner conduit string being disposed within a first annular passageway (24) between said inner and outer conduit strings;

iii) injecting water down said flow diverting conduit string out of said downhole opening to dissolve salt in said dissolution zone to form brine and enlarge said dissolution zone to form a salt cavern (26), and iv) extracting said brine from said first borehole, and v) controlling flow through at least one lateral opening (44) in said flow diverting conduit string (70), said lateral opening communicating with one of said passageways (24, 25) whereby water flows through said lateral opening to said dissolution zone or brine flows through said lateral opening from said dissolution zone.

Preferably said lateral opening (44) is formed in said outer conduit string (2A) and a flow of water or mixed hydrocarbons and water is directed from said lateral opening to said dissolution zone.

Preferably a flow diverter (47) or plug (25A) is disposed in said inner passageway (25) of said flow diverting string (70) and: i) diverts water flowing downwardly through said inner passageway to said lateral opening and thence to said dissolution zone, allowing brine, from said dissolution zone to flow upwardly through said first annular passageway (24) past said flow diverter, ii) diverts brine, entering said lateral opening from said dissolution zone upwardly through said inner passageway, allowing water flowing downwardly through said first annular passageway (24) to flow past said flow diverter to said downhole opening, or iii) combinations thereof.

Preferably an exit conduit extension (115) projects into said borehole or said cavern (26) through a bore of said flow diverter (47) and one or more tools are deployed in said borehole or cavern by means of a cable which extends through said exit conduit extension.

In a preferred embodiment a second annular passageway (40B) is formed around said outer conduit string (2A) below an annular isolation device (40), and fluid is injected into said second annular passageway to vary a water level (3B) in said subterranean borehole or salt cavern (26) and thereby vary the height of said dissolution zone. For example the fluid can be a gas, such as nitrogen, or liquid, such as diesel, and can be placed through the annulus between the threaded leaching strings and the bore of the well or cavern wall to provide additional control and to prevent water from dissolving salt in undesired locations.

A measurement device, such as sonar, can be inserted into the bore to determine whether the cavern is being created in the correct shape.

Optionally, embodiments of the method can include locating an exterior chamber at the lower end of the single main bore and providing communication between the exterior chamber with the one or more conduits of the single main bore, and orienting a flow diverter tool within the exterior chamber.

Embodiments of the method can further include urging a passageway through two or more orifices of the exterior chamber, downward through subterranean strata, and placing conduits between the subterranean strata and the passageways through the orifices, for forming a plurality of production wells, solution mined wells, storage wells, or combinations thereof.

The method can further include the steps of removing the flow diverter tool from the exterior chamber, and locating an interior chamber within the exterior chamber at the lower end of the single main bore, the interior chamber having two or more passageways, communicating with the one or more conduits of the single main bore and forming a chamber junction. The method can further include orienting a flow diverter tool within the interior chamber and urging a passageway through two or more orifices of the interior chamber downward through subterranean strata. The method can also include orienting and arranging the two or more well bores, emanating from the two or more orifices, to locate one or more flow diverting strings per solution mined cavern, one or more production strings per producing reservoir, or combinations thereof, with preferred embodiments described in FIGS. 89 to 92, and placing conduits between the subterranean strata and the passageways through two or more of the orifices of the interior chamber to form an annular passageway between the interior and exterior chambers in communication with annular passageways around the conduits.

Further embodiments of a method of the present invention can include locating one or more flow diverting strings used as leaching, dewatering and storage strings, one or more production strings, or combinations thereof, which can include one or more pre-assembled exterior and interior chamber junction subassemblies, pre-assembled continuous concentric conduit subassemblies, pre-assembled concentric conduits flow crossovers, annulus isolation apparatus subassemblies, flow diverters placed within subassemblies, isolation conduits placed within subassemblies, flow control devices place within subassemblies, or combinations thereof. A series of subassemblies can extend to the lower end of one or more of the single bores for providing communication passageways between the subassemblies at the lower end of the one or more conduits of the single main bore, and the subassemblies can be controlled by flow diverters and/or flow control devices placed and removed through the single main bore.

In another aspect the invention provides a method of storing fluid in, or extracting fluid from, a subterranean salt cavern (26) with a flow diverting string (70) having at least one downhole opening in said cavern, said string comprising an inner conduit string (2) disposed within an outer conduit string (2A), with an inner passageway (25) in said inner conduit string disposed within a first annular passageway (24) between said inner and outer conduit strings, with at least one lateral opening (44) in said outer conduit string, said at least one downhole opening communicating with one of said passageways (24, 25) the method comprising the step of:

i) controlling flow of injected fluid down one of said conduit string passageways out of said downhole opening at one subterranean depth to force fluid out of said cavern (26) at a different subterranean depth into said lateral opening and upward through said conduit string; or ii) controlling flow of injected fluid downward and through said at least one lateral opening (44) in said outer conduit string at one subterranean depth to force fluid out of said cavern (26) at a different subterranean depth into said at least one downhole opening.

The steps of the method can further include providing or removing water, produced water, brine, gas, produced gas, liquids, produced liquids, or combinations thereof, to or from the plurality of passageways through one or more well bores for solution mining, dewatering, storage, separation, and/or processing operations, within one or more caverns, through a single main bore.

The series of pre-assembled exterior and interior chamber junctions, pre-assembled concentric flow crossovers, and annulus isolation apparatus subassemblies can be placed between continuous concentric conduits into a subterranean bore through a salt deposit with a larger rig of greater hoisting capacity.

Thereafter, a smaller rig of lower hoisting capacity, such as that shown in FIG. 3, can be used to hoist valves, flow diverters, and isolation conduits through internal passages of the subassemblies and conduits during solution mining, dewatering and storage operations, without the need to install and remove additional conduits strings with a larger rig, as is the conventional practice.

The steps of the method can further include controlling flow through the passageways of the chamber junction with flow control devices, thereby forming at least one manifold or flow diverting string disposed beneath the earth's surface and in communication with the one or more solution mined storage wells. Substances are provided or removed to or from the one or more wells through the at least one manifold or flow diverting string to control solution mining, dewatering and storage operations without the need to remove or replace the at least one manifold between the operations.

In this embodiment, the method for providing communication with one or more lateral openings in a flow diverting string or a plurality of flow diverting strings in one or more wells, through formation of chamber junctions to control the flow of substances, is accomplished without the need for a plurality of subsequent installations and removals using larger more expensive hoisting rigs as called for by conventional practice. Instead, methods of the present invention can include the use of less expensive and smaller wireline and slickline rigs to rearrange flow diverters and flow control devices.

Thus, embodiments of the present invention include flow control of substances provided by the formation of chamber junctions supplemented with concentric conduits flow crossovers, annulus isolation apparatuses, flow diverters, isolation conduits, flow control devices, or combinations thereof, which enable solution mining, dewatering and storage operations. Conduit manifold embodiments can be installed once to perform any or all of such operations, while conventional methods require installation and removal of a plurality of conduit assemblies with a large hoisting capacity rig.

Preferred embodiments thereby provide the ability to produce, inject, and/or perform other operations on any number of production, solution mined wells, storage wells, processing wells, or combinations thereof, within a region, through one or more conduits within a single bore, while enabling selective isolation and selective access to any individual well, combinations of wells, and/or single well with internal bore and annuli. A minimum of surface equipment is required to access and control operations for each of the one or more wells placed in communication with the chamber junction, a single valve tree being sufficient to communicate with each well through one or more conduits within the single bore.

The preferred embodiments of the present systems and methods are usable to operate on any type and any number of solution mined storage wells, individually or simultaneously, including, but not limited to, leaching or solution mining a salt cavern by injection of water and extraction of salt brine, dewatering a cavern after it has been leached, injecting and extracting gas from a cavern, extracting brine from a cavern to store liquids, extracting liquids from a well by injecting brine, connecting a producing well to a cavern, using produced water to solution mine a cavern, using a cavern to process and separate production, or combinations thereof.

Further, the present systems and methods, at least in preferred embodiments, provide the ability to access each passage to from the central bore, simultaneously or individually, for any operations, including batch completion operations, batch drilling operations, production of substances for solution mining or storage operations, injection of substances for solution mining or storage operations, or other similar operations, while preventing the migration and/or contamination of gases, fluids or other materials between well bores and/or the environment.

Additionally, any number of valves, flow control devices or other similar devices can be disposed in communication with the chamber junction in a subterranean environment, within the subterranean bore, to create a flow diverting string. A single valve tree or similar apparatus can then be placed in communication with the upper end of the main bore, the valve tree being operable for communicating with one or more wells through the flow diverting string during leaching or solution mining, dewatering, debrining, and storage operations. Conventional systems for combining multiple well bore conduits within a single tree are generally limited to above ground use, consuming surface space that can be limited and/or costly in certain applications. Additionally, unlike above-ground conventional systems, embodiments of the present system are usable in both above ground applications and subsea applications to reduce the quantity of costly manifolds and facilities required.

Annulus isolation apparatuses can include a production packer and side pocket for a placeable and retrievable valve to control an annulus passageway, and the apparatuses are usable to control the gas or liquid cushion during leaching or solution mining operations. The valve can be replaced, or the annular gas fluid cushion can be isolated by placing a dummy valve into the side pocket through the internal bore of the one or more conduits of the single main bore.

In preferred embodiments, each of the one or more wells can be individually or simultaneously accessed, circulated, injected, produced, and/or otherwise operated upon by inserting valves, dummy valves, bore selection tools and/or isolation conduits into the chamber junction, side pockets of annulus isolation apparatus and/or concentric conduits flow crossovers.

In an embodiment, the bore selection tool can include an exterior wall, an upper opening that is aligned with the first orifice when inserted, and one or more lower openings, each aligned with an additional orifice of the chamber junction to enable communication with the associated well bores. Use of a bore selection tool enables selective isolation and/or communication with individual bores within a single well, or groups of wells, for performing various operations, including drilling, completion, solution mining, dewatering, storage operations, and other similar undertakings. Required tools and equipment, drilling bottom hole assemblies, coiled tubing, wire line bottom hole assemblies, and similar items for performing an operation on a selected well bore can be lowered through the conduit, into the upper opening of the bore selection tool disposed within the chamber junction, then guided by the bore selection tool through a lower opening in the bore selection tool to enter the selected well bore.

In one or more embodiments, the arrangement of the orifices within each chamber junction can cause certain orifices to have an incomplete circumference. In such an embodiment, the bore selection tool can include an extension member sized and shaped for passage into one of the orifices, such that the extension member can complete the circumference of the selected orifice when the bore selection tool is properly inserted and oriented, thereby enabling communication with the respective well through the orifice while isolating other orifices.

By providing selective access to one or more well bores through a subterranean manifold of flow diverting string, that includes chamber junctions and associated flow control parts within a subterranean bore, wherein flow diverting strings can be placed below a valve tree or a junction of wells below a valve tree, embodiments of the present systems and methods provide greater efficiency and reduced expense over existing methods by reducing above-ground equipment requirements and reducing or eliminating the need to move, erect, and disassemble drilling and/or hoisting rigs and similar equipment between the drilling, completion, dewatering, snubbing and storage phases of a storage well or between a plurality of storage wells.

Embodiments described within United Kingdom Patent Application No. 0911672.4, entitled "Through Tubing Cable Rotary Systems," are usable with embodiments of the present invention to maintain and/or intervene through a flow diverting string during the process of forming and using a cavern within a salt deposit.

Specifically, embodiments include placing the systems below chamber junctions in one or more wellbores, as disclosed in U.S. patent application Ser. No. 12/587,360. For example, the present invention can use one or more chamber junctions disposed axially to create a flow diverting string placed within a single bore to form and/or use a salt cavern within a subterranean salt deposit. Use of a flow diverting string in this manner replaces the conventional practice of installing, using and removing a plurality of differing strings to solution mine, dewater, and store gases and/or fluids within the single well bore and/or the cavern that is formed in the salt deposit.

Specifically, the flow diverting string can be used to replace multiple conventional conduit strings used in the construction and utilization of a storage space within a salt deposit, which normally requires multiple installation and removal operations, while flow diverting strings usable with embodiments of the present invention can be installed once to conduct many operations, including solution mining, dewatering, and creating and performing storage operations throughout the life of the cavern.

Finally, the solution mining, dewatering and storage functions of a flow diverting string can be used in combination with producing wells disposed axially below chamber junctions for connecting multiple wells to create storage and/or separate produced components to further reduce surface facilities of production and storage wells.

BRIEF DESCRIPTION OF THE DRAWINGS

Preferred embodiments of the invention are described below by way of example only, with reference to the accompanying drawings, in which:

FIG. 1 depicts a subterranean storage well during solution mining with a prior art leaching string configuration.

FIG. 2 depicts a prior art offshore platform with an adjacent jack-up workover rig.

FIG. 3 depicts prior art wire-line apparatus usable with embodiments of the present invention.

FIGS. 29-32A depict a preferred embodiment of a flow diverter and concentric chamber junction subassembly with a lateral opening and exit bore conduits with concentric conduit flow crossovers at the lower end for use as a subassembly of a flow diverting string.

FIGS. 44-48 depict preferred embodiments of a chamber junction subassembly usable with a flow diverting string with the exit bore and exit bore extension of FIG. 50 and isolation conduit of FIG. 49, wherein the larger central isolation conduit of FIGS. 53 to 55 has been removed for access to exit bores once the flow diverter of FIGS. 56 to 58 has been placed and oriented.

FIG. 49 depicts a preferred embodiment of an isolation conduit engagable with the exit bores of the chamber junction subassembly of FIGS. 44 to 48.

FIG. 50 depicts a preferred embodiment of an exit bore extension subassembly associated with the chamber junction subassembly embodiment of FIGS. 44 to 48 and FIGS. 51 to 52.

FIGS. 59-63 depict a preferred embodiment of an annulus isolation apparatus comprising a production packer and side pocket mandrel for a placeable and retrievable valve to control an annulus passageway usable to place a gas or liquid cushion interface during leaching or solution mining operations and usable within a flow diverting string.

FIG. 74 and FIGS. 75-77 depict a preferred embodiment of an arrangement for removing an isolation conduit used during solution mining, removing the isolation conduit and installing a tubing retrievable subsurface safety valve above a production packer after a cavern has been formed.

FIG. 74A depicts a preferred embodiment of an arrangement using an isolation conduit across a valve tree during dewatering of a cavern, after which the isolation conduit can be removed to allow the valve tree to operate its valves.

FIGS. 78-82 depict creation of space for the insoluble substances during solution mining with an embodiment of a flow diverting string usable with the present invention.

FIG. 89 depicts use of a junction of wells formed by chamber junctions to create a production well and plurality of solution mined storage wells usable for storage, processing and/or separation of production from the production well.

FIGS. 90-92 depict embodiments of a plurality of flow diverting strings beneath a junction of wells, wherein the lateral spacing of said plurality of flow diverting string is defined to form and use a single cavern.

Figure 4:
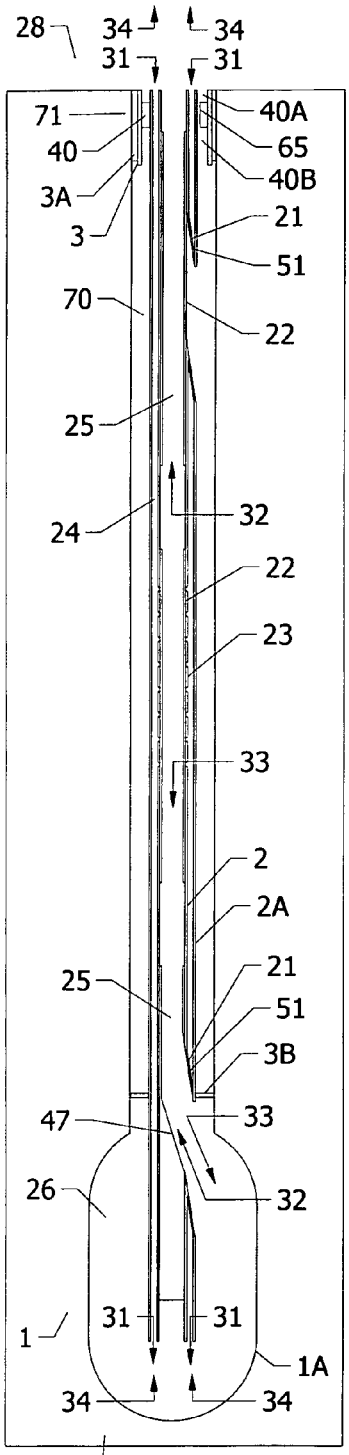
FIGS. 4-6 depict a diagrammatic cross sectional view of solution mining, dewatering and storage operations with various arrangements of preferred flow diverting string embodiments of the present invention insertable into a subterranean bore through a salt deposit to form and use a salt cavern, using associated subassembly, flow diverter, jointed conduit and isolation conduits, such as those shown in FIGS. 7 to 63.

Embodiments of the present invention are described below with reference to the listed Figures.

DETAILED DESCRIPTION OF THE EMBODIMENTS

Before explaining selected embodiments of the present invention in detail, it is to be understood that the present invention is not limited to the particular embodiments described herein and that the present invention can be practiced or carried out in various ways.

Referring now to FIG. 1, a prior art elevation cross sectional view depicting a prior art method of solution mining (1) a subterranean salt deposit to create storage space within a cavern disposed in salt where gas or liquids are later stored is shown.

A bore is drilled through subterranean formations (6) above the top of the salt deposit (5). Subsequent to drilling the bore, one or more segments of casing (3) are cemented (3A) within the bore above or within the salt deposit (5) and connected to a wellhead (7) secured to intermediate casing.

Conventional practice is to place an inner leaching string (2) and outer leaching string (2A) within the bore through the salt deposit (5) and secured to the wellhead (7) serving as conduits through which water can be pumped (8) and water with dissolved salt can be extracted (9), carried by the water or brine as it is known to experts in the art.

Embodiments of apparatus and methods for a flow diverting string of the present intervention would replace this conventional practice.

Through the annular space between the final cemented casing (3) and outer leaching string (2A), a gas or liquid cushion or blanket is injected into the annular space to prevent water from contacting salt to a desired depth determined by the level of the cushion.

Apparatuses and methods for placing the gas or liquid cushion past an isolation device and suspending the flow diverting string are described in FIGS. 59 to 63.

Conventional practice begins by creating (1) a cavern with walls (1A) formed by pumping (8) water into the free hanging inner leaching string (2), where it enters (4) the bore within the salt deposit (5) and is pushed through the annular space between the free-hanging inner (2) and free-hanging outer (2A) leaching strings until it exits (9) the wellhead (7).

To prevent dissolution of salt above a desired level, the common practice is to inject a fluid, such as nitrogen gas or diesel, between the free-hanging outer (2A) leaching string within the cemented (3A) casing (3).

The gas or liquid cushion interface (3B) can be used to prevent the circulated water from dissolving salt at the bore or cavern wall (1A) above the cushion interface, controlling the vertical limit of water contact.

Insolubles (1B) fall through the water and dissolved salt slurry or brine to the bottom of the cavern (1) during the solution mining process.

General practice in the art is to reverse the forward circulation flow (4) after sufficient volume has been created to capture all or a part of the volume of insolubles, wherein the circulation flows, in (8) and out (9) of the wellhead, are reversed during this conventional method.

As lighter water with a lower dissolved salt content has the propensity to channel through heavier brine, with a higher salt saturation level, when released from the lower end of the inner (2) leaching string, the conventional method of reversing flow lets the lighter water float on top of the heavier brine by pumping it from the annulus between the inner and outer (2A) leaching strings, forcing the brine into the inner leaching string bore.

Adjustments of the inner (2) and outer (2A) leaching strings flow exits and the cushion interface (3B) occur during the solution mining process to form a cavern. Conventional practice dictates that the inner leaching string can be removed to allow the outer leaching string to be raised, followed by replacement of the inner leaching string at various depths.

Conventional practice includes, after completing solution mining, the removing of the leaching strings (2 and 2A). Thereafter, a completion with installation of a permanent packer is performed and potentially a subsurface safety valve is installed for storage operations.

Formation of the cavern creates a space filled with brine. Conventional practice is to install a completion and dewatering string, and to insert the dewatering string through the installed completion to return brine from the bottom of the cavern, while stored liquid or gas is injected into the top of the cavern to displace the brine.

In conventional gas storage operations, the practice is to remove the dewatering string to allow any valves of a valve tree or subsurface safety valves, blocked by the dewatering string, to function. The conventional process of removing the dewatering string is particularly hazardous in cases where explosive gas or liquified gas is stored, since the dewatering string must be removed by snubbing or stripping operations.

In conventional liquid storage operations, the practice is to leave the dewatering string in the cavern to: facilitate the storage of lighter liquids by forcing stored liquids between the production casing and dewatering string, which floats above heavier brine forced from the lower end of the cavern to the surface through the bore of the dewatering string, or to retrieve stored fluids by forcing brine down the dewatering string and below the floating lighter fluids to force the stored fluids to surface in the annular space between the production casing and the dewatering string.

Once operational, the cavern can be used to store liquid or compressed gas that can intermittently be pushed from the cavern by salt saturated brine or released and refilled with more liquid or compressed gas to meet the requirements of customers of the storage facilities.

Conventional construction of storage facilities and conventional installation and removal of a plurality of strings for onshore storage facilities involve frequent use of a large hoisting capacity rig.

FIG. 2, depicts an elevation view showing a prior art jack-up boat (16) supported by legs (17), that extend from the boat's hull to the sea floor. The jack-up boat includes a crane (18) for placing an apparatus usable to operate offshore liquid or gas storage facilities (20), supported by a jacket (19) that extends from the top side facilities to the sea floor. Conventional methods may involve using a jacking unit, that is placed on the platform of the storage facility (20) with the crane (18), and lifting and placing the plurality of conduit for forming and using a cavern.

Drilling and workover packages can be placed on jack-up boats (16), or larger mobile offshore drilling and workover units can be used to construct offshore gas storage wells.

After the initial installation of the flow diverting string, boats can be used for personnel transfer and transfer of small hoisting rigs and lubricator arrangements, such as those shown in FIG. 3, to reduce the number of required times a larger hoisting rig, such as a lift boat (16) or mobile offshore drilling unit, is used.

Due to limited space on the storage facilities (20) and required resources in an offshore environment, solution mining of caverns within salt deposits generally occurs onshore. However, in many areas the lack of suitable onshore salt deposits forces the use of offshore salt deposits. The reduction in number of required large hoisting capacity rig operations for the construction and operation of storage caverns in salt, provided by embodiments of the present invention, is equally applicable to onshore and offshore facilities, but significantly increases the viability of offshore storage caverns within a salt deposit. The embodiments further include the minimization of offshore facilities by using various embodiments of chamber junctions, that can be used within a main wellbore, as disclosed in U.S. patent application Ser. No. 12/587,360.

Using embodiments of methods and systems of the present invention, both onshore and offshore operations can be conducted, and the use of large drilling and hoisting rigs to construct a well for solution mining and storage operations is reduced by accessing the well with smaller hoisting units and lubricator arrangements, as described in FIG. 3.

FIG. 3 depicts an elevation view illustrating a known lubricator arrangement with a wire (11) engaged to a smaller hoisting unit (10), not shown. The wire is shown passing through sheaves until it reaches a stuffing box connection (12) at the upper end of a lubricator tube (13), where it is secured to the upper end of a blow out preventer unit (14) and secured to the upper end of a valve tree (15), engaged with a wellhead.

This small hoisting capacity rig arrangement allows disconnection of the lubricator (13) with lighter conventional tools and flow control tools (22, 47 and 25A of FIGS. 4 to 6) engaged to the wire (11) and placed within the lubricator, while the blow out preventers (14) and valve tree (15) isolate the well, after which the lubricator can be reconnected and the preventers and valve tree can be opened to allow passage of the tools to and from the well in a pressure controlled manner. The stuffing box (12) prevents leakage around the wire (11) used for hoisting the tools within conduits of the well with a light hoisting capacity unit (10), after which the tools can be retracted into the lubricator, closing the preventers and valve tree to control the well while disengaging the tools from the wire and removing them from the lubricator.

A small hoisting capacity rig, such as that shown in FIG. 3, can be used to rearrange flow control devices (22, 47 and 25A of FIGS. 4 to 6, FIGS. 78 to 88, FIG. 88A), within preferred embodiments of a flow diverting string (70 of FIGS. 4 to 6, FIG. 12, FIG. 30C and FIGS. 79 to 92) and permanently installed to solution mine, dewater, and perform storage operations throughout the life of the cavern. Thus, the need for multiple conventional conduit strings, which are used in the construction and utilization of a storage space within a salt deposit is removed. The multiple conventional conduit strings normally require multiple installations and removal operations using a large hoisting capacity rig, such as that shown in FIG. 2.

Figure 5:
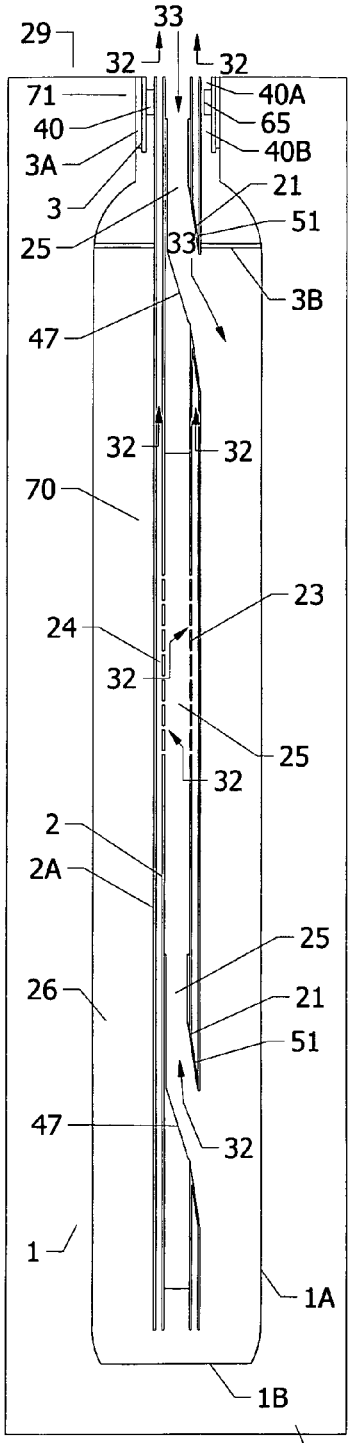
Figure 6:
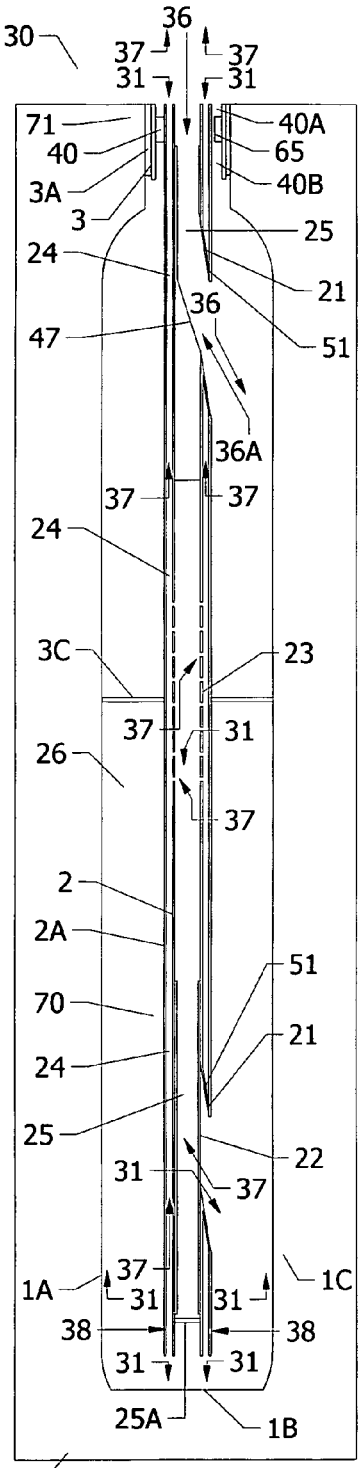
Figure 7:
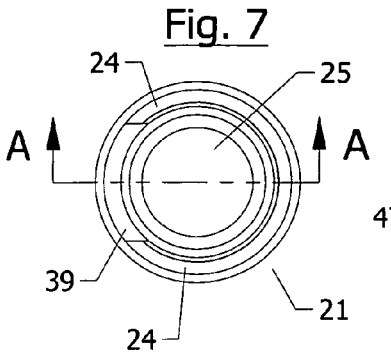
FIGS. 7-12 depict a preferred embodiment of a flow diverter and concentric chamber junction subassembly with a lateral opening and truncated exit bore conduits for use as a subassembly of a flow diverting string.

FIGS. 4 to 6, show flow diverting conduit string arrangements incorporating a preferred subassembly apparatus of FIGS. 7 to 63.

Where conventional methods first insert an outer leaching string followed by insertion of an inner leaching string into a bore through salt, prior to solution mining, with a large hoisting capacity rig, the flow diverting conduit string (70) of the present invention includes at least an inner (2) and outer (2A) engaged conduit strings that can be inserted into a bore through salt at the same time using a large hoisting capacity rig.

Once the leaching strings are placed, the large hoisting capacity rig can be moved and used for other activities during the solution mining period, which is generally measured in years.

It is conventional practice to remobilize a large hoisting capacity rig each time the outer leaching string requires adjustment during solution mining, and again when the leaching strings are replaced with completion and dewatering string, and yet again if dewatering strings are removed. However, the flow diverting string (70) embodiments of the present invention do not require replacement, and can remain within the cavern during solution mining, dewatering and storage operations, as illustrated in FIGS. 4 to 6. Adjustments of cavern shape can be accomplished through changes in the flow paths of the flow diverting string with placement and retrieval of flow control apparatus (22, 47, 25A) through the inner bore of the flow diverting string with a smaller hoisting capacity arrangement, such as that depicted in FIG. 3. The embodiments of the present invention include replacing the conventional need for a plurality of complex and costly large hoisting capacity rig erections, uses, disassemblies and movements with less complex and lower cost small hoisting capacity rig erections, uses, disassemblies and movements.

While heavier components of the flow diverting conduit string (70) can be replaced with hoisting capacity rigs larger than those described in FIG. 3 in instances where this is advantageous, such as those illustrated in FIGS. 74 to 77, it is generally advantageous to replace more complex and/or expensive rig operations with less complex and/or expensive rig operations by leaving the flow diverting conduit string in place and/or minimizing the sizes and/or weights of components used with the flow diverting to solution mine (1, 28 and 29) with a cushion interface (3B), dewater (30) for gas operations with a gas/brine interface (3C), or store liquids (30) with a stored liquid/brine interface (3C) as described in FIGS. 4 to 6.

FIG. 4, depicts a diagrammatic axial cross sectional view of a solution mining embodiment (28) of a flow-diverting conduit string (70) usable in a method for forming a storage cavern. The flow diverting conduit string (70) includes chamber junction subassemblies (21, 51), concentric conduits flow crossovers (23), flow diverters (47), isolation conduits (22), and an annulus isolation apparatus including a packer (40)

with a packer bypass passageway (65). The packer bypass passageway (65) allows fluid flow past the isolation apparatus through the annular passageway defined between an outer casing (3) and the flow diverting conduit string (70) to create a cushion interface (3B).

A bore is drilled into the salt deposit (5) and casing (3) is cemented (3A) into the bore within the subterranean strata. Thereafter, a flow diverting string (70), having a production packer (40) with a liquid or gas bypass passageway (65) having a suspension and bypass subassembly (71), is placed through the salt deposit, and the production packer (40) is engaged with the final cemented casing (3).

As the availability of conventional production packers in large sizes is generally limited, any form of hanger (40) can be used to suspend a flow diverting string (70), while the fluid bypass (65) can include any manner of bypass, e.g. the space between the suspending slips. Other examples include, conventional liner hangers (40) which are available in larger sizes and can be used to suspend the outer leaching string (2A). The outer leaching string can be initially or later cemented in place using an expandable cement packer or other device to effect a differential pressure seal, with the fluid bypass (65) including a separate conduit (104 of FIGS. 68 and 69) placed within the outer annular passageway and extending axially downward to a point below the hanger and an annulus sealing apparatus, where the fluid bypass conduit internal passageway could penetrate the outer leaching string to define a fluid interface for solution mining.

A liquid or gas is injected downwardly through the uppermost and outermost annulus (40A) and past the production packer (40) into the lowermost and outermost annulus (40B) to create a cushion interface (3B). The liquid or gas is placed though the packer bypass passageway (65), between the inner leaching string (2) and the outer leaching string (2A), passing through the bore in the salt deposit (5).

In an embodiment, the flow diverting string (70) or manifold conduit string can include an upper chamber junction (21) subassembly and concentric conduits flow crossover (23) subassembly, and can further include a combined chamber junction and crossover subassembly (51).

To create the walls (1A) of the initial cavern, storage space or volume (26), water is pumped (31) downward in the outer annular passageway (24), between the inner (2) and outer (2A) leaching strings, and the water exits the annular opening at the bottom of the conduit string as indicated by the lower arrows (31). Salt in a dissolution zone of the chamber wall about this annular opening is dissolved to form brine, which flows into a lateral opening of a flow diverter (47) as indicated by the lower arrow (32). The brine then flows upwardly through the inner bore (25) as indicated by the upper arrow (32) and is discharged at the surface.

While preferred embodiments of a flow diverter (47) are described herein, any device, such as a plug (25A of FIG. 6), that urges or diverts fluid flow from the inner bore through a lateral opening in the inner conduit string (2) and/or outer conduit string (2A) can be considered a flow diverter.

After creating sufficient space below the flow diverting string (70) to prevent the sucking of insoluble particles, that fall to the floor of the cavern and into the outer annular passageway (24) in the subsequent reverse flow phase, the circulation path can be reversed by pumping (33) water down the inner bore (25) and out of the lateral opening of the flow diverter (47), with brine returned (34) through the outer annular passageway (24).

The reversing of flow (31 and 32 to 33 and 34) with the same flow diverting string (70) configuration creates a larger initial volume (26) by forcing returned fluids to become fully saturated with brine before they are extracted, as lighter water cannot channel or travel through heavier brine.

A further lateral opening in the upper (proximal) region of the conduit string (70) is blocked by an isolation conduit (22), which confines the flow in the inner bore (25).

FIG. 5 depicts a diagrammatic axial cross sectional view of the flow diverting string (70) in a subsequent solution mining configuration (29), after the initial volume is created and before finishing solution mining (1) of the storage cavern space or volume (26).

The liquid or gas cushion interface (3B) is raised from its previous depth by allowing the liquid or gas forming the cushion to flow upwardly through the packer bypass passageway (65).

The isolation conduit (22), as shown in FIG. 4, can be removed from the concentric conduit flow crossover (23) and the upper chamber junction subassembly (21), or combined chamber junction and flow crossover subassembly (51), after which a flow diverter (47) can be placed in the upper chamber junction.

Water is pumped (33) downward through the inner bore (25) and exits the upper chamber junction (21 or 51) through an upper lateral opening at the termination of the bore of a flow diverter (47). Brine is returned (32) through the internal bore of the lower chamber junction (21 or 51) where it travels to the concentric conduits flow crossover (23), comprising an independent subassembly or part of a combined chamber junction and flow crossover (51), where the flow (32) crosses over from the inner bore (25) to the annular passageway (24) through openings in the wall of the crossover (23). Accordingly, the brine can flow upwardly through the annular passageway (24) past the flow diverter (47) which blocks the inner bore (25).

Any number of chamber junction subassemblies (21) and concentric conduits flow crossovers (23), or combined chamber junction and concentric conduit crossovers subassemblies (51), flow diverters (47), and/or isolation conduits (22) (shown in FIG. 4) can be added to a flow diverting string (70) to control the subterranean depths at which water is placed and brine is recovered during solution mining (1). In addition, the liquid or gas cushion interface (3B) can be adjusted to prevent leaching above the desired depth. This process creates a cavern volume or storage space (26) with a portion of the previous volume consumed by insoluble substances, that have fallen from the wall (1A) to the floor (1B) of the cavern.

Solution mining (1) can include rearranging isolation conduits (22) and flow diverters (47) through a valve tree and the inner bore (25) of a flow diverting string (70) by using small hoisting rigs and lubricator arrangements, such as that shown in FIG. 3, without removing the flow diverting string (70) from the bore or cavern. In contrast, conventional solution mining methods, for adjusting the points at which the circulation of water enters the cavern during its creation and the point where brine exits, would require the movement, erection, use and disassembly of a large hoisting capacity rig to perform such functions as removing the valve tree and the threaded inner leaching string (2), lifting the threaded outer leaching string (2A) to the depth at which water will exit or enter, and then reinstalling the inner leaching string to a shallower depth prior to reinstalling the valve tree and commencing said solution mining, which substantially increases both hazard and cost through the removal of the valve tree and use of the large hoisting capacity rig.

FIG. 6 depicts a diagrammatic axial cross-sectional view of the flow diverting sting (70) in dewatering or storage configuration (30), showing a dewatering gas/brine interface (1C) or dewatering liquid/brine interface (1C) or storage retrieval brine/(gas or liquid) interface (IC) in a storage cavern space (26).

For dewatering, flow diverters below the uppermost flow diverter (47) are shown removed, and an isolation conduit (22) is placed across the lower chamber junction (21) subassembly or combined chamber junction and crossover subassembly (51). If the lower end of the flow diverting string (70) is covered, or can suck up insoluble particles, then the isolation conduit (22) across the lower chamber junction (21 or 51) can be omitted and/or perforations (38) with a plug (25A) can be placed in the internal bore. This will enable upward flow (37) through the inner bore (25), if the lower isolation conduit is omitted where it crosses over to the outer annular passageway (24) at the crossover (23). Alternatively, if the inner bore is plugged (25A) above perforations at a desired depth, through both the inner (2) and outer (2A) strings, then the flow (lower arrow 37) will occur in the outer annular passageway.

Any device that urges flow through an opening in the flow diverting string (70), such as the plug (25A) can be placed anywhere within the string to act as a flow diverter directing flow to or from the cavern, or between the inner passageway (25) and outer or first annular passageway (24).

During dewatering, initial storage of gas or storage of liquids, that are lighter than the water or brine within the cavern (26), are injected (36) through the inner bore (25) into the cavern, forcing the water or brine upward (37) in the outer annular passageway (24) and crossing over at the concentric conduit flow crossover, if necessary.

To store gas after dewatering, the gas is normally compressed into the cavern (26). To retrieve compressed gas from the storage cavern, the gas is normally allowed to expand.

When retrieving stored liquids or uncompressed gas from the cavern, or to adjust the cavern storage volume (26) or pressure, heavier brine can be injected (31) through the annular passageway (24) to exit near the bottom of the flow diverting string (70) for filling the cavern with the brine and urging (36A) the stored gases or liquids through the inner bore (25) to the valve tree (not shown) at the surface, by moving the brine/(gas or liquid) interface (3C) upward.

Alternatively, if a plurality of interfaces exist between brine, stored liquids, stored gases, or combinations thereof, retrieval can occur from intermediate chamber junctions (not shown) to selectively retrieve fluids above, between or below the plurality of interfaces.

FIGS. 7 to 12 depict a preferred embodiment of a flow diverter (47), preferred embodiments of a concentric conduit flow crossover subassembly (23), and preferred embodiments of chamber junction subassemblies (21) for use in a flow diverting string (70 of FIGS. 4 to 6, FIG. 12 and FIGS. 78 to 92), for forming or using a subterranean cavern in a salt deposit.

Figure 10:
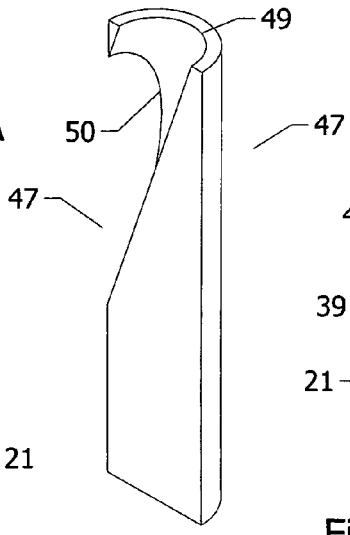
Figure 11:
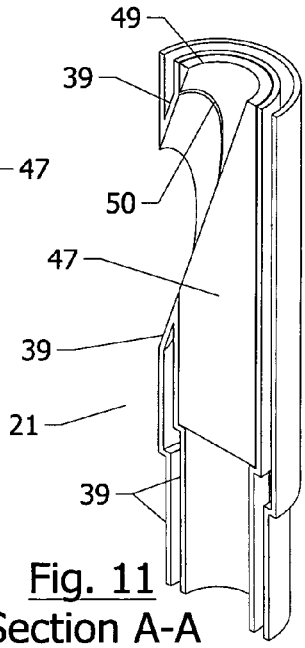
Figure 8:
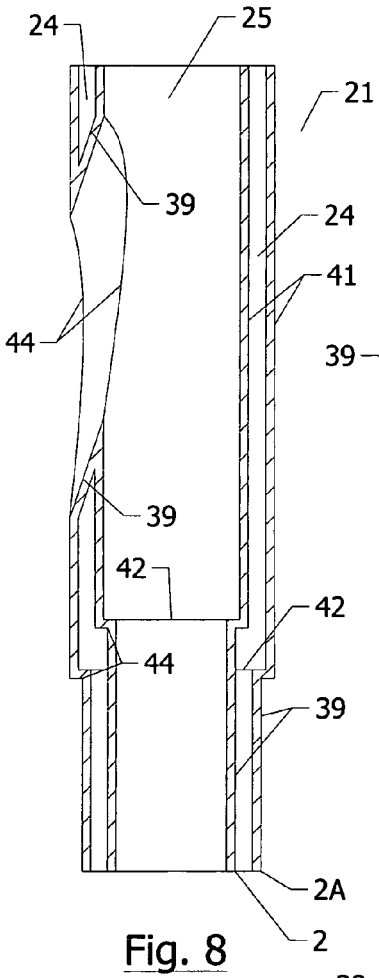
Figure 9:
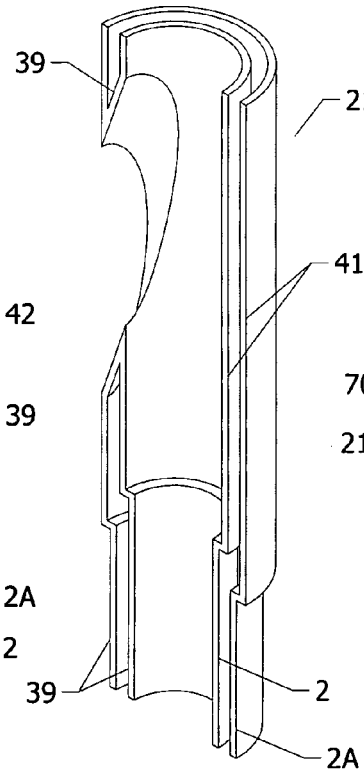
Figure 12:
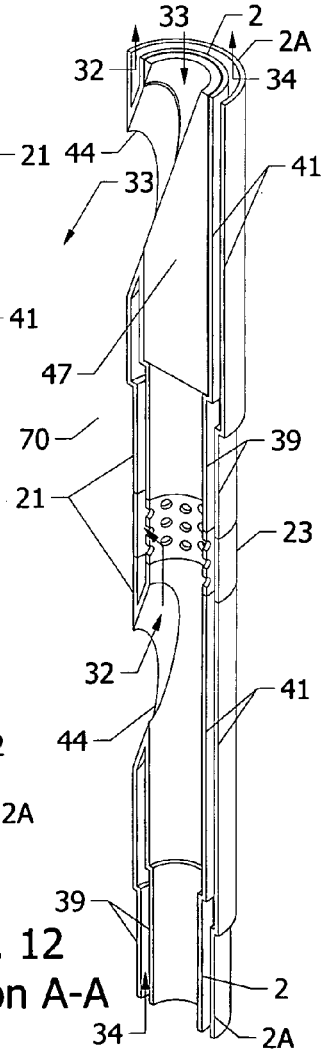

FIGS. 7 to 9 depict a plan, axial cross-section, and isometric view having a cross sectional line A-A associated with FIGS. 11 and 12 and illustrating an embodiment of a chamber junction subassembly (21). The chamber junction subassembly (21) is shown having concentric chambers (41) with concentric exit bores at their lower ends and an internal exit bore (39) (FIG. 9) terminating in a lateral opening (44) in the wall of the outer chamber (41). The connection between the inner and outer concentric chambers (41) isolates them from each other and thereby enables a differential pressure between the outer annular passageway (24), formed between the inner leaching string (2) and outer leaching string (2A), and the inner passageway bore (25). A ledge portion (42) is shown for supporting a flow diverter (47), such as that shown in FIG. 10.

FIG. 10 depicts a cross sectional isometric view of an embodiment of a flow diverter (47). FIG. 11 depicts a cross sectional view showing the flow diverter (47) of FIG. 10 inserted in the chamber junction of FIG. 9. The flow diverter has an inclined bore (49), which is alignable with the inclined bore of the chamber junction.

Referring now to FIG. 12, a cross sectional isometric view of an embodiment of a flow diverting string (70) is depicted. The depicted flow diverting string (70) comprises the flow diverter (47) of FIGS. 10 and 11, and chamber junction subassembly (21) of FIGS. 7 to 9 and FIG. 11, at the upper end of a concentric flow crossover subassembly (23). A similar chamber junction subassembly (21) is shown connected to the lower end of the above crossover subassembly (23). The flow diverting string (70) can be placed in a well bore to create or use a subterranean cavern in a salt deposit.

Downward flow (33) (e.g., of water) through the upper orifice of the flow diverter (47) is diverted through the lateral opening of the chamber junction into a bore or cavern, as indicated at (33). As indicated by arrow (34), flow (e.g., of brine) can re-enter the flow diverting string at its lower end, between its inner (2) and outer (2A) leaching strings, and continue upward (34) past the flow diverter (47) if an isolation conduit blocks the lower lateral outlet and concentric flow crossover orifices. Alternatively, as shown, inward flow (e.g., of brine) can occur at a higher level through the lateral opening of the lower chamber junction subassembly (21), that is blocked by the flow diverter (47), and can cross over from the inner bore to the outer annular passageway via perforations in the inner wall of the flow crossover (23) to travel upward.

FIGS. 13 through 20 depict an embodiment of a combined chamber junction (43) and concentric conduit crossover (23) subassembly (51), having a plurality of lateral openings. The depicted assembly includes various embodiments of flow diverters (47) as shown in FIGS. 21 to 24. The figures also include an embodiment of an isolation conduit.

The combined chamber junction and crossover assembly (51) can include inner and outer chamber junctions (43). A locating collar is shown disposed above the chamber junctions and has an annular recess (58) or nipple profile for locating flow control devices within the inner bore of the assembly. A plurality of exit bores (39), lead to lateral openings from the inner bore (25). A differential pressure bearing outer annular passageway (24) is formed between the inner leaching string (2) and the outer leaching string (2A). The exit bores of the outer chamber junction can be truncated to reduce the diameter of the subassembly.

Locating collars can include recesses (58) for locating flow control devices placed above and below a concentric conduit flow crossover (23). Flow control devices can be placed within the recesses to adjust flow passageways to form or use a subterranean cavern within a salt deposit, or to maintain a flow diverting string.

Figures 13, 14, 15, 16, 17, 18, 19, 20, 21, 22:
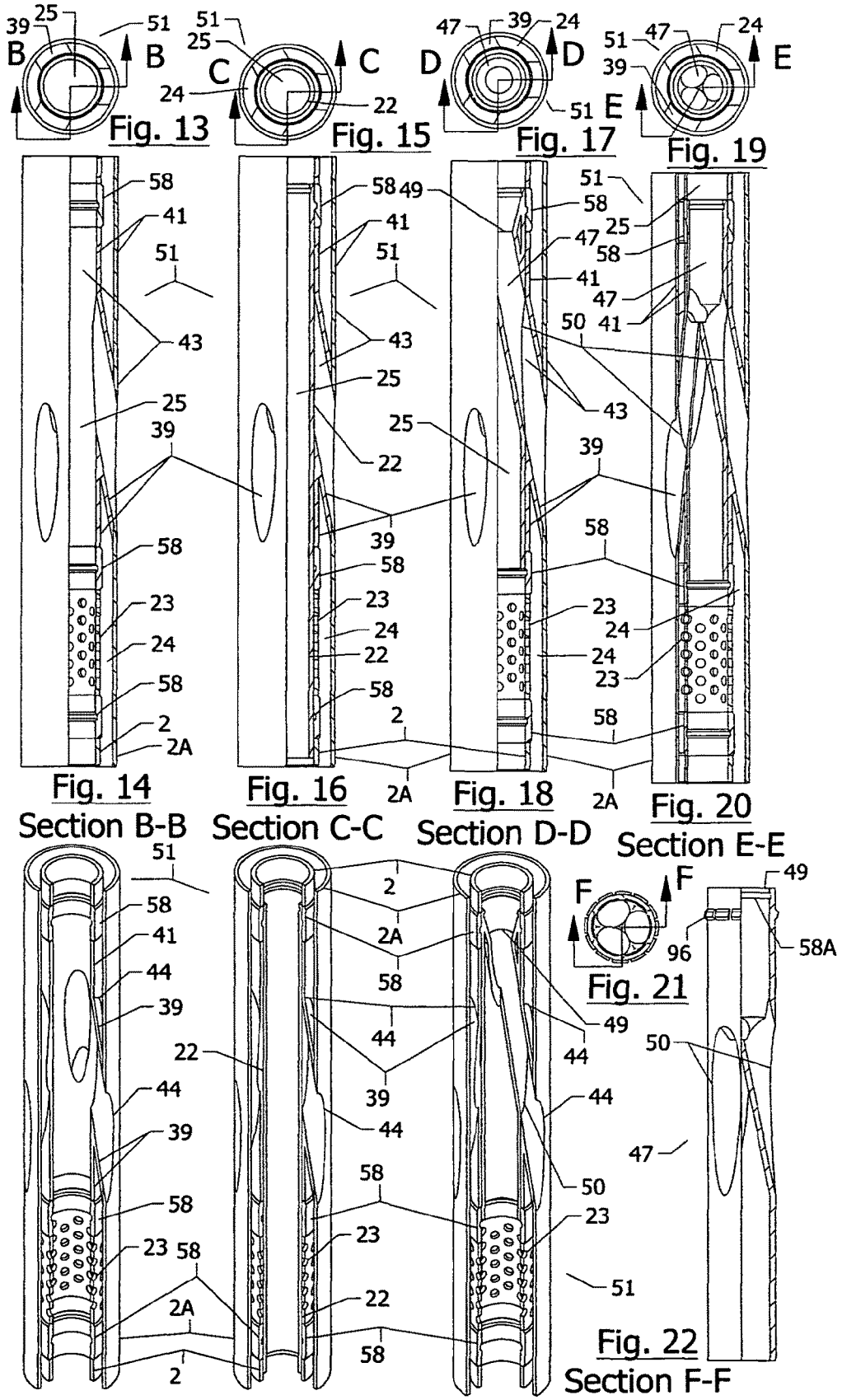
FIGS. 13-20 depict preferred subassembly embodiments of concentric chamber junctions having a plurality of lateral openings and truncated exit bore conduits with various isolation conduit and flow diverter embodiments, such as those shown by FIGS. 21 to 24 placed within said subassemblies usable within a flow diverting string.
FIGS. 21-22 depict a preferred embodiment of the flow diverter within the chamber junction subassembly embodiment of FIGS. 19 and 20, wherein the flow diverter has a single upper orifice with a passageway to a plurality of lower orifices for orientation to the plurality of lateral openings of said chamber junction subassembly.

FIG. 13 depicts a plan view, and FIG. 14 depicts a sectional elevation above isometric views on line B-B of FIG. 13. FIGS. 13 and 14 depict an embodiment of a combined chamber junction and crossover subassembly (51), that is usable within a flow diverting string (70 of FIGS. 4 to 6, FIG. 12 and FIGS. 78 to 92) for forming or using a subterranean cavern in a salt deposit. The depicted chamber junction (43) differs from that of FIGS. 7 to 12 in having three downwardly-inclined bores (39) terminating in regularly circumferentially distributed lateral openings in the outer wall of the chamber junction. These bores communicate with the inner bore (25).

FIG. 15 depicts a plan view, and FIG. 16 depicts a sectional elevation above isometric views on line C-C of FIG. 15. The Figures depict the combined chamber junction and crossover subassembly (51) of FIGS. 13 and 14, with an isolation conduit (22) engaged within, which blocks the inner openings of the bores (39) and crossover (23).

Placement of the isolation conduit (22) effectively converts the combined chamber junction and crossover subassembly (51) into a continuous inner leaching string (2) within a continuous outer leaching string (2A) by blocking the lateral openings of the chamber junctions (43) and the concentric conduit flow crossover (23), which allows the subassemblies to be disabled when desired.

FIG. 17 depicts a plan view, and FIG. 18 depicts a sectional elevation above isometric views on line D-D of FIG. 17. The Figures depict the combined chamber junction and crossover subassembly (51) of FIGS. 13 and 14 with a flow diverter (47), having a single lower orifice exit communicating with, and aligned with, a single lateral opening of the combined chamber junction and crossover subassembly.

The above flow diverter (47) provides a single flow path through the inner bore (25) to the bore or cavern surrounding the combined chamber junction crossover subassembly (51). This arrangement can be used to selectively encourage preferential leaching (e.g., in a single direction), such as in the situation illustrated in FIG. 88A, where an anomaly exists on one side of a cavern. If the potential for producing such a one sided anomaly (1X of FIG. 88A) is known in advance, preferential leaching can be carried out on the side of the flow diverting string, which is away from the potential anomaly.

Water exiting the inner bore (25) can force return flow into the outer annular passageway (24), or vice versa, via passageways of the flow diverting string (70), the selection of which can be used to control shaping of the cavern to avoid creating or enlarging the size of solution mining anomalies.

Figures 23, 24, 25, 26, 27, 28:
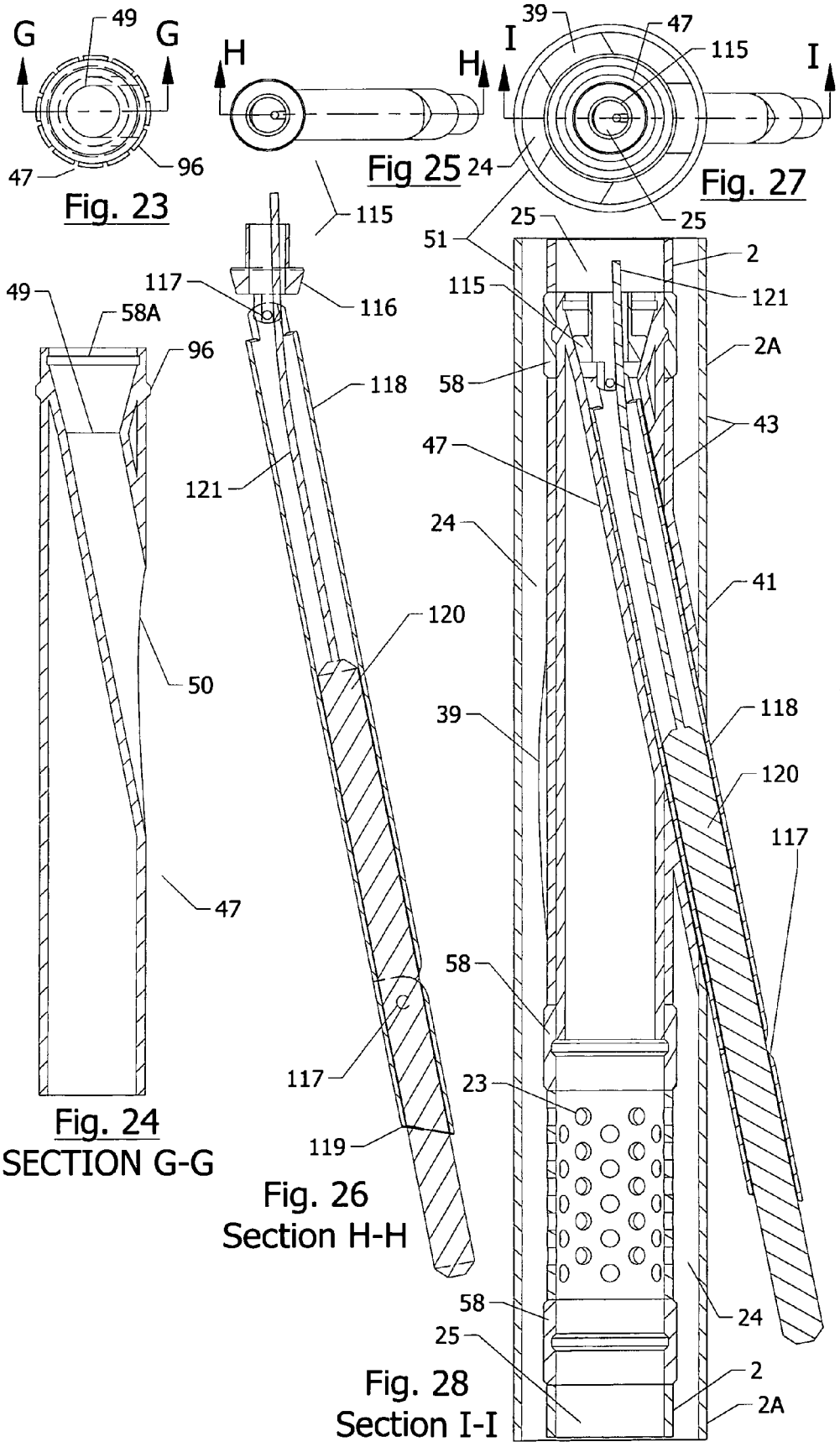
FIGS. 23-24 depict a preferred embodiment of the flow diverter within the chamber junction subassembly embodiments of FIGS. 17 and 18 and FIGS. 27 and 28, wherein the flow diverter has a single upper orifice and passageway to a single lower orifice for orientation to one of the plurality of lateral openings of the chamber junction subassembly embodiment.
FIGS. 25-26 depict a preferred embodiment of a jointed conduit at the same angular orientation of its depiction within the flow diverter and chamber junction subassembly of FIGS. 27 and 28, wherein the jointed conduit is used to extend past the truncation of said chamber junction's exit bore conduit for deployment of a tool suspended from a cable within a subterranean bore or cavern.
FIGS. 27-28 depict the jointed conduit of FIGS. 25 and 26 within the flow diverter of FIGS. 23 and 24, within the chamber junction of FIGS. 13 and 14 to illustrate how a tool suspended from a cable can be placed outside the chamber junction subassembly of a flow diverting string.

Exiting a select lateral opening can also be beneficial for tool deployment outside a flow diverting string, as illustrated in FIGS. 27 and 28, e.g. measurements may be taken monitor a cavern for anomalous solution mining events.

FIG. 19 depicts a plan view, and FIG. 20 depicts a sectional elevation view on line E-E of FIG. 19. The Figures depict the combined chamber junction and crossover subassembly (51) of FIGS. 13 and 14, with the flow diverter (47) of FIGS. 21 and 22. Three lower orifice exits of the flow diverter (47) are shown in communication and alignment with respective lateral openings of the combined chamber junction and crossover subassembly (51).

The flow diverter (47) thereby provides a flow path through the inner bore (25) to the bore or cavern surrounding the combined chamber junction crossover subassembly, which forces return flow to enter the outer annular passageway (24) via a passageway of the flow diverting string.

Using a plurality of lateral openings for the exit and entry of flow through a flow diverting string reduces the harmonic flow vibrations and preferential leaching of a salt cavern by evenly distributing the exit flow and return flow around the outside perimeter of the flow diverting string.

FIGS. 21 to 22 and FIGS. 23 to 24, depict preferred embodiments of flow diverters (47) with a plurality of lateral openings and a single lateral opening, respectively. The flow diverter (47) is shown having an annular recess (58A) for placing and retrieving the flow diverter and engagement and/or orientation keys (96) to engage and/or orient the flow diverter with the lateral openings in the flow diverting string.

FIG. 21 depicts a plan view, and FIG. 22 depicts a sectional elevation view on line F-F of FIG. 21, showing the flow diverter having a single upper orifice (49) and a plurality of lower orifices (50). The depicted flow diverter can be incorporated in the arrangements shown in FIGS. 19 and 20.

FIG. 23 depicts a plan view, and FIG. 24 depicts a sectional elevation view on line G-G of FIG. 23. The depicted embodiment of the flow diverter includes single upper (49) and lower (50) orifices. The flow diverter can be incorporated into the arrangements shown in FIGS. 17 to 18 and FIGS. 27 to 28.

FIG. 25 depicts a plan view, and FIG. 26 depicts a sectional elevation view on line H-H of FIG. 25 with dashed lines showing hidden surfaces. The Figures show a preferred embodiment of an extension tool (115) comprising a straight or jointed conduit (118) wherein a tool (120) may be suspended therein from a cable (121). The tool can be placed within the tool extension embodiment engaged via a mandrel (116) to a flow diverter (47 of FIGS. 23 and 24) orifice (49) of a combined chamber junction crossover subassembly (51 of FIGS. 13 and 14), as shown in FIGS. 27 and 28 as described in FIGS. 27 and 28.

Deployment of the extension tool (115) extends the exit bore of a lateral opening of a chamber junction of a flow diverting string to create separation between the cable (121) of a tool (120) deployed through the extension tool, to reduce the probability of wrapping the cable around the flow diverting string during deployment of the tool and preventing it from being retrieved effectively. After the risk of wrapping the cable around a flow diverting string is removed by retrieval of the tool from outside the flow diverting string, the extension tool (115) is removed.

An engagement mandrel (116) is shown located in, and/or engaged to, the exit bore jointed conduit extension (118) with an upper flexible joint (117A). The flexible joints are bendable in two directions (117A) or one direction (117B), (i.e. like an elbow) allowing the jointed conduit extension (118) and the tool (120) to enter a flow diverter and to exit a lateral opening, with the mandrel (116) allowing the tool (120) to exit into the cavern, suspended by a cable, with the conduit extension supporting the tool and cable, as shown in FIGS. 27 and 28. A wireline entry guide can form part of the exit bore jointed conduit extension (118) to aid re-entry of the cable (121) and the tool (120), with the extension tool retrieved from the flow diverter by the cable and engagement with the tool.

While one bidirectional flexible joint (117A) and one single directional flexible joint (117B) are shown, more than one bidirectional or single directional joint can be used along the length of the conduit extension (118) to allow bending in one direction to pass through the flow diverter (47 of FIG. 24), but incapable of bending in the opposite direction, once outside the flow diverting string (shown in FIG. 28). This can be used to extend the workable length of the conduit extension, providing further separation and reduction in the propensity of the cable (121) to wrap around the flow diverting string during tool deployments, e.g. sonar measurements inside the cavern.

FIG. 27 depicts a plan view, and FIG. 28 depicts an axial cross-sectional view on line I-I of FIG. 27. The figures depict the combined chamber junction and crossover subassembly (51), of FIGS. 13 and 14, with the flow diverter (47), of FIGS. 23 and 24 inserted therein. The extension tool (115) of FIGS. 25 and 26 is shown inserted into the passageway of the flow diverter to extend the exit bore past the truncation of the outer chamber junction's exit bore at the chamber wall (41). This allows the tool (120) to be deployed with a cable (121), from the jointed conduit extension (118) through the lateral opening of the combined chamber junction and crossover subassembly and into a bore or cavern.

During solution mining, various measurement tools may be needed to measure downhole conditions, including sonar. Inclusion of a chamber junction (43) with a plurality of downward sloping lateral openings, with an oriented flow diverter (47) placed within, provides access to the cavern outside the chamber junction. As the cable (121) carrying a sonar tool (120) can become wrapped around a flow diverting string during deployment, an exit bore extension tool (115) can be inserted to replace the truncated exit bore conduit, needed to place a larger diameter string within a bore, after sufficient space has been created by leaching and forming of a cavern space outward from the bore diameter. The extension conduit (118) separates the wire from the flow diverting string to reduce the probability of wrapping the cable around the flow diverting string. A wireline entry guide (119) (shown in FIG. 26), located at the lower end of the extension conduit (118), aids re-entry of the wire and tool (120) into the extension conduit (118).

Figures 83, 84, 85, 86, 87, 88, 88A:
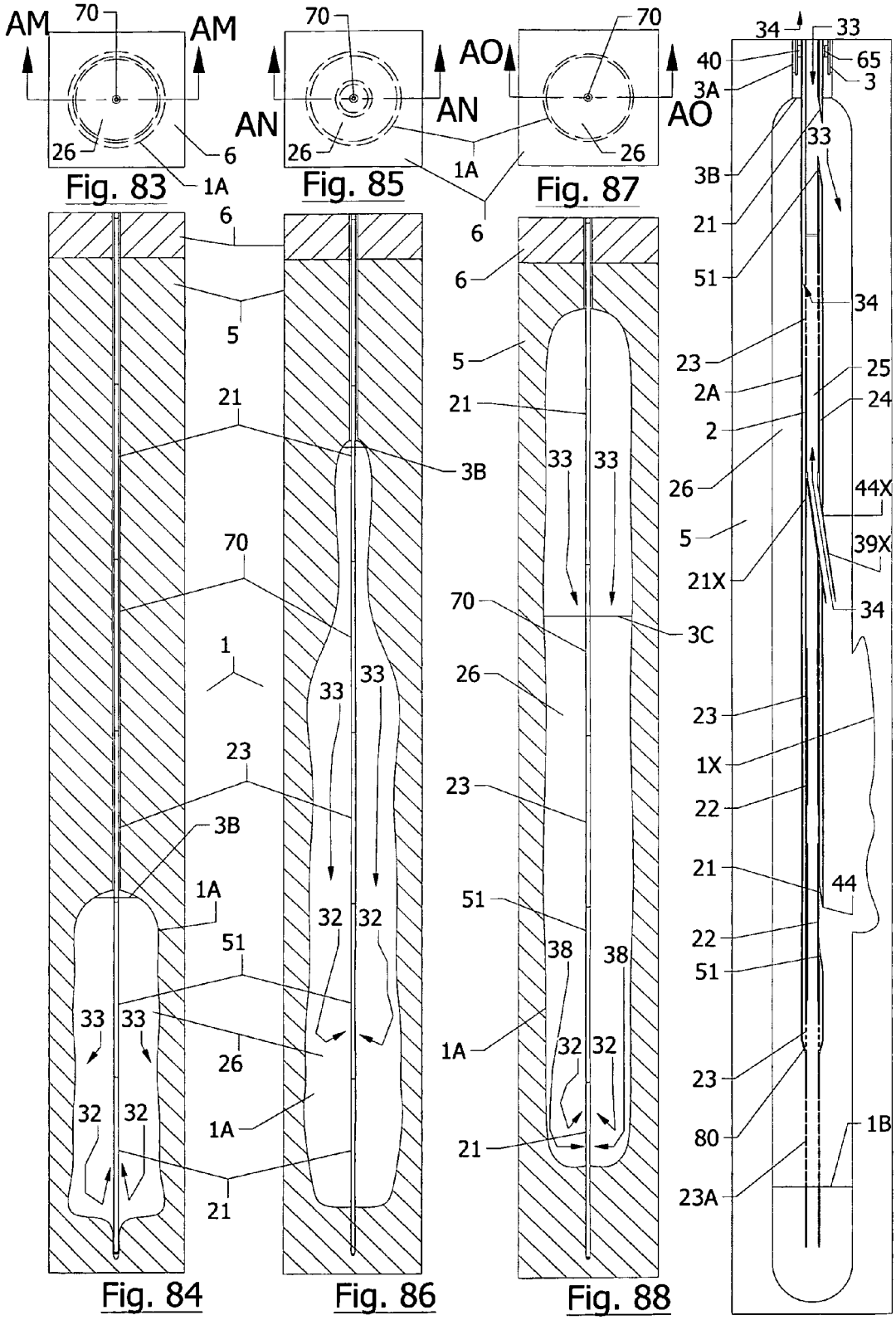
FIGS. 83-88 depict creation of the storage space or cavern during solution mining operations and subsequent dewatering, storing and/or extraction of fluid extraction from said cavern using a flow diverting string.
FIG. 88A depicts a diagrammatic view of solution mining where an anomaly has occurred during leaching and a new lateral opening has been created above said anomaly with a rotary cable tool after which a conduit is installed to allow solution mining to continue without further leaching of the anomaly.

Measurement of downhole conditions is useful to determine when flow control devices should be rearranged and to find leaching abnormalities, such as that illustrated in FIG. 88A.

Taking sonar measurements outside the flow diverting string and through a plurality of lateral openings allows measurement of the full cavern without interference from the flow diverting string, if data from multiple sonar measurements are spliced together.

More specifically, reduced quality sonar measurements can be taken through both the inner (2) and outer (2A) leaching strings, and merged with a plurality of sonar measurements taken outside a plurality of lateral openings of one or more chamber junctions, using an exit bore extension tool (115). Preferably, the sonar tool is extended a minimum distance below the extension tool that a sonar tool (120) can be extended, to minimize the risk of wrapping the suspending cable (121) around the flow diverting string. This method achieves a high quality sonar measurement.

The ability to place measurement tools, such as sonar, outside the flow diverting string avoids the conventional need to accept reduced quality sonar measurements, that are taken through inner and outer leaching strings and/or eliminates the need for the inner and outer leaching strings to take higher quality measurements.

Referring now to FIGS. 29 to 32A and FIGS. 44 to 52, embodiments of chamber junctions (51) are shown, in which diameters of the bores, and/or the flow diverting string in which the chamber is included, do not require truncation of exit bore conduits of the chamber junction for placement of the flow diverting string. Flow diverters (47) can be placed within the chambers, and isolation conduits (91) can be placed within exit bores (39) to control the flow through the flow diverting string to selectively place water into a cavern and extract brine from the a cavern in one or more selected radial directions, which is usable, for example, to preferentially leach radially outward or downward at a preferred point on the circumference of a flow diverting string in instances where anomalies (1X of FIG. 88A) are believed to exist.

Dual exit bores (39 of FIGS. 29 to 32A) of multiple chamber junctions (51) can be used to place water and extract brine through the inner bore or outer annular passageway between the dual exit bore conduits, and are dependent on depth, exit bore orientation between chamber junctions, and placement of flow control devices within the exit bore conduits, as illustrated in FIGS. 29 to 32A. Similarly, the exit bores can be used to place water at differing radial orientations and depths and to extract brine at potentially differing radial orientations and depths, through placement of isolation conduits as illustrated in FIGS. 44 to 52. Selection of radial orientation and depth of water placement and brine retrieval is not possible through use of conventional leaching strings.

FIGS. 29 to 30B and FIGS. 31 to 32A depict various embodiments of combined chamber junctions, cross over subassemblies (51), and a flow diverter usable to create the flow diverting string of FIG. 30C, which is similar in function to that of FIGS. 4 to 6 and FIGS. 78 to 92, to solution mine and operate a production well and/or a storage cavern in a salt deposit. The single lateral opening chamber junction and flow diverter embodiments are similar in function and use to the chamber junction having a plurality of lateral openings, a flow diverter, and isolation conduit embodiments as shown in FIGS. 44 to 58, and are usable when preferential leaching is desired.

FIG. 29 depicts a plan view of an embodiment of two concentric chamber junctions. FIGS. 30, 30B, 30C and 32A depict sections on line J-J of FIG. 29. The Figures depict a combined chamber junction crossover subassembly (51), that can be usable with the flow diverting string (70 of FIG. 30C) for solution mining and storage operations.

Specifically, FIGS. 30, 30A and 30B show an axial cross sectional view, a bottom plan view, and an isometric cross sectional view, respectively on the line J-J, showing the combined chamber junction crossover subassembly (51), of FIG. 29.

Referring now to FIGS. 29 through 30B, an assembly of concentric chamber junctions (43) and concentric conduit flow crossovers (23) is depicted. The two concentric chamber junctions (43) include two concentric additional orifice conduits defining exit bores. The first conduit extends generally downward from the upper first orifice, and the second conduit extends at an inclination from the central axis of the chamber (41), to form a combined chamber junction crossover subassembly (51). The exit bore conduits (39) are secured at a lateral opening (44) in the walls of each chamber (41). The centerlines of each additional orifice conduit (39) and the chamber (41) coincide at a junction (52). Therefore, the lateral opening of the depicted embodiment of a chamber junction crossover assembly is effectively extended to the end of the internal exit bore conduit, where the passageway extends into the bore or cavern.

The chamber junction of FIGS. 29 through 30B provides access to the outer annular passageway at each chamber junction by placing a plug in the upper engagement recess (58), or provides access to the internal passageway by placing an isolation sleeve across the crossover (23), effectively providing direct access to either the inner passageway or outer annular passageway at each chamber junction within a flow diverting string.

Additional embodiments of chamber junctions provide only access to the inner passageway of the inner conduit (2), wherein crossover to the outer or first annular passageway occurs between the inner and outer (2A) strings, from the inner passageway to the first annular passageway, and below a flow diverter having two orifices and a passageway. The embodiments of FIGS. 29 to 30B include a crossover from the inner passageway and through a crossover (23) using a flow diverting plug (not shown) in the upper recess (58), without the need for a passageway through the flow diverting plug. Hence, various embodiments of chamber junctions with lateral openings can use flow diverters with or without internal passageways.

An upper annular isolation conduit engagement recess (58) is disposed between concentric additional orifice conduits (39) and a concentric conduits flow crossover (23), with a lower annular isolation conduit engagement recess (58) formed in the lower end of the concentric conduits flow crossover (23). The recesses (58) can be adapted to retain an optional isolation conduit, valve, isolation plug (not shown in FIGS. 29 to 30B), or other flow control device across the orifices of the concentric conduits flow crossover (23). The annular space between the inner and outer additional orifice conduits (39) can be closed at the end of the concentric conduits flow crossover (23) to facilitate differential pressure bearing communication within the annular space if an isolation conduit is installed between the recesses (58).

While one set of dual exit bore conduits are shown, a plurality of conduits are usable within a single chamber junction to control the radial direction of water exit and brine entry during solution mining, each of which may be configured with different diameters or choking flow control devices to perform preferential leaching.

The flow communication within and about the combined chamber junction crossover subassembly (51) can be controlled by placement of flow diverters in the internal chamber, valves in the engagement recesses (58) across the internal bore or passageway between concentric exit bore conduits, isolation plugs in the engagement recesses (58), an isolation conduit between the engagement recesses (58), or combinations thereof.

Selective flow control can be used, for example, during combined solution mining and production processing under a junction of wells, such as the embodiment illustrated in FIG. 89, in which hydrocarbons and produced water from one well flows into a solution mined cavern under the junction of wells, or through piping at the surface and into a separate well. Production flows to the lower end of a flow diverting string through the inner passageway, with lighter hydrocarbons rising through the cavern and functioning as a cushion or blanket to prevent leaching in an upward direction. The internal passageway of an axially upward chamber junction's concentric exit bore conduits is blocked by a plug in the upper recess allowing hydrocarbon fluids into the annular passageway, with blocking of the internal passageway of an additional chamber junction's concentric exit bore conduits by a plug, and a pressure activated valve in the lower recess to allow hydrocarbon gas to flow up the outer annulus once a certain pressure is reached, thus creating a subterranean processing facility where hydrocarbons are separated from produced water and the gas is lifted to the surface once a defined pressure has been reached.

Placement of a flow diverter (47 of FIGS. 31 and 32) enables communication between the bore of the internal chamber and the corresponding exit bore (39) for fluid flow or passage of apparatus, while isolating the lower bore.

In the exemplary above subterranean process facility, flow can be changed within the flow diverting string to allow produced water and hydrocarbons to exit into the cavern through a flow diverter (47), that is placed in an axially upward chamber junction, while an axially lower chamber junction's concentric exit bore conduits (39) crossover (23) can be used to remove brine through the outer annular passageway from a selected level in the cavern, to solution mine the cavern axially upward by filling it with hydrocarbons and produced water. By alternating between filling the cavern with hydrocarbons and produced water to remove brine, and then removing hydrocarbons by filling the cavern with hydrocarbons and produced water, expensive produced water treatment facilities on hydrocarbon production wells can be minimized, especially in offshore applications where discharge of brine disposal has few detrimental effects.

Placement of an isolation conduit or valve through a flow diverter between the upper and lower engagement recesses (58) (as shown in FIG. 30B), isolates the annular space and allows communication of the internal bore of the additional orifice conduit with the space within which it is disposed. The flow diverter can be either left in place or removed to affect internal chamber bore communication by taking or discharging flow from the internal passageway at multiple levels. This would be the case for the above example, if produced hydrocarbons and water entered the cavern through the outer annular passageway while gas-lifting of fluid hydrocarbon flow occurs through the internal passageway.

Placement of an isolation plug through a flow diverter across the internal bore in the upper engagement recess (58) allows communication of the annular space between concentric additional orifice conduits, comprising an extension of the outer annular passageway with the space within which it is disposed at each chamber junction of a flow diverting string.

Placement of an isolation plug or valve through a flow diverter across the internal bore in the lower engagement recess (58) allows communication of the annular space, between concentric additional orifice conduits (39), with the internal bore of the internal concentric conduit. The flow diverter can be either left in place or removed to affect internal chamber bore communication so as to allow circulation between the inner passageway and outer annular passageway.

Circulation between the internal bore and outer annular passageway facilitates maintenance of the flow diverting string, through which fresh water can be circulated to remove any build up of salt within the flow diverting string resulting from solution mining, dewatering or processes where the injection of hot gas or liquids and the cooling of the extracted brine can cause restrictions or plugging of the passageways through a fall out and building up of salt within the string.

Additionally, microorganisms carried in water can grow within the flow diverting string, and chemicals can be circulated between the inner passageway and outer passageway to clean the string.

The ability to circulate between the inner passageway and outer annular passageway also allows the use of positive displacement fluid motors, which can be deployed on cables to mechanically clean or repair embodiments of the flow diverting string.

Placement of two isolation plugs or valves across the internal bores in the upper and lower engagement recess (58) retains differential pressure bearing integrity of the annular space between the concentric additional orifice conduits and integrity of the internal concentric bore conduit, while isolating the space within which the combined chamber junction crossover subassembly (51) is located, effectively removing the functionality of the chamber junction when desired.

FIG. 30C depicts an embodiment of a flow diverting string (70), having an upper combined chamber junction crossover subassembly (51), as shown in FIGS. 29-30B, coupled to a lower combined chamber junction crossover subassembly (51) of similar construction.

Connecting a plurality of chamber junctions of similar construction to those of FIGS. 29 to 30B creates a flow diverting string (70) with inner passageway and outer annular passageway entry and exit locations along the axis of the flow diverting string, thereby increasing the flow diverting capabilities of the flow diverting string and reducing the number of engagement points along the axis of the flow diverting string by moving the concentric crossover off the central axis. Movement of the concentric conduit crossover (23) away from the central axis increases the number of internal diameter reductions within a flow diverting string (70).

Figure 64:
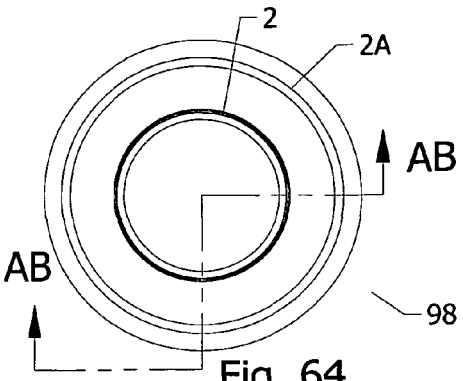
FIGS. 64-67 depict a preferred embodiment of an alternative engagement arrangement for coupling of casings for forming and using a subterranean cavern in salt.
Figure 65:
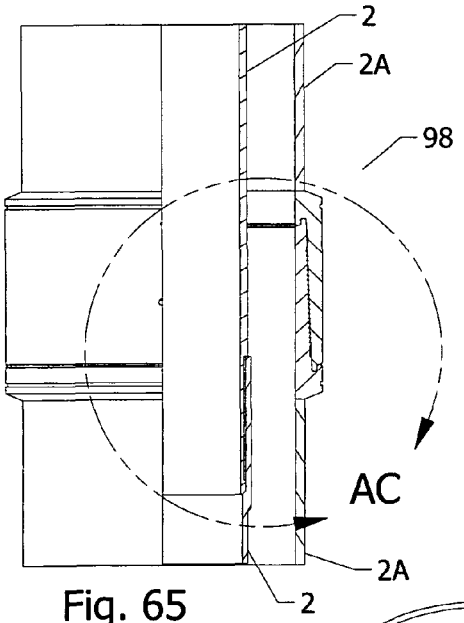
Figure 66:
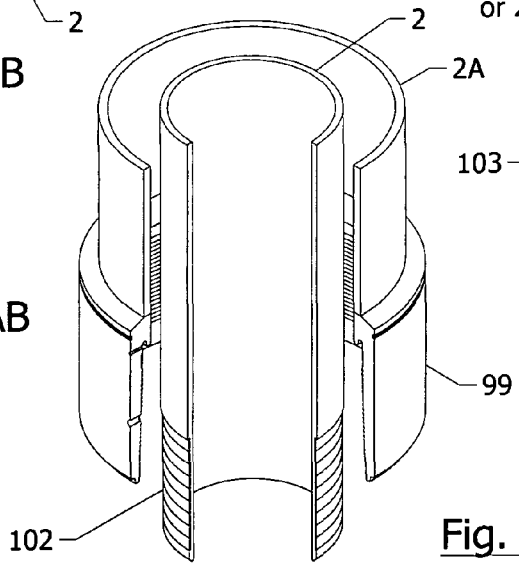

While chamber junctions of a flow diverting string can be connected in any fashion, the embodiments shown in FIGS. 29 to 30C are especially suitable for use with bolted or flanged connections, as shown in FIGS. 45 to 48, or the snap together connections illustrated in FIGS. 64 to 66.

As illustrated in FIGS. 4 to 30C, any number of chamber junctions having any configuration of additional orifices, also referred to as lateral openings, can be stacked or otherwise arranged in series, thus enabling provision of additional orifice conduits oriented to communicate within a bore or cavern of varying configurations. The additional orifice conduits can be rotationally or axially displaced from one another by any distance or angle during the processes of solution mining, dewatering, and storage operations.

FIG. 31 depicts a plan view, and FIG. 32 depicts a section on line K-K of FIG. 31, showing an embodiment of a bore selection tool or flow diverter (47), having a generally tubular shape, with an angled internal bore (49) at its upper end that terminates at a lateral opening (50).

FIG. 32A is an isometric view taken on lines J-J and K-K depicting the flow diverter (47), of FIGS. 31 and 32, engaged within the combined chamber junction crossover subassembly (51) of FIGS. 29-30B. As shown, when inserted within the first orifice at the upper end of the internal chamber junction of the combined chamber junction crossover subassembly (51), the lateral opening (50) of the flow diverter (47) aligns with an additional orifice or lateral opening of the internal chamber junction. This, enables operations to be performed through the lateral opening that correspond to the aligned additional orifice by circulating gases and/or fluids, passing tools, coiled tubing, and/or other similar objects through the internal bore (49) of the flow diverter. At the same time, one or more other internal bores are isolated, after which the bore selection tool (47) can be removed to restore communication between all additional orifices.

FIGS. 33 to 38, FIGS. 41 to 43 and FIGS. 59 to 62 depict embodiments of various subassemblies (52, 23, 54, 71) which can be engaged by connections comprising an inner threaded connection, in the form of a threaded pin (57) at one end, and a complementary threaded box (56) and an outer welded connection utilizing a weld prep (61) at the end of each abutting outer conduit section.

Figures 33, 34, 35, 36, 37, 38:
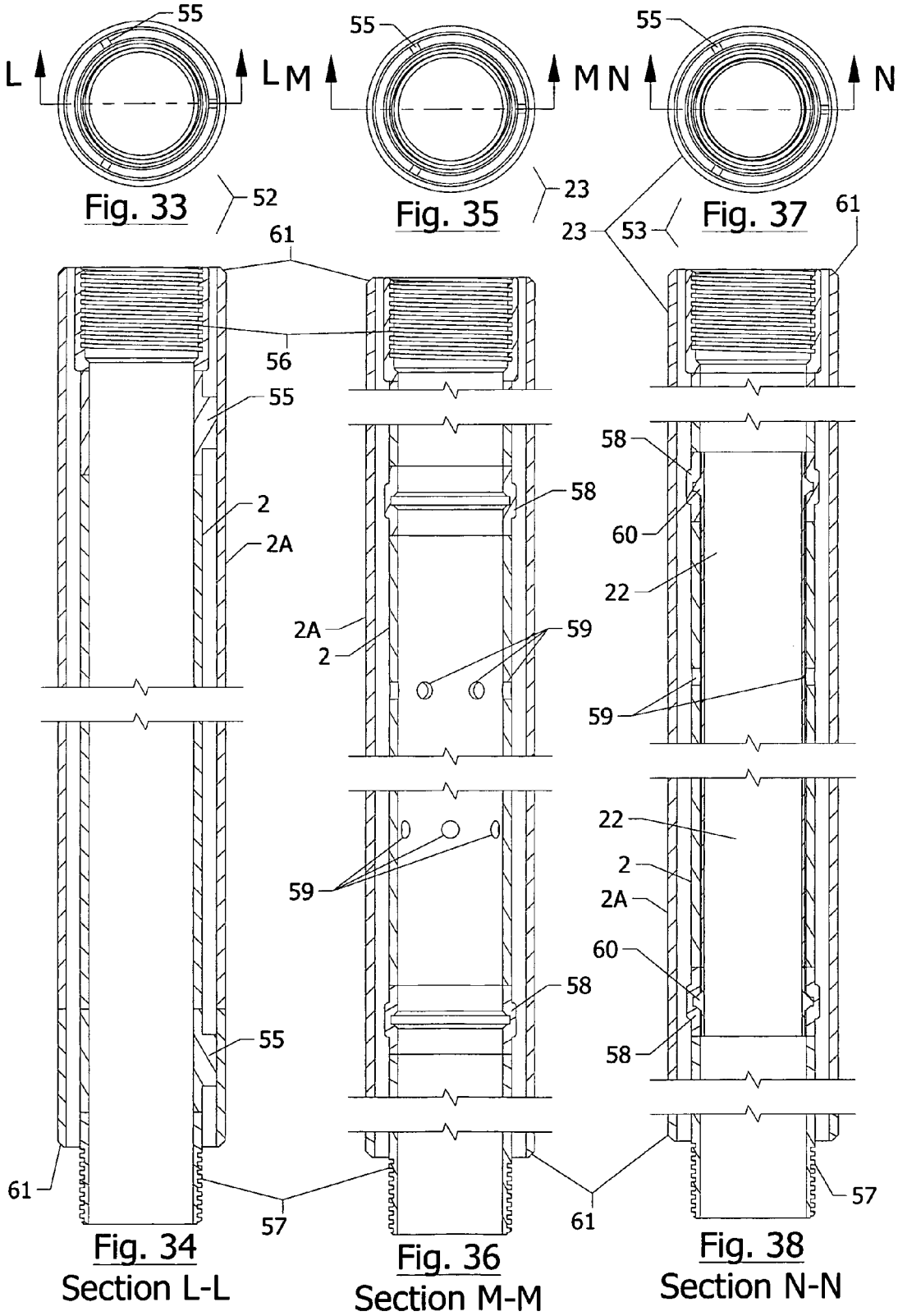
FIGS. 33-34 depict a preferred embodiment of two engaged concentric conduits subassemblies with connectors, one at each end, for threaded and welded engagements placeable between chamber junction subassemblies of a flow diverting string embodiment.
FIGS. 35-38 depict a preferred embodiment of a concentric conduits flow crossover subassembly with and without an isolation conduit installed within its internal bore, usable within a flow diverting string embodiment.

FIGS. 33 and 34 show a plan view and cross sectional elevation view on line L-L, respectively, depicting an embodiment of a concentric conduit sub-assembly (52) that includes a section of inner leaching string (2) engaged to a section of outer leaching string (2A) at radial projections (55), maintaining the end of the threaded box (56) flush with the end of the surrounding outer leaching string section and the threaded pin (57) at the other end protruding a distance equal to the depth of the threaded box (56). Accordingly, successive concentric conduit sections can be secured to each other by screwing a projecting threaded pin (57) into the threaded box (56) of another section until the weld preps (61) of the sections of outer leaching string (2A) abut each other, and then welding together the sections of outer leaching string at the weld preps (61). The inner and outer conduit sections of FIGS. 36 and 38 are similarly connected by radial projections, as can be seen in FIGS. 35 and 37. The concentric conduit subassembly 52 can be run above a production packer to place components at the required subterranean depth for both solution mining and storage operations.

In FIGS. 35 and 36, a plan view and cross sectional elevation view on line M-M are shown, depicting an embodiment of a concentric conduit crossover (23) subassembly in which the inner conduit has perforations (59) which provide a flow crossover. FIGS. 37 and 38 depict a plan view and a cross sectional elevation view on line N-N, in which these perforations are blocked by an isolation conduit (22) engaged with a mandrel (60), which is releasably held in engagement recesses (58).

Figures 39, 40, 41, 42, 43:
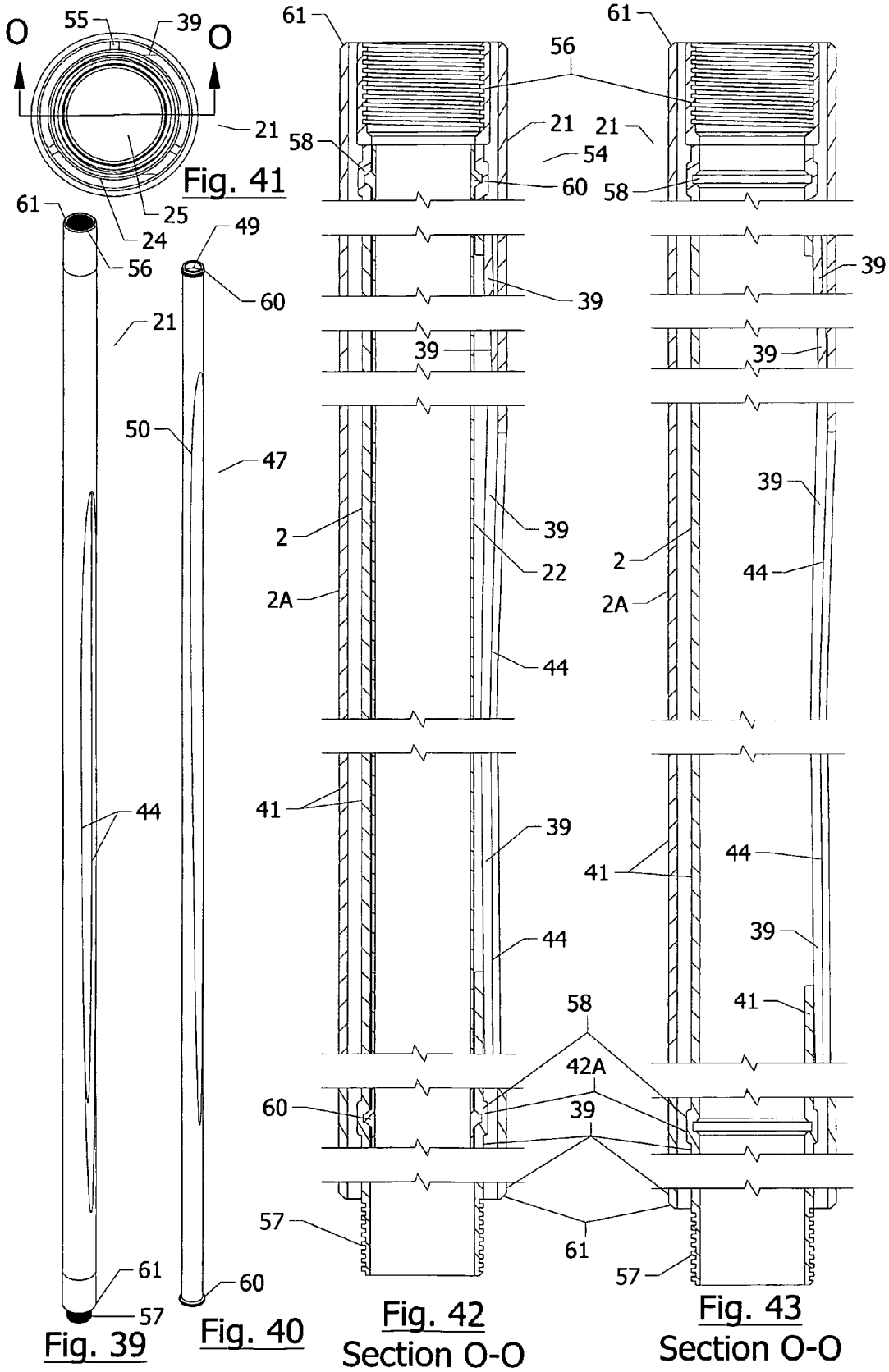
FIGS. 39-40 depict preferred embodiments of a concentric chamber junction subassembly and a flow diverter for the chamber junction subassembly, respectively, usable within a flow diverting string embodiment.
FIGS. 41-43 depict the embodiment of the concentric chamber junction subassembly of FIG. 39, with and without an isolation conduit installed and usable within a flow diverting string embodiment.

FIGS. 39 and 40 depict isometric views of a chamber junction subassembly (21) and associated flow diverter (47). In FIGS. 41 and 42, a plan view with section line O-O and an associated cross sectional elevation view along line O-O are shown, depicting an embodiment of a chamber junction subassembly (21) with a lateral opening (44) from the internal passageway with associated flow diverter (47 of FIG. 40) lower orifice (50 of FIG. 40), that is alignable with the lateral opening and an isolation conduit (22 of FIG. 42) to close the lateral opening. FIG. 42 shows a cross sectional elevation view along line O-O of FIG. 41, in which the lateral opening is blocked by an isolation conduit (22) engaged with a mandrel (60), which is releasably held in an engagement recesses (58).

FIG. 43 depicts a line O-O cross sectional elevation view of the embodiment of FIG. 41, wherein the isolation conduit (22 of FIG. 42) has been removed to allow placement of a flow diverter (47 of FIG. 40).

Referring now to FIGS. 39 to 43, flow diverters (47 of FIG. 40) can be inserted into chamber junctions (21 of FIG. 41), aligning their lower orifice (50 of FIG. 40) with the lateral opening (44 of FIGS. 39, 42 and 43) to divert fluid or tools through the lateral junction, while isolation conduits (22 of FIG. 42) can be inserted into the chamber junctions to prevent fluids or tools from exiting the lateral opening, as shown in FIG. 42.

In a similar construction to that shown in FIG. 12, embodiments of a flow diverting string can be created by assembling the dual conduit sections of FIGS. 33 to 34 with the crossover embodiments of FIGS. 35 to 38, and the chamber junction embodiments of FIGS. 41 to 43, wherein flow diverters (47 of FIG. 40 and isolation conduits (22 of FIGS. 38 ad 42) can be used to control flow through the flow diverting string. as described in FIGS. 4 to 6.

To assemble a flow diverting string (70) from any of the above embodiments of concentric conduit subassemblies, the concentric conduit string pin ends (57) are screwed into the threaded box ends (56) until the weld preparation (61) meets the tolerance requirements of securing the connection with a weld.

The resulting threaded connection of the internal conduit sections forms a differential pressure bearing seal of the inner leaching string (2), when the associated weld preparation of the outer leaching string (2A) is within the required welding tolerance. This threaded and welded connection can be used to form a flow diverting string (70) of any desired length.

As solution mining is performed with water pumped and brine returned, the inner connections of the internal conduit sections can be liquid tight, while the outer welded connection between the outer concentric conduits can be both liquid and gas tight. The latter connection can be checked, such as through use of x-raying and/or ultrasonic testing, to insure integrity.

Successive concentric conduit sections can be connected in the manner described above to form a flow diverting string (70), which avoids the need to replace a conventional solution mining string with a completion string.

Figure 67:
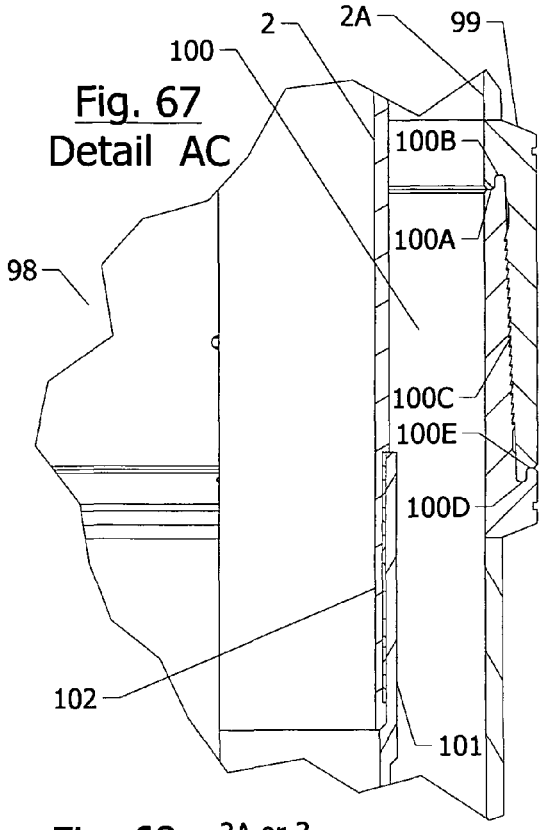

FIG. 64 depicts a plan view, while FIG. 65 depicts an elevation view, partially in section, on line AB-AB of FIG. 64. FIG. 66 depicts an isometric view, and FIG. 67 depicts a magnified view on detail line AC of FIG. 64. The figures depict an embodiment of a snap-fit coupling for a concentric string connection, which can be used instead of the threaded and welded connection, described above, to connect sections of inner leaching string (2) and outer leaching string (2A) to form a flow diverting string. A known gas tight "snap together" (snap-fit coupling), such as Oil States®, couples the conduit of the outer leaching string (2A) with a conventional seal stack mandrel (102) and polished bore receptacle (101), for providing a fluid tight differential pressure bearing connection for the inner leaching string (2). These snap together connections (99) can be used as an alternative to the threaded and welded connections described above, shown in FIGS. 33 to 38, FIGS. 41 to 43 and FIGS. 59 to 62.

A suitable construction for a snap together connection (98) can include a box end (99) and a pin end (100) having an internal load shoulder (100A) and external load shoulder (100E), which prevent excessive loading of the sealing surfaces (100B) and (100D), which are coupled by engaging teeth (100C), that can be protected by the internal and external load shoulders and sealing surfaces.

Snap together connectors are generally more expensive than welded connections, but can be assembled more quickly. Hence, use of snap together connectors can be less expensive than welding during onshore construction of a gas or liquid storage wells, while expensive construction rigs and vessels wait for the welding to occur.

Offshore construction costs are, however, orders of magnitude greater than onshore construction costs for gas and liquid storage well construction. In these circumstances, savings of time outweigh equipment costs, and it can be more economical to use the above snap together connectors.

As demonstrated in FIGS. 33 to 38, FIGS. 41 to 43, FIGS. 59 to 62 and FIGS. 64 to 67, threaded and welded connections, or snap together connections, used with internal sealing mandrels and receptacles, can be used to create a gas tight differential pressure seal for any coupling of the outer leaching string (2A) and a fluid tight differential pressure seal of the internal leaching string (2) of the flow diverting string (70). Snap together seals can be of particular importance if a significant probability exists that the flow diverting string would require removal at any time in the storage well's useful life.

Alternatively, embodiments equivalent to combined chamber junction crossover over subassemblies (51 of FIGS. 13 to 20, FIGS. 27 to 28 and FIGS. 29 to 30B) can be constructed by combining subassemblies of FIGS. 35 to 38 with subassemblies of FIG. 39 and FIGS. 41 to 43.

FIG. 35 depicts a plan view, and FIG. 36 depicts a section on line M-M of FIG. 35, showing an embodiment of a concentric conduits flow crossover subassembly (23) without an isolation conduit installed. Passageways (59) in the inner conduit allow flow to cross over between the inner passageway of the inner leaching string and the outer annular passageway, between the inner and outer leaching string.

The concentric conduits flow crossover (23) is generally placed below a chamber junction subassembly (21 of FIGS. 7 to 12, FIG. 41 to FIG. 43). In an embodiment, the combination of crossovers and chamber junctions performs the necessary functions of a combined chamber junction crossover subassembly (51 of FIGS. 13 to 20, FIGS. 27 to 30C and FIG. 32A), and can replace the combined chamber junction crossover subassembly.

FIGS. 37 and 38, depict an embodiment of a concentric conduits flow crossover subassembly (23) with an isolation conduit installed (22). Mandrel profiles (60), secured to distal ends of the isolation conduit (22), can engage connection recesses (58) to isolate the flow crossover passageways (59) of the inner leaching string (2) and the annular passageway between the inner leaching string (2) and the surrounding outer leaching string (2A).

The isolation conduit (22) can be installed through the single main bore and through any chamber junctions and/or flow diverters with the lubricator arrangement, as shown in FIG. 3. Alternatively, other conventional means can be used, such as coiled tubing, to reconfigure a flow diverting string (70 of FIGS. 4 to 6, FIG. 12, FIG. 30C and FIGS. 79 to 92) during solution mining or storage operations of one or more solution mined storage wells.

FIG. 39 and FIGS. 41 to 43 depict an embodiment of a concentric chamber junction subassembly (21) with threaded (56 and 57) and welded (61) concentric string connections at distal ends. FIG. 42 shows an isolation conduit (22) installed in the chamber junction subassembly, and FIG. 43 shows the chamber junction subassembly without an isolation conduit.

FIGS. 39 and 40, show an embodiment of a chamber junction subassembly (21) and an embodiment of an associated flow diverter (47), respectively. The flow diverter has mandrel profiles (60) at distal ends, which are engagable with associated recesses within the chamber junction. The lower orifice (50) of the flow diverter is aligned with the lateral opening (44) of the chamber junction (21) to isolate the bore of the chamber junction assembly's internal conduit, axially below the flow diverter, when inserted and to facilitate liquid/gas flow or tool passage from the upper orifice (49) substantially coincidental with the inner passageway of the chamber junction to the lower orifice (50), when oriented with the lateral opening. Flow diverters (47) can have mandrels, keys, or other orientation or engagement devices at one or both ends to aid the orientation and/or engagement of the flow diverter with one or more lateral openings of a chamber junction subassembly (21).

FIGS. 41 and 42 depict the concentric chamber junction subassembly of FIG. 39, which shows concentric chamber junctions with its lateral opening (44) and laterally deviated exit bore (39) blocked by an installed isolation conduit (22), having mandrel profiles (60) at distal ends, and engaged within recesses (58) that are secured to the internal chamber junction walls (41). The lower recess (58) serves as a chamber junction bottom (42A), engagable with an associated lower mandrel profile (60 of FIG. 40) of a flow diverter (47 of FIG. 40). When the isolation conduit (22) is engaged within the internal concentric chamber junction, the isolation conduit (22) can isolate the exit bore (39) of the laterally deviated additional orifice conduit or lateral opening, allowing flow from the internal chamber (41) to the exit bore (39).

The isolation conduit (22) or other flow control devices can be installed through the single main bore and through any chamber junctions and/or flow diverters with wireline equipment or by other means, such as coiled tubing, to reconfigure the concentric chamber junction subassembly (21). A flow control device can be used to change the flow configuration of an associated flow diverting string (70 of FIGS. 4 to 6 and FIGS. 78 to 92) during solution mining or storage operations, or allow apparatuses, such as sonar cavern measurement tools, to exit and re-enter the flow diverting string.

FIG. 43 depicts the chamber junction subassembly (21) embodiment, as shown in FIGS. 39 and 41, which differs from that shown in FIG. 42 due to omission of the isolation conduit (22). Omission of the isolation conduit (22) allows gas/fluid flow or an apparatus, including a sonar tool, to pass through the lateral opening (44) when guided by a flow diverter (47 of FIG. 40, not shown in FIG. 43) installed within and engaged with one or more mandrel recesses (58).

FIGS. 44 to 58 depict various preferred embodiments of combined chamber junction and crossover subassemblies (51), isolation conduits (22 and 91), bore selectors (47), and exit bore extensions usable in a flow diverting string (70 of FIGS. 4 to 6, FIG. 12 and FIGS. 78 to 92) for forming or using a subterranean cavern in a salt deposit.

Figures 51, 52, 53, 54, 55, 56, 57, 58:
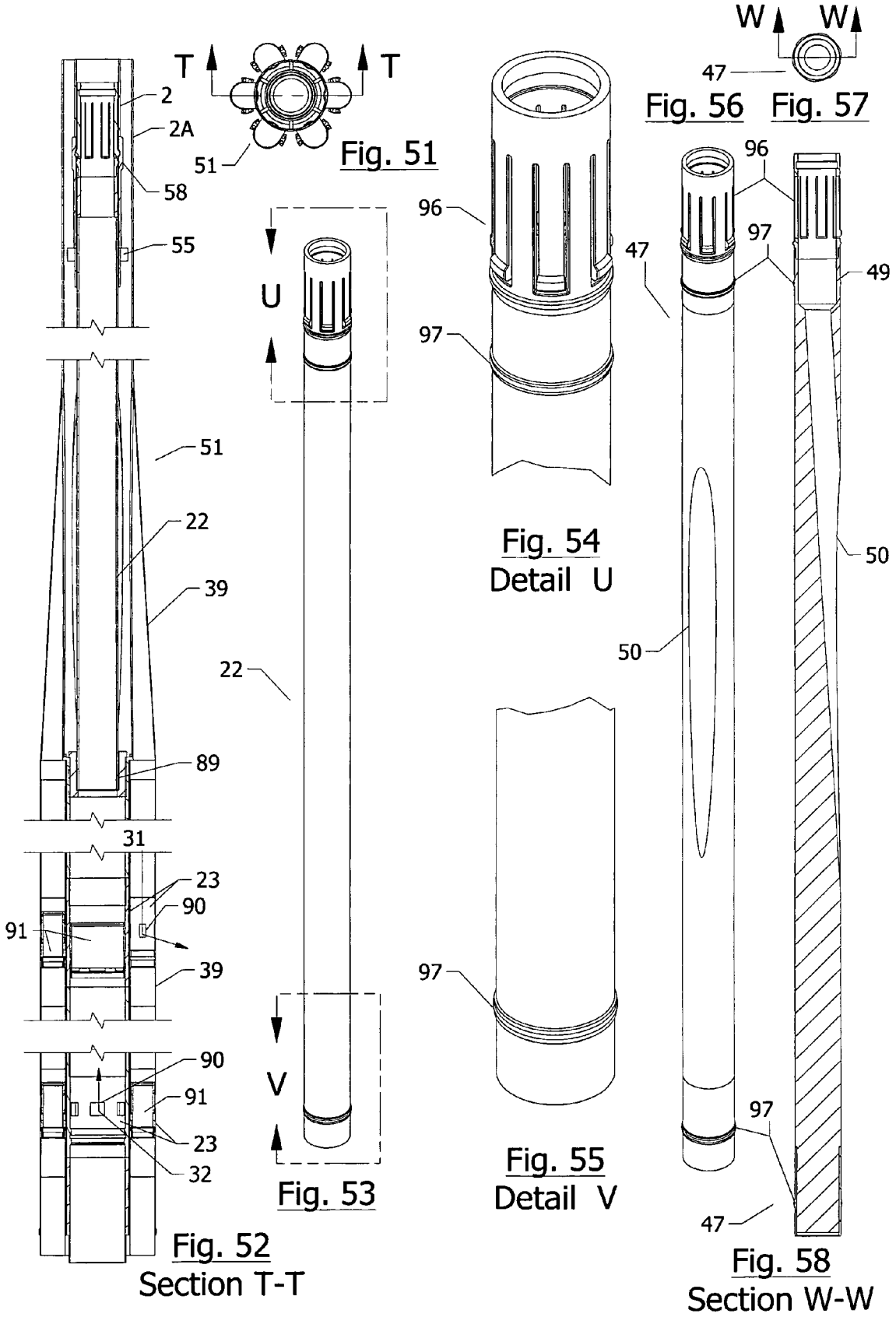
FIG. 51-52 depicts the concentric chamber junction subassemblies of FIGS. 44 to 48 with the preferred embodiment of the central isolation conduit of FIGS. 53 to 55 inserted within, wherein flow between exit bores and exit bore extensions may be used as part of a flow diverting string.
FIGS. 53-55 depict a preferred embodiment of a central isolation conduit usable in the concentric chamber junction subassembly of FIGS. 44 to 48.
FIGS. 56-58 depict a preferred embodiment of a flow diverter usable in the concentric chamber junction subassembly of FIGS. 44 to 48 once the isolation conduit of FIGS. 53 to 55 has been removed.

FIG. 44 depicts a plan view, and FIG. 45 depicts an isometric section on line P-P of FIG. 44, the figures showing an embodiment of a combined chamber junction and crossover subassembly (51), without the internal isolation conduit (22 of FIGS. 53 to 55). The depicted exit bore conduits have not been truncated, thus requiring a larger diameter bore and/or smaller diameter conduits for placement within a flow diverting string to form and use a subterranean cavern in a salt deposit.

The chamber junction (43) has a chamber (41) with exit bores (39) extending downward and outward to an exit bore extension, shown separately in FIG. 50, and having placement passageways (90) which effectively extend the lateral openings (44) for passage of liquids or gases from the exit bore conduits, dependent upon the presence of an isolation device (91 of FIG. 49) placed within.

FIGS. 46 and 47 are magnified views on a detail lines Q and R of FIG. 45, respectively, showing radial projections (55) connecting the inner leaching string (2) and outer leaching string (2A) at the upper end of the chamber junction. FIG. 46 includes a recess (58), that is usable to locate an internal isolation conduit (22 of FIGS. 53 to 55, not shown in FIGS. 46 and 47), having a complementary snap-in mandrel (96 of FIG. 54). The isolation conduit (22) seals (97 of FIG. 54) at its upper end, with the isolation conduit located axially below the recess (58), and extends axially downward for engagement and sealing (97 of FIG. 55) with a chamber junction bottom receptacle (89 of FIG. 47), axially below the chamber junction bottom (42 of FIG. 47).

With an isolation conduit (22 of FIGS. 53 to 55) in place, flow from the outer annular passageway between the inner (2) and outer (2A) leaching strings is separated with flow in the outer annular passageway diverted to exit bores (39) by the chamber bottom (42A) (Shown in FIGS. 42 and 43). Substance placement passageways (90), extending from lateral openings, allow flow crossover between parallel conduits or can be blocked by isolation conduits (91), if desired, allowing control both circumferentially and/or axially if preferential leaching is desired as later described in FIG. 52.

FIG. 49 depicts an isometric view of an isolation conduit (91) comprising a placeable and displaceable barrier with mandrels (92), that are engagable with associated receptacles in exit bores (39), and differential pressure seals (94), that are engagable with the exit bore conduits to prevent flow through their lateral openings (90) in the exit bores. The isolation conduit includes an annular recess (93) to enable it to be located in a desired exit bore (39), when a bore selector (47 of FIGS. 56 to 58) is installed within the chamber junction (51 of FIG. 45) and oriented to the desired exit bore.

FIG. 48 depicts a magnified isometric view on detail line S of FIG. 47, showing a separable securing member (95), such as a bolted connection. The securing member (95) allows connection of the plurality of parallel conduits and, if necessary, disconnection with explosive charges to drop an unwanted apparatus below the connection to the bottom of the salt cavern.

As shown, the above connections between these exit bore conduits and/or the conduits of a combined chamber junction and crossover subassembly (51 of FIGS. 44 to 47) are less robust and more difficult to seal than welded connections. In an embodiment, the connections can be replaced by more robust connections, such as the snap together connections of FIGS. 64 to 67, in instances where a robust gas tight connection is needed.

FIG. 50 depicts an isometric view of an arrangement of exit bore extensions engagable with bolted connection tabs (95). Lateral openings (90) permit flow between the outermost exit bores (39) and the central bore conduit, i.e. a crossing over of flow.

FIG. 51 depicts a plan view, and FIG. 52 a section on line T-T of FIG. 51. The Figures depict the combined chamber junction and crossover subassembly (51) of FIGS. 44 to 48. An isolation conduit (22 of FIGS. 53 to 55) is shown inserted within and engaged with a recess (58) at its upper end and engaged with a sealing receptacle (89) at its lower end.

During use or formation of a cavern, flow through the outer annular passageway, between the inner leaching string (2) and outer leaching string (2A), passes over radial projections (55), securing the two strings together, enters exit bores (39) and exits (as shown by arrow 31) the combined chamber junction and crossover subassembly (51) at placement passageways (90) extending from lateral openings. Flow can reenter (as shown by arrow 32) the central exit bore through lower lateral openings (90), carrying brine is carried during the formation or use of the cavern.

Other configurations of flow exit and entry points, at varying depths and varying circumferential and central locations in the exit bore below the combined chamber junction and crossover subassembly (51), can be provided in the flow diverting string (70 of FIGS. 4 to 6, FIG. 12 and FIGS. 78 to 92).

FIGS. 56, 57 and 58 depict an isometric view, a plan view, and a cross sectional elevation view on line W-W of FIG. 57, respectively. The bore selection tool (47) can be engagable with the combined chamber junction and crossover subassembly (51 of FIGS. 44 to 45 and FIGS. 51 to 51) to allow isolation conduits (91 of FIG. 49) to pass from the internal passageway to an exit bore (39 of FIGS. 44 to 45 and FIGS. 51 to 51) and from the upper orifice (49) to the lower orifice (50). In addition, the Figures show a snap-in mandrel (97), which is engagable with a recess (58 of FIG. 52) to secure the tool in position in the subassembly (51), and further includes upper and lower seals (97).

FIGS. 59 to 63 depict isometric views of a preferred embodiment of an annulus isolation subassembly (71) for suspending a flow diverting string (70 of FIGS. 4 to 6, FIG. 12 and FIGS. 78 to 92) from its lower end, within a surrounding casing (3, as also shown in FIGS. 4 to 6). The subassembly is also shown having dual conduits extending from its upper end to a wellhead and valve tree. Alternatively, the dual conduits can extend from its upper end to a safety valve subassembly (105 of FIGS. 70 to 73, 112 of FIGS. 77 and 51A of FIGS. 94 to 104), or to a mandrel and receptacle subassembly (106 of FIG. 74, 122 of FIG. 74A).

The annulus isolation subassembly (71) has threaded (56 and 57) and welded (61) concentric string connections at distal ends. A production packer (40) and side pocket (66) are provided for a placeable and retrievable valve (62) to control a bypass passageway (65 of FIGS. 61 to 63). Valve 62 can be accessible via side pocket (66 of FIG. 61) to control flow between an upper annulus (40A) above a packer (40 of FIGS. 4-6), via an upper orifice (64) to bypass passageway (65) via a lower orifice (67 of FIG. 63), and a lower annulus (40B of FIGS. 4-6) below the packer (40). In this manner, the flow of gases or liquids, in the annuli above and below the packer (40), is used to place a cushion interface (3B of FIGS. 4 and 5) at a desired level under the control of a valve (62 of FIG. 61). The annulus isolation apparatus (71) is usable not only in the flow diverting string (70 of FIGS. 4 to 6), but also with the apparatus of FIG. 12, FIG. 30C, and FIGS. 78 to 92.

FIG. 59 depicts an isometric view, with a quarter section removed, to show internal components of an embodiment of an annulus isolation subassembly (71), with detail lines X, Y, Z and AA associated with FIGS. 60, 61, 62 and 63, respectively.

FIGS. 60 and 63 depict the box (56) and pin (57) threaded connections of the inner leaching string (2) within the outer leaching string (2A), the latter having a welding preparation (61) for a welded connection. These connections allow the inner bore (25) and the outer annular passageway (24) to be used for circulation of gas or liquids from adjacent subassemblies. The recess (58) can be used for a kick-over tool to aid the placement and retrieval of valves (62 of FIG. 61) from the side pocket (66 of FIG. 61).

FIG. 61 depicts a wireline placeable valve (62), insertable through the inner bore (25) into a side pocket (66). The wireline placeable valve (62) can be used to control gas for fluid flowing through the orifice (64), from the annulus (40A of FIGS. 4 to 6) outside the outer leaching string (2A) to the bypass passageway (65), which is differentially pressure sealed from the outer annular passageway (24) between the inner (2) and outer (2A) leaching strings. Placement of the valve (62) can be aided by use of the recess (58) and, if another recess is added below the side pocket (66), an isolation conduit can be used to isolate the side pocket, if required. In an alternate embodiment, expandable casing or other isolation means can be used to isolate the inner bore (25) from the annulus (40A of FIGS. 4 to 6) surrounding the subassembly.

FIG. 62 depicts a magnified isometric view on line Z of FIG. 59, which shows an embodiment of a production packer (40). The production packer (40) can be set by placing a barrier mandrel profile across the inner bore in the receptacle below the packer to apply pressure from a pressure integral ported passageway, from the inner bore (25) to the packer, to hydraulically activate engagement slips (69) and sealing elements (69A) for anchoring and sealing, respectively, to the final cemented casing (3 of FIG. 1 and FIGS. 4 to 6). The bypass passageway (65) is thereby differentially pressure sealed, from the outer annular passageway (24), to allow gas or liquid to pass from the upper orifice (64 of FIG. 61) to the lower orifice (67 of FIG. 63), where they define a cushion interface (3B of FIGS. 4 and 5) during the solution mining process. After engaging the packer, any barrier mandrel profile across the inner bore can be removed, and a valve (62 of FIG. 61) can be placed in the side pocket (66 of FIG. 61), if such a valve is not already present.

FIG. 63 depicts a magnified isometric view of the annulus isolation subassembly (71) taken on line AA of FIG. 59, showing the bypass passageway (65) passing through the outer annular passageway (24), between the inner leaching string (2) and outer leaching string (2A), and communicating with an orifice (67) leading to the annulus (40B of FIGS. 4 to 6) surrounding the subassembly.

FIGS. 59 to 63 depict solution mining operations that are carried out by circulating water and brine through the inner bore (25) and outer annular passageway (24), between the inner leaching string (2) and the connected outer leaching string (2A). A liquid or gas cushion interface (3B of FIGS. 4 and 5) can be controlled through the passageway (65), that bypasses the annulus isolation subassembly through a side pocket (66), and the valve (62), that can later be differentially pressure sealed once solution mining is completed.

To monitor the cushion interface (3B of FIGS. 4 and 5), additional cables can pass through the outer annular passageway (24) and the bypass passageway (65), to measure the depth of the cushion interface during solution mining.

After solution mining operations are completed, an isolation mandrel can be fitted into the side pocket (66) valve receptacle to isolate the bypass passageway (65) connecting the annulus (40A of FIGS. 4 to 6) surrounding the outer leaching string (2A), above the packer (40), and the annular space (40B of FIGS. 4 to 6) surrounding the outer leaching string, below the packer. As such, the storage cavern can be isolated from the upper production annulus (40A of FIGS. 4 to 6). Cables passing through the outer annular passageway (24), from the upper annulus (40A) to the lower annulus (40B) and past the packer (40), are generally sealed sufficiently to be left in place after solution mining operations. However, wet connect arrangements can be used to engage the cable during use, after which the cable can be removed and the penetration can be sealed with a conventional straddle, or expandable casing, to ensure pressure integrity.

Figure 68:
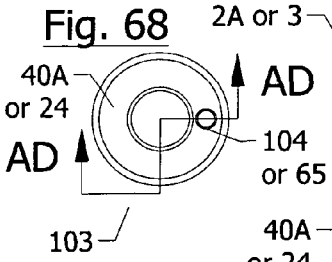
FIG. 68-69 depict preferred embodiments of an arrangement for placement of cement to seal a liner hanger in instances where off-the-shelf sealing technology is not available for larger bore sizes.
Figure 69:
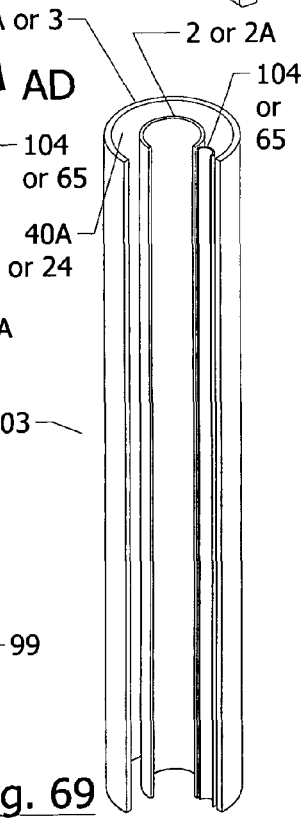

FIGS. 68 and 69 depict a plan view and an isometric section on line AD-AD, respectively, showing a placement apparatus (103), usable with any flow diverting string to place fluid cement in the annulus (40A), between the flow diverting string and the casing (3) above a packer (40 of FIG. 62), if a sealing element (69A of FIG. 62) is not available or is not sufficient to seal the upper annulus (40A) from the lower annulus (40B of FIGS. 4 to 6). The cement is circulated down a parallel conduit (104) for placement above the packer to differentially pressure seal the annular space, after solution mining and before storage operations.

As off-the-shelf liner hangers, without sealing elements (69A of FIG. 62), are available in sizes greater than those of a production packer having such sealing elements, this method can be used to allow the use of larger bore sizes to aid placement of apparatuses downhole and for circulation of fluids with a reduction in friction.

An alternative use can include placement of cement, before solution mining begins, using other means, such as an expandable cement packer circulating through spaces between the hanger engagement. In addition, methods of placement, usable for creating a gas and/or liquid interface (3B of FIGS. 4 and 5), can be used for placing the parallel conduit (104) in the outer annular passageway (24), between the inner (2) and outer (2A) leaching strings of a flow diverting string. Accordingly, the passageway of the parallel conduit can extend below the packer (40 of FIGS. 4 and 5) and penetrate the outer leaching string to place gas or fluid, thus creating the interface in the annulus below the packer (40B of FIGS. 4 and 5).

Using this placement method, any fluid or apparatus, such a cable, can be placed through an annular passageway of a flow diverting string or the annular passageway surrounding a flow diverting string via a parallel conduit within the annular space to facilitate sealing the annular space, bypassing an isolation device in a surrounding annular passageway, guiding a cable, sealing the parallel conduit after its use, or combinations thereof.

As the rate of dissolution of salt is controlled by the volume of water entering a dissolution zone and the resulting volume of brine leaving the zone, larger diameter conduits of a flow diverting string are more effective that smaller diameter conduits of a flow diverting string. However, since conventional apparatuses for the permanent sealing of annular spaces are not readily available, while hanging means are normally available, the placement method described above can allow sealing of larger annular spaces around a flow diverting string with cement, while fluids or apparatuses bypassing or passing through the sealing cement and/or hanging apparatus can create a fluid interface (3B of FIGS. 4 and 5) and/or monitor the level of the interface.

As demonstrated in FIGS. 4 to 63 and FIGS. 68 to 69, any configuration of chamber junctions and concentric conduit flow crossovers can be used with concentric parallel conduits to create a differential pressure bearing flow diverting string using isolation conduits, flow diverters or bore selectors, jointed conduits, valves, plugs and other flow devices, to place a cushion interface and to control or divert circulated flow to differing orientations and depths for forming and using a subterranean cavern in a salt deposit.

FIGS. 70 to 74 and FIGS. 75 to 77 depict alternative embodiments of apparatuses and methods usable for installing subsurface safety valve subassemblies (105 and 112 respectively) between a packer (40 of FIGS. 4 to 6 and FIGS. 59 to 63) and a valve tree, that is located at the surface to provide protection to people and the environment from gas or other substances stored within a subterranean cavern.

FIGS. 70 to 73, depict embodiments of a subsurface safety valve arrangement subassembly (105), that can be installed with the flow diverting string (70 of FIGS. 4 to 6 and FIGS. 78 to 92). A significant benefit of the depicted arrangement is the ability to use a small hoisting capacity rig, in conjunction with a lubricator arrangement, such as that shown in FIG. 3, to install and retrieve isolation conduits and to activate the subsurface safety valve arrangement, after solution mining and before storage operations, which provides a substantial savings in costs of operation and promotes a more safe practice by reducing hazardous risks.

Figures 70, 71, 72, 73:
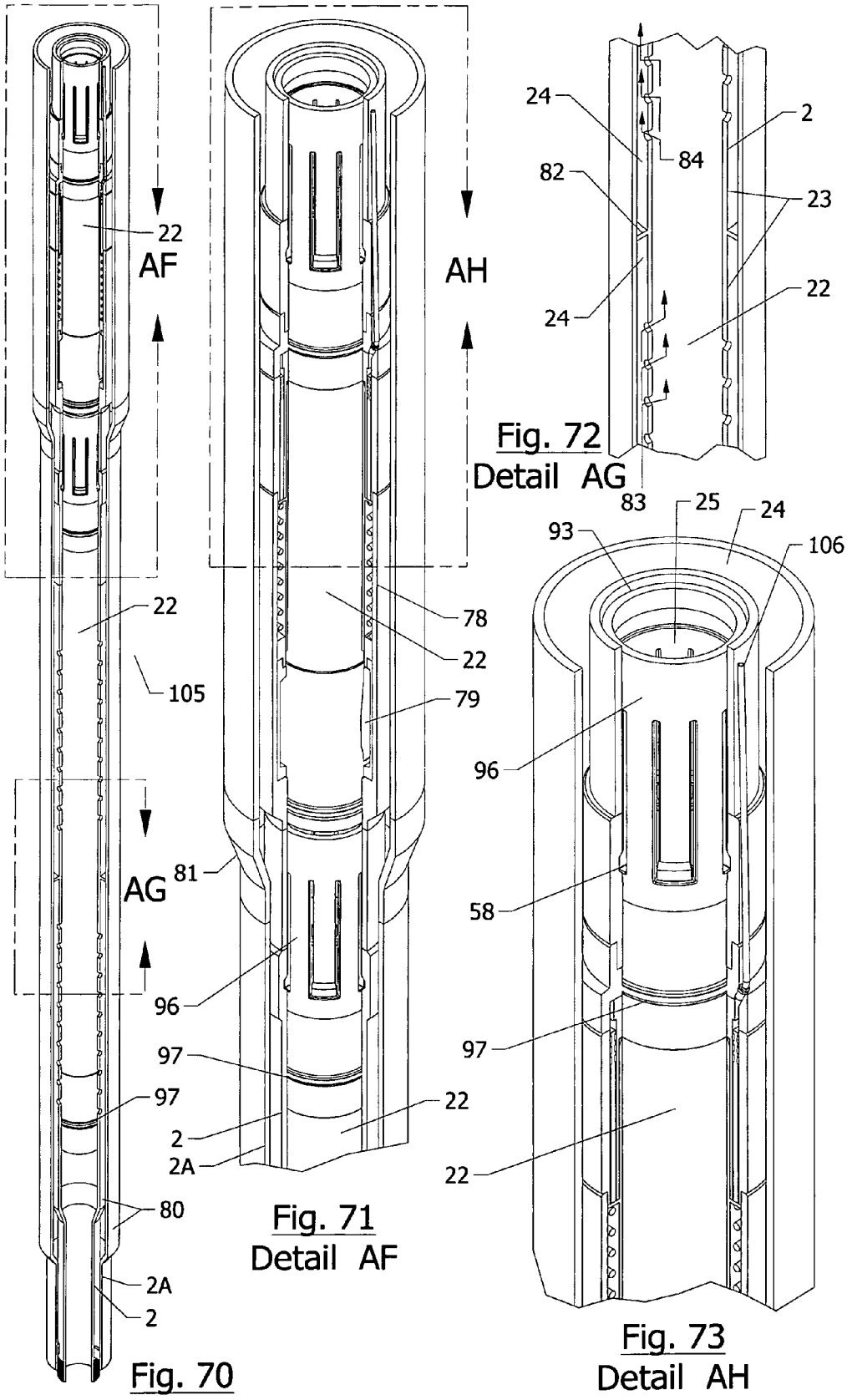
FIGS. 70-73 depict a preferred embodiment of an arrangement for installing a tubing retrievable subsurface safety valve isolated during solution mining operations with isolation conduits.

FIG. 70 depicts an isometric view, with a quarter section removed to show internal components of an embodiment of a valve arrangement (105). The valve arrangement (105) includes two inserted isolation conduits (22) for a subsurface safety valve (78 of FIG. 71), showing enlargements (80) of the inner (2) and outer (2A) leaching strings to accept the diameter of the subsurface safety valve.

The valve arrangement (105) can be enclosed within casing (3 of FIGS. 4 to 6), which is sized to enclose the valve arrangement, with the larger outside diameters of the conduits at the upper end potentially reducing back to the diameters of the lower end before engaging the wellhead of the valve tree (not shown).

FIG. 71 depicts a magnified isometric view on detail line A-F of FIG. 70, showing the inner (2) and outer (2A) leaching strings, enlarged further (81) to enclose the subsurface safety valve (78) with a flapper (79) closing mechanism. The upper isolation conduit (22) holds the closing mechanism open and prevents the inadvertent closing of the subsurface safety valve.

FIG. 73 depicts a magnified view of the valve arrangement of FIG. 71, taken on detail line A-H, showing a control line (106) for operating the safety valve (78 of FIG. 71). A snap-in mandrel (96), is engaged with a recess (58) to secure the isolation conduit (22) within the safety valve, with its bore forming the internal passageway when in place. The seals (97) prevent ingress of substances behind the isolation conduit, and a receptacle (93) is present for placing and retrieving the isolation conduit.

FIG. 72 depicts a magnified isometric view of the valve arrangement of FIG. 71, taken on detail line A-G of FIG. 70, showing an isolation conduit (22), with an outside diameter less than that of the inner leaching string (2) within the valve arrangement. FIG. 72 shows the outer annular passageway (24) with concentric conduit flow crossovers (23) above and below a blockage or barrier (82) against axial flow within the annular space. When the isolation conduit is in place, flow from the annular passageway flows past the barrier 82 (as indicated by arrow 83), between the isolation conduit and inner leaching string, and back (as indicated by arrow 84) into the outer annular passageway (24), after passing the barrier.

Seals at the upper end (97 of FIG. 71) and the lower end (97 of FIG. 70) prevent flow, between the isolation conduit (22) and inner leaching string (2), from entering the inner bore (25 of FIG. 73). The upper isolation conduit 22 of FIGS. 70, 71 and 73 protects the safety valve while the lower isolation conduit 22 of FIG. 70 creates an inner annulus passageway shown in FIG. 72.

This flow arrangement, for this single flow diverting string, is similar to that shown in FIGS. 95, 97, 99-102 and 104 for a multi-well arrangement. The longer isolation conduit (22), shown in FIG. 72, can be placed within the inner bore for sealing the upper concentric flow crossover to prevent flow from re-entering the outer annular passageway (24) above the blockage (82), and thus allow control of both the inner bore (25) and outer annular passageway (24), below the barrier 82 to be controlled by the safety valve (78 of FIG. 71).

FIG. 74 and FIGS. 75 to 77 depict embodiments of a subsurface safety valve arrangement subassembly (112), that can be installed with the flow diverting string (70 of FIGS. 4 to 6 and FIGS. 78 to 92) after solution mining and before storage operations. A large hoisting capacity jacking arrangement and crane or a large hoisting capacity rig can be used to remove the inner conduit string (107) of FIGS. 74 and 75 from the arrangement shown in FIG. 75, and to replace it with the valve and packer arrangement (108) of FIG. 76 to form the valve arrangement (112) of FIG. 77, controlling flow from both the inner bore (25) and outer annular passageway (24).

The inner mandrel arrangement (125), shown in FIG. 75, previously installed during solution mining, is removable so that the safety valve and packer arrangement (108), shown in FIG. 76 can be placed within the outer leaching string (2A) after the inner mandrel (125) has been removed, thereby converting the arrangement shown in FIG. 74 to the arrangement shown in FIG. 77. It will be noted that the arrangements of FIGS. 70-73 and 94-104 require only the lubricator arrangement of FIG. 3 to reconfigure them after solution mining whereas the arrangements of FIGS. 74-77 require a larger hoisting rig. The benefits are less cost for the arrangements of FIGS. 70-73 and 94 to 1040R more cost but less risk to the safety valve from solution mining in the arrangement of FIGS. 74-77.

Since the process of solution mining can take years, it often desirable to avoid exposing the subsurface safety valve (78) to the prolonged solution mining operations, as such valves are generally not designed for such exposure. In these instances, a mandrel arrangement (125) can be used during solution mining, then replaced with a packer and subsurface safety valve arrangement (108) after completing solution mining. Once the packer and safety valve have been placed, a retrievable conduit can be placed through the safety valve and engaged with the polished bore receptacle (110) to dew ater the cavern. After the dewatering is completed, the conduit can be removed using a small hoisting rig and lubricator to allow the safety valve to function and to avoid the hazardous conventional practice of snubbing a dewatering string from the well under pressure.

FIG. 74 depicts an isometric view, with a quarter section removed to show the internal components as associated with FIG. 77, of a dual conduit internal mandrel and receptacle arrangement (106). FIG. 74 shows the internal mandrel arrangement of FIG. 75 forming the upper portion of the inner leaching string (2), the mandrel being inserted and engaged (109) into a sealing receptacle (110) and forming the lower portion of the inner leaching string (2) within the outer leaching string (2A), which is enclosed by optional enlargements (80) to accommodate increases in diameters for installation of the safety valve and packer arrangement (108 of FIG. 76). The safety valve and packer arrangement can be inserted after removal of the internal mandrel arrangement (125).

The dual conduit internal mandrel and receptacle arrangement (106) facilitates solution mining of a cavern without exposing a subsurface safety valve to the solution mining process, which can take a number of years to complete. After the cavern is formed through the lengthy solution mining process, the internal mandrel arrangement (125) can be removed and a safety valve and packer arrangement (108 of FIG. 76) can be installed, after which the mandrel arrangement can be re-inserted through the safety valve for dewatering operations. Subsequently, the internal mandrel arrangement (125) can be removed to allow the valve to function during storage operations.

FIG. 75 depicts an isometric view, with a quarter section removed to show the internal components as associated with FIG. 74 of an internal mandrel arrangement (125), showing an engagement surface (109), and seal members (111) for engagement with a sealing receptacle (110 of FIGS. 74 and 74A), wherein a long inner leaching string (2) conduit section can be used, as shown in FIG. 74, or a shorter conduit section can be used, as shown in FIG. 74A.

FIG. 76 shows an isometric view, with a quarter section removed to show the internal components (utilized in FIG. 77) of a subsurface safety valve and packer arrangement (108), showing an inner leaching string (2) with a subsurface safety valve (78), having a closing member (79) and a receptacle for engagement of an isolation conduit to isolate the closing member. A control line (106) parallel to the inner leaching string (2) is provided to control the valve. In addition, a packer (40) can be included, having engagement slips (69) and a sealing element (69A) located below an enlargement conduit (80), wherein the packer can be engaged and differentially pressure sealed against an outer leaching string (2A of FIGS. 74 and 77) to allow the valve to control both the inner bore (25) and outer annular passageway (24).

FIG. 77 depicts an isometric view, with a quarter section removed to show the internal components (associated with FIGS. 74, 75 and 76 of a valve arrangement (112). The valve and packer arrangement (108) of FIG. 76 is placed and engaged within the outer leaching string (2A) of FIG. 74, with securing slips (69) and a sealing element (69A). The internal mandrel arrangement (125 of FIG. 74) has been removed to allow placement. Placement of the packer and safety valve arrangement (108) would generally occur after solution mining and before storage operations to remove the need to snub or strip the arrangements into the well, since it would be filled with brine prior to storage operations.

The outer leaching strings can be extended upward and connected to a safety valve (78), such as that shown in FIG. 74A. Optionally, enlargement (80 of FIG. 74A) or reduction of the diameter can occur between the safety valve (78) and the wellhead (7 of FIG. 1) or valve tree (15 of FIG. 3).

To facilitate removal using a lubricator arrangement, such as that in FIG. 3, a short isolation conduit, that is retrievable through the lubricator arrangement and engagable with the recess (58) and internal sealing receptacle (110), can be placed across the safety valve (78) during dewatering to re-establish continuity of the inner leaching string (2).

FIG. 74A depicts an isometric view with a quarter section removed to show the internal components of an internal mandrel arrangement (122), usable across a valve tree during dewatering operations. FIG. 74A, shows an internal mandrel arrangement (125) providing continuation of the inner leaching string (2), similar to that of FIG. 75, but spanning one or more valve trees. An engagement surface (109), with sealing members (111) axially below, is engaged with a sealing receptacle (110) within the outer leaching string (2A), having a hanger (123) at its upper end for engagement with a wellhead or production valve tree.

The hanger (123) at the upper end of the internal mandrel arrangement (125), used to continue the inner leaching string (2), engages with the dewatering tree and spans the valves of the production tree during the dewatering process. Thereafter, the internal mandrel arrangement can be removed through a lubricator arrangement, engaged to the top of the dewatering tree, to allow the removal in a pressure controlled manner. After removal of the internal mandrel arrangement (125), any mandrel arrangement across the subsurface safety valve as earlier described can be removed, the production tree valves and subsurface safety valves can be closed, and the dewatering tree can be removed.

The arrangement of FIG. 74A can be used above valve arrangements (105 of FIGS. 70 to 73 and 112 of FIG. 77) for gas and liquid storage where a safety valve is generally required, or above a production packer arrangement (71 of FIGS. 59 to 63) in cases where a safety valve is not required.

To summarize, FIGS. 74, 74A and 75, depict a placeable and removable internal mandrel arrangement (125), generally applicable during instances where the inner string must cross valves that can later be used, with the aim of performing installation and removal during periods where water or brine fill the well and cavern. A lubricator arrangement, similar to that of FIG. 3, can be used in cases where volatile subsurface conditions require pressure controlled placement and/or retrieval.

FIGS. 78 and 79 depict a plan view and a cross section on line AI-AI of FIG. 78, respectively, with dashed lines showing hidden surfaces. The Figures show a flow diverting string (70) usable for solution mining a cavern (26) in a salt deposit (5) by dissolving salt from the cavern wall (1A). The salt deposit is shown below other formations (6), and the creation of the cavern is shown during the initial stages of cavern creation. FIGS. 78 and 79 are associated with FIGS. 83 to 88 and, and FIG. 79 shows detail lines AJ, AK and AL associated with FIGS. 80, 81 and 82, respectively.

The embodied method comprises placing the flow diverting string (70) in a bore (3X) through salt (5). The flow diverting string can include a chamber junction subassembly (21 of FIG. 82) having a lateral opening (44 of FIG. 82) with a cap (21X of FIG. 82) across its lower end to prevent water exiting through the outer annular passageway. A combined chamber junction crossover assembly (51 of FIG. 81) can be incorporated in the flow diverting string above the chamber junction (21 of FIG. 82), and can have a flow diverter installed to divert water, that is pumped down the outer annular passageway (24 of FIG. 4), across the inner bore (25) to exit the lateral opening (44) of the lower chamber junction subassembly (21 of FIG. 82) lateral opening. Brine can enter the lateral opening (44 of FIG. 81) of the combined chamber junction crossover subassembly (51 of FIG. 81) and pass through the flow diverter (as indicated by arrow 32) and flow axially upward through the inner bore (25), where it can be disposed of or processed for its salt content. As the lower end of the lower chamber junction subassembly is still within the bore through salt (3X of FIG. 82), it can become secured in the orientation of the bore, generally specified to be vertical, through salt, as insoluble substances fall from the brine and become deposited between the bore and the lower end of the flow diverting string (70).

Anchoring of the lower end of a flow diverting string into a vertical orientation reduces the probability of flow induced vibration, especially if chamber junction subassemblies and combined chamber junction crossover subassemblies have a plurality of exits to minimize lateral forces of jetting. Also, as caverns form, heavier insolubles can fall from the sidewall (1A of FIG. 82) and centralizing of the flow diverting strings can reduce the risk of impact from such falling debris.

Finally, anchoring the flow diverting string to the floor of a cavern reduces the induced loading on the string during dewatering. This is a great improvement over conventional methods which often produce failures during the final stages of dewatering when the dewatering string can begin to jet itself across an uneven cavern floor, or move laterally, as the result of whirlpool like effect from injected gas trying to push its way past brine in the final stages of dewatering.

FIGS. 80, 81 and 82 depict magnified views of detail lines AJ, AK and AL, respectively, which show the flow diverting string (70) of FIG. 78, with a configuration similar to that shown in FIG. 4.

FIG. 80, shows the upper chamber junction subassembly (21) within a bore (3X) through the salt deposit (5), with the lateral opening (44) covered by an isolation conduit (not shown) to prevent communication with the outermost annulus space between the flow diverting string (70) and the bore (3X). The annulus space can be filled with a gas or liquid cushion to prevent water from dissolving salt within the zone of FIG. 80.

FIG. 81 shows the lower combined chamber junction crossover subassembly (51) within a bore in the salt deposit (5). A flow diverter lateral opening (44) allows brine flow (32) into the inner bore (25 of FIG. 4) while water flowing down the outer annular passageway (24 of FIG. 4) is forced to cross over to the inner bore (25) at the concentric conduit flow crossover (23) by the cap (21X of FIG. 82) at the lower end of its outer annular passageway. Water is prevented from travelling upward in the outermost annular space between the bore (3X) and flow diverting string (70) by the cushion or blanket interface (3B).

FIG. 82 shows the lower end of the flow diverting string (70) injecting (31) water through a lateral opening (44) in a chamber junction subassembly (21) to a dissolution zone to dissolve a salt deposit (5) until it forms a cavern (1) storage space or volume (26). The cavern walls (1A) continue to dissolve with water contact to form brine, which enters at an upper chamber junction subassembly (21 of FIG. 81).

Insoluble substances, encased in the salt (5), fall to the cavern bottom and settle between the lower end of the flow diverting string (70) and the bore (3X), securing the flow diverting string to the floor of the cavern.

FIGS. 83, 85 and 87 are plan views with dashed lines showing hidden surfaces with section lines AM-AM, AN-AN and AO-AO respectively, while FIGS. 84, 86 and 88 show elevation cross sectional views on lines AM-AM, AN-AN and AO-AO, respectively. The figures illustrate subsequent stages of solution mining (1) and dewatering of the cavern volume or space (26) of the associated FIGS. 78 and 79 by dissolution of the salt wall (1A). The detail lines AJ, AK and AL of FIG. 79 and associated with FIGS. 80, 81 and 82, respectively, provide magnified views of the lateral openings (44 of FIGS. 80 to 82) of the flow diverting string (70).

FIGS. 83 to 88, illustrate an embodiment of a flow diverting string (70) anchored to the cavern bottom for creating a cavern volume (26), by dissolving salt walls (1A), and allowing insoluble substances to engage the lower end of the flow diverting string (70). This reduces the vortex-induced movement of the flow diverting string and reduces the probability of impact from insoluble debris falling from the sidewall during solution mining.

Engaging or anchoring the flow diverting string (70) resists harmonic and/or vortex shedding forces associated with flow velocities acting against the string and associated with movement of the string during solution mining, dewatering and storage operations. Use of a plurality of lateral openings about the circumference, at the same axial depth of a flow diverting string in the chamber junction and the combined chamber junction crossover assemblies, can be advantageous to reduce bending, that is due to lateral loads arising from jetting from the lateral opening.

The flow diverting string (70) can have any combination and number of chamber junction subassemblies (21), concentric conduits flow crossover subassemblies (23), and combined chamber junction crossover subassemblies (51) to circulate in water against a bore and/or cavern wall (1A) in a salt deposit (5) for forming a cavern space or volume (26).

FIGS. 83 and 84 show a later stage of the solution mining operation shown in FIGS. 78 to 82. The circulation direction shown in FIGS. 81 and 82 has been reversed so that water exits (33) the lower chamber junction crossover subassembly (51) at its lateral opening below the cushion interface (3B), preventing upward movement of the water, and brine is taken (32) into the lower lateral opening of the lower chamber junction subassembly (21) internal passageway until it crosses over at the chamber junction crossover subassembly to the annular passageway, between the inner and outer conduit strings (2, 2A, respectively of FIG. 5) and below the associated flow diverter within the chamber junction crossover subassembly.

FIGS. 85 and 86 show a later stage of the solution mining operation shown in FIGS. 83 to 84. The circulation pathway of FIG. 86 has been changed so that water exits (33) the lateral opening of the upper chamber junction subassembly (21) below the cushion interface (3B), preventing upward movement of the water, and brine is taken (32) into the lateral opening of the combined chamber junction crossover assembly (51) of the flow diverting string (70).

FIGS. 87 and 88 show a later stage, namely a dewatering process, occurring after the solution mining operations shown in FIGS. 85 and 86. The circulation pathway of FIG. 87 has been changed for the dewatering process, with stored substances, such as air, non-aqueous liquid, or gas injected into the inner bore (25 of FIG. 6) of the flow diverting string from the surface and exiting (33) the flow diverting string (70) at the lateral opening (44 of FIG. 80) of the upper chamber junction subassembly (21) above the brine interface level (3C) in the cavern, so that brine is forced (32) through the lateral opening (44) of the lower chamber junction subassembly (21). Then, the brine crosses over at the concentric conduit flow crossover (23) or is forced into new perforations (38) in the flow diverting string to enter the annular passageway, between inner and outer conduit strings (2, 2A, respectively), through new perforations or by any other means above the level of insoluble substances against the lower end of the flow diverting string (70), if the insoluble substances are impermeable, or below the level of insoluble substances if the substances are permeable, thus forming a suction sump to drain brine from the cavern. This embodiment of a dewatering arrangement is similar to that of FIG. 6, in which the stored substances flow through the inner passageway (25 of FIG. 6) to the lateral opening (44 of FIG. 80) of the upper chamber junction (21) where a flow diverter is installed, and brine enters either the lateral opening (44 of FIG. 82) of the lower chamber junction, flowing to a crossover of the combined chamber junction cross over subassembly (51) where it crosses over and flows up the outer annular passageway, or if the lateral opening is covered with an isolation sleeve (22 of FIG. 6), brine flows through perforations (38) in the flow diverting string (70) to flow up the outer annular passageway.

In gas operations, the level of brine left in the bottom of the cavern space (26) can reduce the effectiveness of gas storage, as hot compressed gas is injected into the cavern causing condensation of water on the walls (1A) of the cavern. This can, in turn, cause hydrates when the gas is decompressed during retrieval from the cavern space (26). Lowering the level of brine, left in the cavern before gas operations begin, reduces the time period of drying the cavern and the associated risk of hydrates.

Embodiments of the present invention allow the logging of the floor of the cavern to determine the level of insoluble substances on the floor of the cavern, after which perforations can be placed within the flow diverting string to minimize the level of brine left in the cavern before gas operations begin. If it can be determined that the insoluble substances are permeable and capable of sustaining the flow of brine through their volume, perforations can be placed below the insoluble level in the cavern to create a suction sump capable of removing the majority of brine from the cavern, thus providing the benefit of reducing the time necessary to dry the cavern and lowering the risk of forming hydrates when hydrocarbons are stored within the cavern.

By securing the end of the flow diverting string, and using perforating guns conveyed through the internal passageway (25 of FIG. 6) to perforate through both the inner (2 of FIG. 6) and outer (2A of FIG. 6) strings, at the desired level above the cavern floor, the resulting level of brine remaining in the cavern at the end of dewatering, and prior to the start of gas operations, will be generally lower than that of conventional methods using an unsecured dewatering string that can move about the cavern during the last stages of dewatering. This adds value to gas storage operations by reducing the time period during which hydrates and water condensation on the walls of the cavern are an issue, as a result of reducing the amount of brine left in the cavern. An additional benefit of the described method for securing the upper and lower ends of the flow diverting string is an increase in the speed at which all dewatering operations can occur as the result of reducing the probability of string failures associated with the uncontrolled movement of an unsecured dewatering string during dewatering, as is often encountered with conventional methods FIG. 88A depicts a diagrammatic cross sectional view of a flow diverting string usable in a solution mining operation involving removal of solution mining anomalies (1X).

An intermediate concentric conduit flow crossover subassembly (23) is depicted between upper and lower chamber junction subassemblies (21). The Figure includes a concentric conduits flow crossover (23) at the lower end of the subassemblies (21). The outer conduit string is reduced until it merges (80) with the inner conduit string, which continues downward to a perforated joint (23A). The joint (23A) is secured to the cavern bottom by insoluble substances (1B) on the cavern floor.

Prior to encountering the anomaly (1X), the solution mining process includes circulating water downward through the internal conduit passageway to the lateral opening (44) of the lower chamber junction subassembly (21) and into the cavern, and flow of brine back through the perforated joint (23A) and lower flow crossover (23) up the outer annular passageway (24), where it is discharged at the surface.

In the example shown in FIG. 88A, a pot ash zone, which preferentially leached outward, was encountered below the cushion level, allowing the cushion level to rise until the anomaly (IX) was formed and solution mining was stopped.

After measuring the anomaly (1X) with a tool, such as a sonar device, to determine the level at which a new lateral opening is needed, an isolation conduit can be placed across the lateral opening of the lower chamber junction (21) and across the intermediate concentric conduit flow crossover (23). A bore (44X) is then formed through the flow diverting string above the anomaly (1X), by cable rotary systems or other apparatuses, such as bits turned by motors and coiled tubing placed through the internal passageway (25).

If the bore (44X) through the inner and outer conduit strings is created with a through tubing cable rotary system return, fluids are pumped through the internal passageway (25) with returns through crossovers within the flow diverting string to the outer annular passageway (24).

Once the bore (44X) is completed, a new chamber junction subassembly (21X) exit bore conduit (39X) conduit can be secured within the inner conduit extending through the new bore (44X), as shown in FIG. 88A, to allow passage of tools for sonar measurement to ensure the anomaly (1X) is not growing during subsequent solution mining.

Circulation could begin through the extended conduit. Alternatively, the exit bore conduit (39X) extending outward from the flow diverting string (70) can be omitted and circulation can occur from the upper lateral opening (33), returning (34) through the new lateral opening (44X) at the bore (21X), and rising through the internal conduit passageway until it crosses over at the upper concentric conduit flow crossover (23).

After solution mining the cavern above the anomaly (1X), the exit bore conduit extension through the new lateral opening (44X) can be removed, if present, and an isolation conduit or a conventional straddle can be placed across the internal conduit string at the bore (44X) to reinstate pressure bearing integrity for dewatering of the cavern.

As demonstrated in the above description, a through tubing cable rotary system or conventional wireline, slickline and/or coiled tubing can be used to maintain, repair, reconfigure and modify a flow diverting string (70 of FIGS. 4 to 6, FIG. 12, FIG. 30C and FIGS. 78 to 92) into any dual conduit configuration needed, without removal of the flow diverting string, to form or use a subterranean cavern in a salt deposit.

FIG. 89 depicts an isometric view of an embodiment of combined production, solution mining, storage, separation and/or processing operations arrangement (76), comprising a junction of wells (51A), disclosed in U.S. patent application Ser. No. 12/587,360, with concentric exit bores (39) diverging to a production well (114) and a plurality of solution mined storage wells through subterranean strata (6) into a salt deposit (5). Flow diverting strings (70) with annulus isolation packers (71) are usable to solution mine caverns with water or produced water, perform storage operations, separate produced components and/or process production within cavern volumes (26).

In instances where water for solution mining is limited, the production well (114) can comprise a water well used to supply water directly to the solution mining process.

In instances where the production is a hydrocarbon bearing well that also produces water, the production can be routed through the chamber junction manifold of the junction of wells (51) to the solution mining process, where hydrocarbons are allowed to separate from produced water that is floating to the top of the cavern and forming a natural cushion or blanket, from which gases can further separate from liquid hydrocarbons for creating a subterranean processing plant. The flow diverting string can be used to produce gas, condensates, and/or oil intermittently, before emptying brine from the bottom of the cavern and refilling it with hydrocarbon production.

Using the above chamber junctions, any configuration and arrangement of flow control devices can be used to create a subterranean processing facility that would minimize required surface facilities to provide a more cost effective and safer production operation, where sufficient quantities of salt were present.

As hydrocarbons are often found adjacent to salt diapers, walls and domes, embodiments of the present invention, in combination with embodiments disclosed in U.S. patent application Ser. No. 12/587,360 and GB Patent Application Serial No. 0911672.4 can provide significant benefits in the form of subterranean processing facilities.

Placing multiple production and/or storage wells under a single valve tree, as earlier explained, provides advantages that include reducing surface equipment and reducing the number of rig movements to construct and the equivalent number of the wells to create.

FIGS. 90, 91 and 92 depict a plan view, a sectional elevation view of line AP-AP, and a sectional isometric view on line AP-AP, respectively, showing a junction of wells (51A) with concentric additional exit bores (39) diverging to a plurality of solution mined storage well bores through subterranean strata (6) into a salt deposit (5). The well bores are shown laterally spaced, enabling subsequent solution mining with a plurality of flow diverting strings (70), having a plurality of lateral openings, to create a single cavern space or volume (26) having a wall (1A) potentially shaped like a cloverleaf, as shown in FIG. 90.

Placing a plurality of wells into a single cavern increases the initial speed of solution mining by reducing the flow frictions, to increase the circulated volume, and by increasing the wall (1A) contact area with water.

Also, the risk of damaging a flow diverting string (70) from large falling insoluble objects or rocks trapped within the salt is partially mitigated by having additional or redundant strings for dewatering and subsequent storage operations.

The energy consumption of pumps used during the solution mining or leaching process can be reduced and/or the solution mining time reduced by increasing the effective circulating area and decreasing the associated pumping frictional factors with a plurality of wells.

Finally, the rates of injection and extraction from storage can be increased with the larger effective diameters of a plurality of well bores into a storage cavern.

Referring now to FIG. 93, and FIGS. 94 to 97, the Figures depict embodiments of a chamber junction manifold of a junction of wells (51A), while FIGS. 98 to 104 depict a flow diverting string with two flow configurations, respectively, that are usable above the well configurations of FIGS. 89 to 92 for controlling a plurality of wells with subsurface safety valves. This is similar to the embodiment shown in FIGS. 70 to 73. A flow diverting string (70) can be engaged at the lower end of each additional exit bore (39) to control the circulating passageways of the plurality of wells. FIGS. 94 to 97 show configurations for solution mining and dewatering operations, while FIGS. 98 to 104 show configurations for storage operations.

The chamber junction manifold of a junction of wells (51A) comprises concentric chamber junctions (43) and concentric additional exit bores (39) engaged (44) to concentric chambers (41) and chamber bottoms (42). The external chamber junction (43) comprises the outer leaching string (2A), and the inner chamber junction (43) comprises the inner leaching string (2). The lower ends of the chamber junction exit bores are engagable with the upper end of flow diverting strings.

Three concentric conduit flow crossovers (23C) are engaged axially below the concentric additional exit bores (39) and contain a flow control device (78), shown as a wireline insertable, and a retrievable flapper (79) type subsurface safety valve capable of blocking the internal bore, with isolation conduits (22) installed.

A concentric conduit enlargement (81) is located axially below the three concentric conduits flow crossover (23C) to increase the effective flow across sectional areas of the flow control device (78) and to reduce frictional forces, when diverting both the inner bore (25) and the outer annular passageway (24) through the flow control device, using the concentric conduit flow crossover.

Flow control devices can be of any form, including, but not limited to, valves, chokes, plugs, packers, or other devices for controlling the flow of liquids or gases, and the devices can be inserted through the arrangement for engagement with a flow diverting string engaged axially below.

The chamber junction manifold of the junction of wells (51A) can include concentric chamber junctions (43), concentric conduits flow crossovers (23C), and concentric conduit enlargements (81), further comprising an inner (2) and outer (2A) leaching string to a plurality of wells engaged with the lower end of the concentric conduit enlargements.

Figure 94:
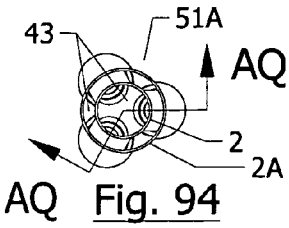
FIGS. 93-97 depict embodiments of chamber junction manifolds of a junction of wells with inserted valves and a concentric conduit flow crossovers and isolation conduits arrangement for solution mining and dewatering.
Figure 93:
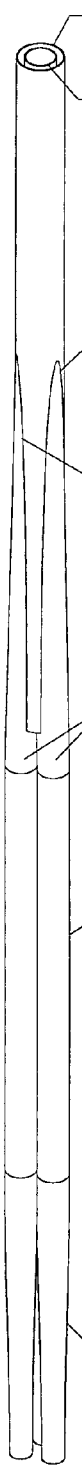

FIGS. 93 and 94 depict an isometric and plan view respectively, of an embodiment of a chamber junction manifold junction of wells (51A).

Figure 95:
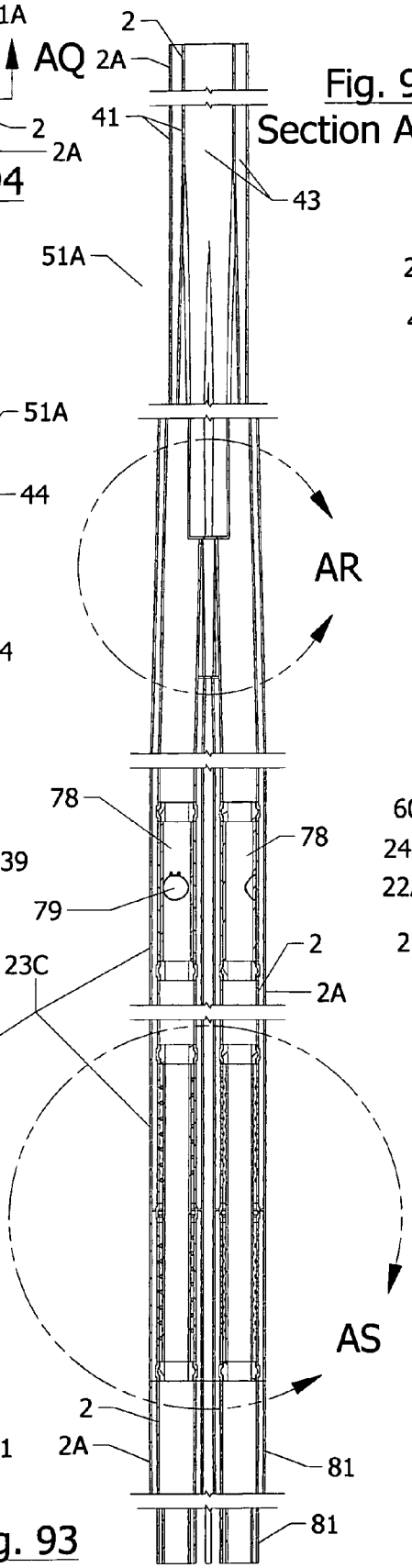

FIG. 95 depicts a sectional elevation view on line AQ-AQ of FIG. 94, with break lines removing portions of the chamber junction manifold junction of wells (51A) of FIG. 94.

Figure 96:
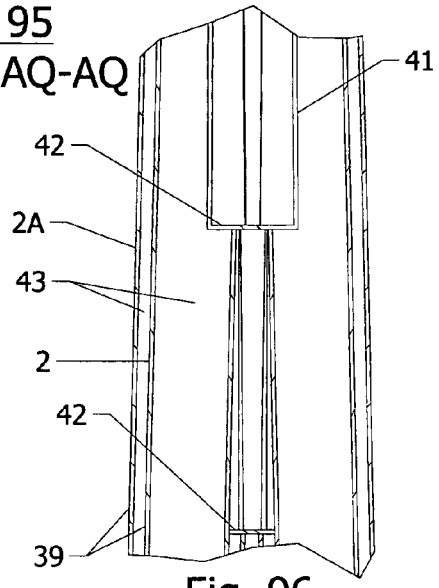

FIG. 96 depicts a magnified view on detail line AR of FIG. 95, illustrating the chamber junction manifold junction of wells (51A), of FIG. 95, and showing the arrangement of chamber bottoms (42) within concentric chamber junctions (43).

Figure 97:
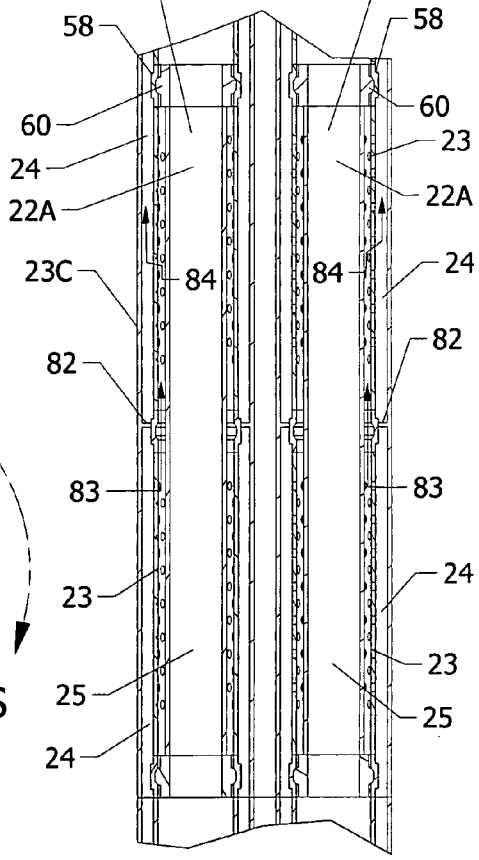

FIG. 97 depicts a magnified view on detail line AS of FIG. 95, showing the chamber junction manifold junction of wells (51A), of FIG. 95, configured for leaching and dewatering operations. Long isolation conduits (22A) are shown engaged within upper and lower concentric conduits flow crossovers (23). In FIG. 97, the flow within the outer annular passageway (24) passes through (83) the lower concentric conduit flow crossover (23) and past the blocked (82) annular passageway, and exits (84) through the upper concentric conduit flow crossover (23) above the blockage (82). Then, the flow passes back into the outer annular passageway, while flow through the internal passageway continues through the bore of the isolation conduit, which is shown engaged at distal ends by mandrels (60) in recesses (58).

Figures 98, 99, 100, 101, 102, 103, 104:
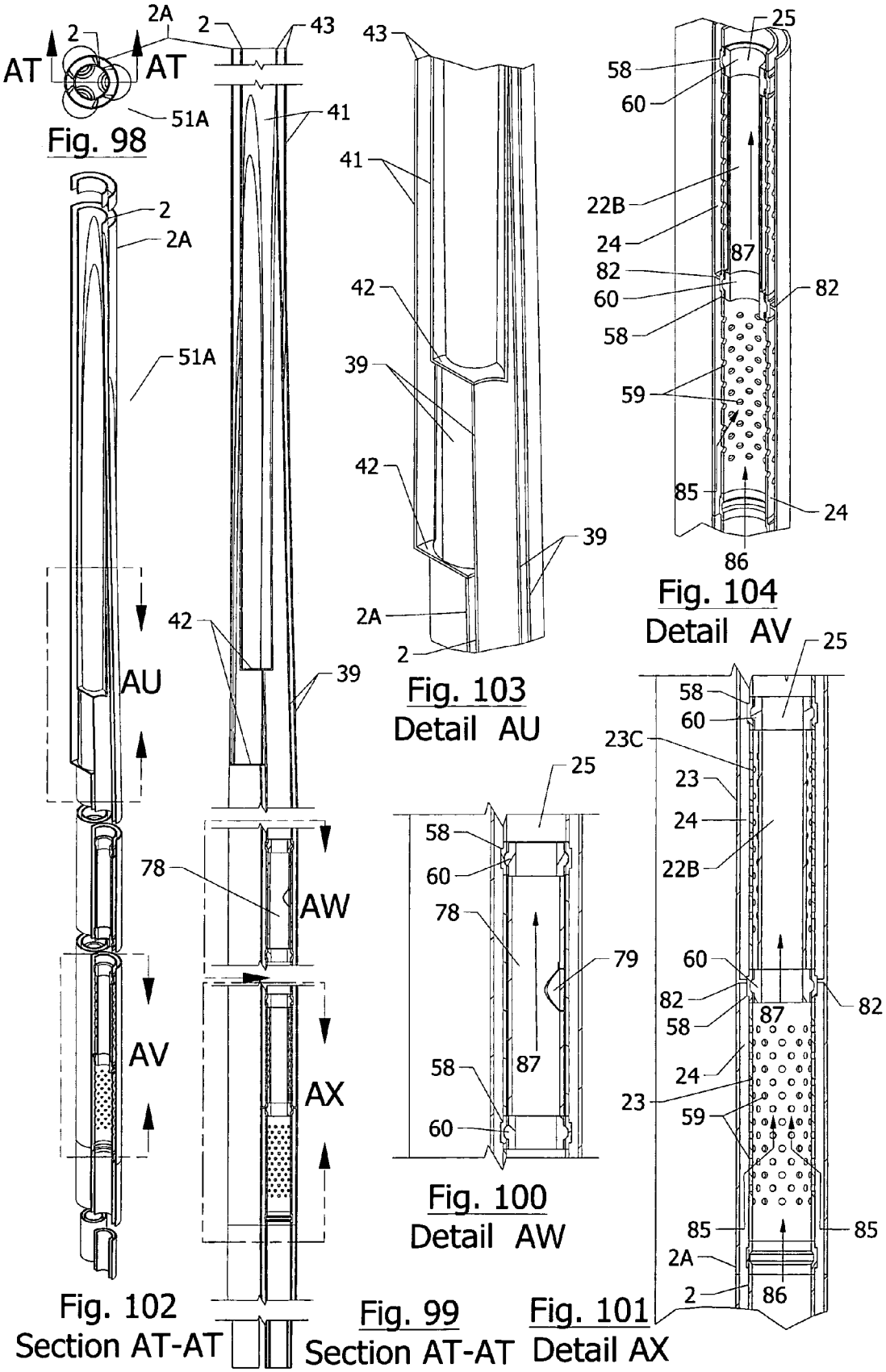
FIGS. 98-104 depict the junction of wells and associated chamber junction manifold of FIGS. 94 to 97 with inserted valves and concentric conduit flow crossovers and isolation conduits arrangement for gas storage operations.

FIG. 98 depicts a plan view of the chamber junction manifold junction of wells (51A) of FIG. 94.

FIG. 99 depicts a cross-sectional view on line AT-AT of FIG. 98 with portions of the illustration removed by break lines, showing the chamber junction manifold junction of wells (51A) of FIG. 98.

FIG. 100 depicts a magnified view on detail line AW-AW of FIG. 99, which shows a flow control device (78), with a flapper (79) type valve. The flow control device can be placed and retrieved with wireline and can be engaged at its distal end with mandrels 60 within recesses (58), and enables combined flow (87) from the inner bore (25) and outer annular passageway (24 of FIG. 101) below the annulus passageway block (82 of FIG. 101).

FIG. 101 depicts a magnified view on detail line AX of FIG. 99, showing a short isolation conduit (22B) engaged between recesses (58), with mandrels (60) isolating the orifices (59) of the upper concentric conduit flow crossover (23) above the annulus block (82). The flow (85) in the outer annular passageway (24) below the annulus block mixes with flow (86) from the inner bore (25) into a combined flow (87), which can be controlled by a flow control device (78 of FIG. 100) above the crossover.

FIG. 102 depicts an isometric cross sectional view on line AT-AT of FIG. 98, showing the chamber junction manifold.

FIG. 103 depicts a magnified view on detail line AU of FIG. 102, showing concentric chamber junctions (43) having chamber walls (41), chamber bottoms (42), and additional exit bores (39), comprising inner (2) and outer (2A) leaching strings. The annulus space between chambers can be isolated by the arrangement shown in FIGS. 101 and 104 during storage operations, through use of a flow control device (78 of FIG. 100).

FIG. 104 depicts a magnified view taken on detail line AV of FIG. 102, showing the combined flow (87) from the flow (85) from the outer annular passageway (24), that is prevented from re-entering the annular space by the isolation conduit (22B) and the annulus block (82) combined with the flow (86) from the inner bore (25).

As demonstrated in FIGS. 4-104, and in the preceding depicted and described embodiments, any combination and configuration of chamber junctions having lateral openings, and other communicating conduits, and concentric conduit flow crossovers can be used to construct flow diverting strings arranged in series, and/or in parallel, to accommodate any desired well bore orientation. Any configuration of dual conduit string with lateral openings can be made accessible and/or isolated using one or more corresponding flow diverters, valves, isolation plugs and/or isolation conduits to more effectively solution mine and operate a storage cavern in a salt deposit, using the flow diverting string and/or associated junction of wells; and thus, allowing operation of a plurality of production wells, a plurality of single cavern wells, a plurality of well bores to a single cavern, or combinations thereof, under a single valve tree.

Multi-well embodiments of the present system can be installed by urging a subterranean bore into subterranean strata and, then, placing the lower end of a chamber junction at the lower end of the subterranean bore. A conduit can be placed within the bore, its lower end connected to the upper end of the chamber junction. Sequentially, a series of additional subterranean bores can then be urged through one or more additional orifice conduits of the chamber junction, such as by performing drilling operations through the chamber junction and associated conduits. The upper ends of the conduits, that extend within the additional subterranean bores, can be secured to the lower ends of the additional orifice conduits. To sequentially access each additional orifice conduit when urging or interacting with additional subterranean bores extending to similar depths through similar geologic conditions, a bore selection tool, as described previously, can be inserted into the chamber junction to isolate one or more of the additional orifice conduits from one or more other additional orifice conduits, while facilitating access through the desired additional orifice for interacting with, urging axially downward and/or placing conduits or other apparatuses within the bores of the accessed well.

The drilling, completion, or intervention of a series of subterranean bores in this batch or sequential manner provides the benefit of accelerating the application of knowledge gained before it becomes lost or degraded through conventional record keeping methods or replacement of personnel, as each of the series of bores will pass through the same relative geologic conditions of depth, formation, pressure, and temperature within a relatively condensed period of time, as compared to conventional methods, thus allowing each subsequent bore to be drilled, completed, or otherwise interacted with more efficiently.

In preferred single and multi-well embodiments of the present invention, after reaching the desired salt deposit for solution mining and subsequent storage operations, a flow diverting string is installed at the lower end of the bore.

Solution mining of the salt deposit by circulating water and retrieving dissolved salt in the form of brine creates a cavern volume or space for subsequent subterranean storage substances. In multi-well applications, water and cushion hydrocarbon liquids or gases can come from a producing well that is engaged to solution mined storage wells through a junction of wells of the present inventor.

Space created during solution mining, using produced fluids from a hydrocarbon well, can be used as a storage, processing and separation space for the producing well, thus reducing the quantity of surface equipment.

The same flow diverting string used for solution mining can be used for dewatering and gas operations, without being removed from the well bore or storage space, thus reducing the number of operations necessary to create a subterranean storage space.

The process of solution mining and storage operations can be enhanced by placing more than one well in a single storage space or cavern, with solution mining continuing until spaces created by dissolution of salt merge into a single cavern.

Embodiments of the present invention thereby provide systems and methods that enable any configuration or orientation of one or more producing, solution mined and/or storage wells, within a region, to be operated through a single main bore, using one or more chamber junctions with associated conduits. A minimum of above-ground equipment is thereby required to selectively operate any number and any type of wells, independently or simultaneously, and various embodiments of the present systems and methods are usable within near surface subterranean strata.

While various embodiments of the present invention have been described with emphasis, it should be understood that within the scope of the appended claims, the present invention might be practiced other than as specifically described herein.

Reference numerals have been incorporated in the claims purely to assist understanding during prosecution.

What is claimed is:

1. A flow diverting conduit string for injecting fluid into or extracting fluid from a subterranean borehole in salt or a subterranean salt cavern, said conduit string comprising:

an inner conduit string disposed within an outer conduit string, with an inner passageway within said inner conduit string and a first annular passageway between said inner and outer conduit strings, wherein said conduit string comprises at least one lateral opening in said inner or outer conduit string, said at least one lateral opening communicating with at least one of said passageways and with said borehole or cavern, and a flow control apparatus arranged to control flow of said fluid between or along said passageways to enable said conduit string to be used for storage and extraction of gases, hydrocarbon liquids, or combinations thereof, in and from said cavern and at least one of solution mining operations, subterranean hydrocarbon separation and dewatering operations;

wherein said flow diverting conduit string uses a subsurface valve arrangement formed with said flow control apparatus that isolates opposing fluid flows within or about said flow diverting conduit string for controlling fluid flows during said solution mining operations, subterranean hydrocarbon separation and dewatering operations; and wherein said flow control apparatus is removable or replaceable from within said inner passageway to bring said subsurface valve arrangement of said flow diverting conduit string into communication with said fluid flows of said solution mining operations, subterranean hydrocarbon separation and dewatering operations.

2. The flow diverting conduit string according to claim 1, wherein said at least one lateral opening is formed in said outer conduit string and is usable during solution mining to direct a flow of water to or receive a flow of brine from a dissolution zone in said subterranean borehole or salt cavern.

3. The flow diverting conduit string according to claim 2, wherein a flow diverter is disposed in said inner passageway of said inner conduit string and has a bore communicating between said inner passageway and said at least one lateral opening, said flow diverter allowing flow past said flow diverter through said first annular passageway.

4. The flow diverting conduit string according to claim 3, wherein an exit conduit extension projects into said borehole or said cavern through said bore of said flow diverter and a cable carrying tools for deployment in said borehole or cavern extends through said exit conduit extension.

5. The flow diverting conduit string according to claim 3, wherein at least one further opening is formed in the wall of said inner conduit string below said flow diverter to allow flow of fluid to cross over between said inner passageway and first annular passageway.

6. The flow diverting conduit string according to claim 2, wherein a removable plug is disposed in said inner passageway of said inner conduit string, said plug allowing flow past said plug through said first annular passageway.

7. The flow diverting conduit string according to claim 2, wherein upper and lower flow diverters, plugs, or combinations thereof, are disposed within said inner passageway, each plug blocking said inner passageway and each flow diverter having a bore communicating with said inner passageway and terminating in a respective lateral opening, at least one further opening being formed in the wall of said inner conduit string between said upper and lower flow diverters, plugs, or combinations thereof to allow flow to or from the lower flow diverter or to or from a lateral opening of the inner passageway blocked by a lower plug to cross over between the inner passageway and the first annular passageways.

8. The flow diverting conduit string according to claim 2, comprising a plurality of lateral openings provided at different subterranean depths within said bore or cavern in said inner conduit string, said plurality of lateral openings being selectively openable and closable to vary the disposition of the dissolution zone.

9. The flow diverting conduit string according to claim 8, comprising at least one isolation conduit, said isolation conduit being placeable from the inner passageway of said flow diverting conduit string and being movable in an axial direction to open or close a lateral opening, open or close said at least one further lateral opening, bridge a discontinuous section of said inner passageway, or combinations thereof.

10. The flow diverting conduit string according to claim 1, further comprising an isolation subassembly at an upper end thereof for engaging a casing, said isolation subassembly comprising:

an annular isolation device that defines a second annular passageway around said outer conduit string below said annular isolation device; and a flow control apparatus including a bypass passageway which communicates with said second annular passageway and enables fluid to be injected through said bypass passageway into said second annular passageway to control a water level in said subterranean borehole or salt cavern whereby said water level can be varied during a solution mining operation.

11. The flow diverting conduit string according to claim 10, wherein said bypass passageway is disposed within said first annular passageway and communicates between orifices in said inner and outer conduit strings and said control apparatus is accessible from said inner passageway for controlling flow through said bypass passageway.

12. The flow diverting conduit string according to claim 1, wherein said flow control apparatus is movable and forms a protective member comprising a conduit which is removably located in a differential pressure bearing sealing arrangement within said inner passageway or within an exit bore communicating therewith.

13. The flow diverting conduit string according to claim 12, wherein said conduit is removably located in a sealing arrangement by at least one engagement mandrel engaging an end of said conduit and providing a differentially pressure bearing continuation of said inner conduit string or exit bore.

14. The flow diverting conduit string according to claim 1, wherein a third inner conduit is disposed within said inner conduit string or between said inner conduit string and said outer conduit string and defines a third annular passageway between said third inner conduit and said inner conduit string or between said inner conduit string and said outer conduit string.

15. The flow diverting conduit string according to claim 1, wherein the flow diverting conduit string is formed from sections each comprising:

a) an inner conduit string section having threaded ends for screwing to complementary threaded ends of adjacent inner conduit string sections, and b) an outer conduit string section having ends which abut adjacent outer conduit string ends when the inner conduit string section is screwed to its adjacent inner conduit string ends, wherein the inner conduit string ends being screwed together and the abutting outer conduit string ends being welded together.

16. The flow diverting conduit string according to claim 1, wherein the flow diverting conduit string is formed from sections each comprising:

a) an outer conduit string section having threaded or snap fitting ends for engagement to complementary threaded or snap fitting ends of adjacent outer conduit string sections, and b) an inner conduit string section having mandrel ends which are resiliently sealed to adjacent inner conduit string receptacle ends when the outer conduit string mandrel section is snapped or screwed to its adjacent outer conduit string ends.

17. The flow diverting conduit string according to claim 1, further comprising a further conduit string communicating with and branching from said at least one lateral opening of said flow diverting string, said further conduit string having at least one downhole opening locatable in a production zone or dissolution zone associated with said borehole and comprising an inner conduit string disposed within an outer conduit string, with an inner passageway in said inner conduit string being disposed within a first annular passageway between said inner and outer conduit strings thereof.

18. A flow diverting conduit string for injecting fluid into or extracting fluid from a subterranean borehole in salt or a subterranean salt cavern, said flow diverting conduit string comprising:

an inner conduit string disposed within an outer conduit string, with an inner passageway within said inner conduit string and a first annular passageway between said inner and said outer conduit strings, wherein said flow diverting conduit string comprises at least one lateral opening in said inner or outer conduit string, said at least one lateral opening communicating with at least one of said passageways and with said borehole or cavern, and a flow control apparatus arranged to control flow of said fluid between or along said passageways to enable said flow diverting conduit string to be used for storage and extraction of gases, hydrocarbon liquids, or combinations thereof, in and from said cavern and at least one of solution mining operations, subterranean hydrocarbon separation and dewatering operations; and an isolation subassembly at an upper end of said flow diverting conduit string for engaging a casing, said isolation subassembly comprising:

an annular isolation device that defines a second annular passageway around said outer conduit string below said annular isolation device, and a flow control apparatus including a bypass passageway which communicates with said second annular passageway and enables fluid to be injected through said bypass passageway into said second annular passageway to control a water level in said subterranean borehole or salt cavern, whereby said water level can be varied during a solution mining operation, and wherein said bypass passageway is disposed within said first annular passageway and communicates between orifices in said inner and said outer conduit strings and said flow control apparatus is accessible from said inner passageway for controlling flow through said bypass passageway.

19. A flow diverting conduit string for injecting fluid into or extracting fluid from a subterranean borehole in a salt or a subterranean salt cavern, said flow diverting conduit string comprising:

an inner conduit string disposed within an outer conduit string, with an inner passageway within said inner conduit string and a first annular passageway between said inner and said outer conduit strings, wherein said flow diverting conduit string comprises at least one lateral opening in said inner or outer conduit string, said at least one lateral opening communicating with at least one of said passageways and with said borehole or cavern, and a flow control apparatus arranged to control flow of said fluid between or along said passageways to enable said flow diverting conduit string to be used for storage and extraction of gases, hydrocarbon liquids, or combinations thereof, in and from said cavern and at least one of solution mining operations, subterranean hydrocarbon separation and dewatering operations, wherein said at least one lateral opening is formed in said outer conduit string and is usable during solution mining to direct a flow of water to or receive a flow of brine from a dissolution zone in said subterranean borehole or said salt cavern, and wherein upper and lower flow diverters, plugs, or combinations thereof, are disposed within said inner passageway, each plug blocking said inner passageway and each flow diverter having a bore communicating with said inner passageway and terminating in a respective lateral opening, at least one further opening being formed in a wall of said inner conduit string between said upper and lower flow diverters, plugs, or combinations thereof, to allow flow to or from the lower flow diverter or to or from a lateral opening of the inner passageway blocked by a lower plug to cross over between the inner passageway and the first annular passageways.

20. A flow diverting conduit string for injecting fluid into or extracting fluid from a subterranean borehole in a salt or a subterranean salt cavern, said flow diverting conduit string comprising:

an inner conduit string disposed within an outer conduit string, with an inner passageway within said inner conduit string and a first annular passageway between said inner and said outer conduit strings, wherein said flow diverting conduit string comprises at least one lateral opening in said inner or outer conduit string, said at least one lateral opening communicating with at least one of said passageways and with said borehole or cavern, and a flow control apparatus arranged to control flow of said fluid between or along said passageways to enable said flow diverting conduit string to be used for storage and extraction of gases, hydrocarbon liquids, or combinations thereof, in and from said cavern and at least one of solution mining operations, subterranean hydrocarbon separation and dewatering operations, wherein said at least one lateral opening is formed in said outer conduit string and is usable during solution mining to direct a flow of water to or receive a flow of brine from a dissolution zone in said subterranean borehole or salt cavern;

a plurality of lateral openings provided at different subterranean depths within said bore or said cavern in said inner conduit string, said plurality of lateral openings being selectively openable and closable to vary the disposition of the dissolution zone; and at least one isolation conduit, wherein said at least one isolation conduit is placeable from the inner passageway of said flow diverting conduit string and is movable in an axial direction to open or close a lateral opening, bridge a discontinuous section of said inner passageway, or combinations thereof.

21. A flow diverting conduit string for injecting fluid into or extracting fluid from a subterranean borehole in a salt or a subterranean salt cavern, said flow diverting conduit string comprising:

an inner conduit string disposed within an outer conduit string, with an inner passageway within said inner conduit string and a first annular passageway between said inner and said outer conduit strings, wherein said flow diverting conduit string comprises at least one lateral opening in said inner or outer conduit string, said at least one lateral opening communicating with at least one of said passageways and with said borehole or cavern, and a flow control apparatus arranged to control flow of said fluid between or along said passageways to enable said flow diverting conduit string to be used for storage and extraction of gases, hydrocarbon liquids, or combinations thereof, in and from said cavern and at least one of solution mining operations, subterranean hydrocarbon separation and dewatering operations, wherein said at least one lateral opening is formed in said outer conduit string and is usable during solution mining to direct a flow of water to or receive a flow of brine from a dissolution zone in said subterranean borehole or said salt cavern, wherein a flow diverter is disposed in said inner passageway of said inner conduit string and has a bore communicating between said inner passageway and said at least one lateral opening, said flow diverter allowing flow past said flow diverter through said first annular passageway, and wherein an exit conduit extension projects into said subterranean borehole or said cavern through said bore of said flow diverter and a cable carrying tools for deployment in said subterranean borehole or said cavern extends through said exit conduit extension.

* * * * *